US006766892B2

(12) United States Patent
Martin et al.

(10) Patent No.: US 6,766,892 B2
(45) Date of Patent: Jul. 27, 2004

(54) COIN DISCRIMINATION APPARATUS AND METHOD

(75) Inventors: Douglas Alan Martin, Woodinville, WA (US); Mark Louis Waechter, Seattle, WA (US); Rodrigo Berho, Seattle, WA (US); John Partlow, Bakersfield, CA (US)

(73) Assignee: Coinstar, Inc., Bellevue, WA (US)

( * ) Notice: Subject to any disclaimer, the term of this patent is extended or adjusted under 35 U.S.C. 154(b) by 0 days.

(21) Appl. No.: 10/336,617

(22) Filed: Jan. 2, 2003

(65) Prior Publication Data

US 2003/0150688 A1 Aug. 14, 2003

Related U.S. Application Data

(63) Continuation of application No. 09/703,946, filed on Oct. 31, 2000, now Pat. No. 6,520,308, which is a continuation of application No. 09/105,403, filed on Jun. 26, 1998, now Pat. No. 6,196,371, which is a continuation-in-part of application No. 08/883,780, filed on Jun. 27, 1997, now Pat. No. 5,988,348, which is a continuation-in-part of application No. 08/807,046, filed on Feb. 24, 1997, now abandoned, which is a continuation of application No. 08/672,639, filed on Jun. 28, 1996, now abandoned.

(51) Int. Cl.[7] ..... G07D 5/08; G07F 1/04

(52) U.S. Cl. ..... 194/317; 194/344; 194/346; 193/DIG. 1

(58) Field of Search ..... 194/317, 215, 194/216, 217, 230, 302, 303, 344, 346; 193/DIG. 1

(56) References Cited

U.S. PATENT DOCUMENTS

| | | | |
|---|---|---|---|
| 446,303 | A | 2/1891 | Thompson |
| 1,234,707 | A | 7/1917 | Whistler |
| 2,390,147 | A | 12/1945 | Hatton |

(List continued on next page.)

FOREIGN PATENT DOCUMENTS

| | | |
|---|---|---|
| CA | 2067987 | 11/1992 |
| CA | 2060630 | 2/1999 |
| DE | 1 944 488 | 3/1971 |

(List continued on next page.)

OTHER PUBLICATIONS

"Slide Changing Apparatus With Slide Jam Protection", Research Disclosure 30509, 9/89.

(List continued on next page.)

*Primary Examiner*—Donald P. Walsh
*Assistant Examiner*—Mark J. Beauchaine
(74) *Attorney, Agent, or Firm*—Perkins Coie LLP

(57) ABSTRACT

A coin discrimination apparatus and method is provided. Coins, preferably after cleaning, e.g. using a trommel, are singulated by a coin pickup assembly configured to reduce jamming. A coin rail assists in providing separation between coins as they travel past a sensor. The sensor provides an oscillating electromagnetic field generated on a single sensing core. The oscillating electromagnetic field is composed of one or more frequency components. The electromagnetic field interacts with a coin, and these interactions are monitored and used to classify the coin according to its physical properties. All frequency components of the magnetic field are phase-locked to a common reference frequency. The phase relationships between the various frequencies are fixed, and the interaction of each frequency component with the coin can be accurately determined without the need for complicated electrical filters. In one embodiment, a sensor having a core, preferably ferrite, which is curved, such as in a U-shape or in the shape of a section of a torus, and defining a gap, is provided with a wire winding for excitation and/or detection. The sensor can be used for simultaneously obtaining data relating to two or more parameters of a coin or other object, such as size and conductivity of the object. Two or more frequencies can be used to sense core and/or cladding properties. Objects recognized as acceptable coins, using the sensor data, are diverted by a controllable deflecting door, to tubes for delivery to acceptable coin bins.

44 Claims, 65 Drawing Sheets

U.S. PATENT DOCUMENTS

| | | | | | |
|---|---|---|---|---|---|
| 2,621,665 | A | | 12/1952 | McGee | |
| 2,856,561 | A | | 12/1958 | Rosapepe | |
| 2,931,480 | A | | 4/1960 | Heim | |
| 3,065,467 | A | | 11/1962 | Prevost | |
| 3,132,654 | A | | 5/1964 | Adams | |
| 3,173,742 | A | | 3/1965 | Simjian | |
| 3,297,242 | A | | 1/1967 | Karp | |
| 3,463,171 | A | | 8/1969 | Dolman | |
| 3,589,492 | A | | 6/1971 | Shirley | |
| 3,599,771 | A | | 8/1971 | Hinterstocker | |
| 3,603,327 | A | | 9/1971 | Buchholz et al. | |
| 3,653,481 | A | | 4/1972 | Boxall et al. | |
| 3,680,566 | A | | 8/1972 | Tanaka et al. | |
| 3,752,168 | A | | 8/1973 | Bayha | |
| 3,797,307 | A | * | 3/1974 | Johnston | 73/163 |
| 3,815,717 | A | | 6/1974 | Arseneau | |
| 3,818,918 | A | | 6/1974 | Nissmo et al. | |
| 3,870,137 | A | | 3/1975 | Fourgere | |
| 3,901,368 | A | | 8/1975 | Klinger | |
| 3,948,280 | A | | 4/1976 | Dahl et al. | |
| 3,952,851 | A | | 4/1976 | Fougere et al. | |
| 3,965,912 | A | | 6/1976 | Gross | |
| 4,036,242 | A | | 7/1977 | Breitenstein et al. | |
| 4,058,954 | A | | 11/1977 | Asami | |
| 4,059,122 | A | | 11/1977 | Kinoshita | |
| 4,071,740 | A | | 1/1978 | Gogulski | |
| 4,089,400 | A | | 5/1978 | Gregory, Jr. | |
| 4,092,990 | A | | 6/1978 | Bayne | |
| 4,099,722 | A | | 7/1978 | Rodesch et al. | |
| 4,100,925 | A | | 7/1978 | Fukunaga | |
| 4,106,610 | A | | 8/1978 | Heiman | |
| 4,111,216 | A | | 9/1978 | Brisebarre | |
| 4,148,331 | A | | 4/1979 | Nicolaus | |
| 4,167,949 | A | | 9/1979 | Hashimoto et al. | |
| 4,184,366 | A | | 1/1980 | Butler | |
| 4,199,744 | A | | 4/1980 | Aldridge et al. | |
| 4,228,811 | A | | 10/1980 | Tanaka et al. | |
| 4,249,552 | A | | 2/1981 | Margolin et al. | |
| 4,266,121 | A | | 5/1981 | Hirose | |
| 4,286,704 | A | | 9/1981 | Wood | |
| 4,334,604 | A | | 6/1982 | Davies | |
| 4,356,829 | A | | 11/1982 | Furuya | |
| 4,360,034 | A | | 11/1982 | Davila et al. | |
| 4,369,800 | A | | 1/1983 | Watanabe et al. | |
| 4,380,316 | A | | 4/1983 | Glinka et al. | |
| 4,383,540 | A | | 5/1983 | De Meyer et al. | |
| 4,398,550 | A | | 8/1983 | Shireman | |
| 4,416,365 | A | | 11/1983 | Heiman | |
| 4,434,359 | A | | 2/1984 | Watanabe | |
| 4,436,103 | A | | 3/1984 | Dick | |
| 4,437,558 | A | | 3/1984 | Nicholson et al. | |
| 4,448,297 | A | | 5/1984 | Mendelsohn | |
| 4,460,003 | A | | 7/1984 | Barnes et al. | |
| 4,469,213 | A | | 9/1984 | Nicholson et al. | |
| 4,471,864 | A | | 9/1984 | Marshall | |
| 4,488,116 | A | | 12/1984 | Plesko | |
| 4,503,963 | A | | 3/1985 | Steiner | |
| 4,509,542 | A | | 4/1985 | Watanabe et al. | |
| 4,509,633 | A | | 4/1985 | Chow | |
| 4,556,140 | A | | 12/1985 | Okada | |
| 4,558,711 | A | | 12/1985 | Yoshiaki et al. | |
| 4,558,712 | A | | 12/1985 | Sentoku et al. | |
| 4,574,824 | A | | 3/1986 | Paulsen et al. | |
| 4,598,378 | A | | 7/1986 | Giacomo | |
| 4,611,205 | A | | 9/1986 | Eglise | |
| 4,622,456 | A | | 11/1986 | Naruto et al. | |
| 4,625,851 | A | | 12/1986 | Johnson et al. | |
| 4,667,093 | A | * | 5/1987 | MacDonald | 250/223 R |
| 4,706,577 | A | | 11/1987 | Jones | |
| 4,716,799 | A | | 1/1988 | Hartmann | |
| 4,723,212 | A | | 2/1988 | Mindrum et al. | |
| 4,733,765 | A | | 3/1988 | Watanabe | |
| 4,753,625 | A | | 6/1988 | Okada | |
| 4,754,862 | A | | 7/1988 | Rawicz-Szczerbo et al. | |
| 4,809,838 | A | | 3/1989 | Houserman | |
| 4,842,119 | A | | 6/1989 | Abe | |
| 4,872,618 | A | | 10/1989 | Sato et al. | |
| 4,883,158 | A | | 11/1989 | Kobayashi et al. | |
| 4,884,672 | A | | 12/1989 | Parker | |
| 4,910,672 | A | | 3/1990 | Off et al. | |
| 4,914,381 | A | | 4/1990 | Narod | |
| 4,921,463 | A | | 5/1990 | Primdahl et al. | |
| 4,926,997 | A | | 5/1990 | Parker | |
| 4,936,435 | A | | 6/1990 | Griner | |
| 4,936,436 | A | | 6/1990 | Keltner | |
| 4,950,986 | A | | 8/1990 | Guerrero | |
| 4,953,086 | A | | 8/1990 | Fukatsu | |
| 4,960,196 | A | | 10/1990 | Kanehara et al. | |
| 4,964,495 | A | | 10/1990 | Rasmussen | |
| 4,978,322 | A | | 12/1990 | Paulsen | |
| 4,995,497 | A | | 2/1991 | Kai et al. | |
| 4,995,848 | A | | 2/1991 | Goh | |
| 4,997,406 | A | | 3/1991 | Horiguchi et al. | |
| 5,021,967 | A | | 6/1991 | Smith | |
| 5,025,139 | A | | 6/1991 | Halliburton, Jr. | |
| 5,030,165 | A | | 7/1991 | Nilsson et al. | |
| 5,039,848 | A | | 8/1991 | Stoken | |
| 5,040,657 | A | | 8/1991 | Gunn et al. | |
| 5,042,635 | A | * | 8/1991 | Bell | 194/346 |
| 5,056,644 | A | | 10/1991 | Parker | |
| 5,067,604 | A | | 11/1991 | Metcalf | |
| 5,078,252 | A | | 1/1992 | Furuya et al. | |
| 5,083,765 | A | | 1/1992 | Kringel | |
| 5,091,713 | A | | 2/1992 | Horne et al. | |
| 5,098,339 | A | | 3/1992 | Dabrowski | |
| 5,131,885 | A | | 7/1992 | Nakao et al. | |
| 5,145,046 | A | * | 9/1992 | Satoh | 194/203 |
| 5,167,571 | A | | 12/1992 | Waller | |
| 5,173,851 | A | | 12/1992 | Off et al. | |
| 5,191,957 | A | | 3/1993 | Hayes | |
| 5,199,545 | A | | 4/1993 | Takamisawa et al. | |
| 5,217,100 | A | * | 6/1993 | Thompson et al. | 194/346 |
| 5,219,059 | A | | 6/1993 | Furuya et al. | |
| 5,226,520 | A | | 7/1993 | Parker | |
| 5,236,074 | A | | 8/1993 | Gotaas | |
| 5,244,070 | A | | 9/1993 | Carmen et al. | |
| 5,254,032 | A | | 10/1993 | Abe | |
| 5,263,566 | A | | 11/1993 | Nara et al. | |
| 5,279,404 | A | | 1/1994 | Bruner et al. | |
| 5,285,883 | A | | 2/1994 | Le Hong et al. | |
| 5,291,782 | A | | 3/1994 | Taylor | |
| 5,293,979 | A | | 3/1994 | Levasseur | |
| 5,293,980 | A | | 3/1994 | Parker | |
| 5,299,673 | A | | 4/1994 | Wu | |
| 5,316,120 | A | | 5/1994 | Ibarrola | |
| 5,321,242 | A | | 6/1994 | Heath, Jr. | |
| 5,323,891 | A | | 6/1994 | Waite | |
| 5,326,312 | A | | 7/1994 | Patroni | |
| 5,346,049 | A | | 9/1994 | Nakajima et al. | |
| 5,351,798 | A | | 10/1994 | Hayes | |
| 5,379,875 | A | | 1/1995 | Shames et al. | |
| 5,386,901 | A | | 2/1995 | Ibarrola et al. | |
| 5,386,902 | A | * | 2/1995 | Bointon et al. | 194/346 |
| 5,388,680 | A | | 2/1995 | Hird et al. | |
| 5,392,891 | A | | 2/1995 | Ferguson et al. | |
| 5,404,985 | A | | 4/1995 | Baughman | |
| 5,431,270 | A | | 7/1995 | Wohlrab et al. | |
| 5,433,310 | A | | 7/1995 | Bell | |
| 5,439,089 | A | | 8/1995 | Parker | |
| 5,449,058 | A | | 9/1995 | Kotler et al. | |
| 5,452,785 | A | | 9/1995 | Iwamoto et al. | |

| | | | | | |
|---|---|---|---|---|---|
| 5,458,225 | A | | 10/1995 | Iwamoto et al. | |
| 5,460,256 | A | * | 10/1995 | Levasseur | 194/334 |
| 5,469,952 | A | | 11/1995 | Kershaw et al. | |
| 5,484,334 | A | | 1/1996 | Evdokimo | |
| 5,489,015 | A | | 2/1996 | Wood | |
| 5,494,145 | A | | 2/1996 | Cohrs et al. | |
| 5,494,147 | A | | 2/1996 | Takahashi et al. | |
| 5,501,633 | A | | 3/1996 | Watkins et al. | |
| 5,515,960 | A | | 5/1996 | Wood | |
| 5,535,872 | A | * | 7/1996 | Smith et al. | 194/317 |
| 5,564,546 | A | | 10/1996 | Molbak et al. | |
| 5,616,074 | A | | 4/1997 | Chen | |
| 5,620,079 | A | | 4/1997 | Molbak | |
| 5,695,395 | A | | 12/1997 | Ota et al. | |
| 5,788,046 | A | * | 8/1998 | Lamah | 194/317 |
| 5,901,828 | A | * | 5/1999 | Monie | 194/346 |
| 5,909,793 | A | * | 6/1999 | Beach et al. | 194/210 |
| 5,988,348 | A | | 11/1999 | Martin et al. | |
| 6,047,808 | A | | 4/2000 | Neubarth et al. | |
| 6,053,300 | A | * | 4/2000 | Wood et al. | 194/317 |
| 6,056,104 | A | | 5/2000 | Neubarth et al. | |
| 6,196,371 | B1 | | 3/2001 | Martin et al. | |
| 2002/0011394 | A1 | * | 1/2002 | Kuwabara et al. | 194/217 |

FOREIGN PATENT DOCUMENTS

| | | | |
|---|---|---|---|
| DE | 25 16 532 | A1 | 10/1975 |
| DE | 25 28 735 | A1 | 4/1976 |
| DE | 30 21 327 | A1 | 12/1981 |
| DE | 288 018 | A5 | 3/1991 |
| EP | 0 060 392 | B1 | 9/1982 |
| EP | 0 209 357 | B1 | 1/1987 |
| EP | 0 300 781 | B1 | 1/1989 |
| EP | 0 724 237 | B1 | 7/1996 |
| GB | 2198274 | A | 6/1988 |
| JP | 1-307891 | A | 12/1989 |
| JP | 3-63795 | A | 3/1991 |
| JP | 3-92994 | A | 4/1991 |
| WO | SE87/00102 | | 9/1987 |
| WO | WO 87/05729 | A1 | 9/1987 |
| WO | GB88/00274 | | 10/1988 |
| WO | WO 88/08174 | A1 | 10/1988 |
| WO | GB88/00592 | | 2/1989 |
| WO | WO 89/01209 | A1 | 2/1989 |
| WO | DK91/00209 | | 2/1993 |
| WO | WO 93/02431 | A1 | 2/1993 |
| WO | US93/07846 | | 4/1994 |
| WO | WO 94/09440 | A1 | 4/1994 |
| WO | US95/05356 | | 11/1995 |
| WO | WO 95/30215 | A1 | 11/1995 |

OTHER PUBLICATIONS

F. Zimmerman & Co., "Reference Manual Contovit/Sortovit, Perconta Money Counting and Sorting Systems", 8/95, pp. I–III, 1–31, and three pages of specifications.

Hamilton, "Turning Cans into Cold Cash", *The Washington Post,* Jul. 2, 1991, pp. D1, D4, 194–209.

Reis Eurosystems Geldbearbeitungssysteme, "Test–Programme CS 3110 Selectronic coin sorting and counting machine ", 7/92, pp. 1–3.

Reis Eurosystems, "Operating Instructions CS 3110 Selectronic Coin Sorting and Counting Machine With Central Sensor", 7/92, pp. 1–12, I–IV.

"The Electrical Engineering Handbook", 2$^{nd}$ Edition, CRC Press and IEEE, 1997, edited by Richard C. Dorf, pp. 23–31.

* cited by examiner

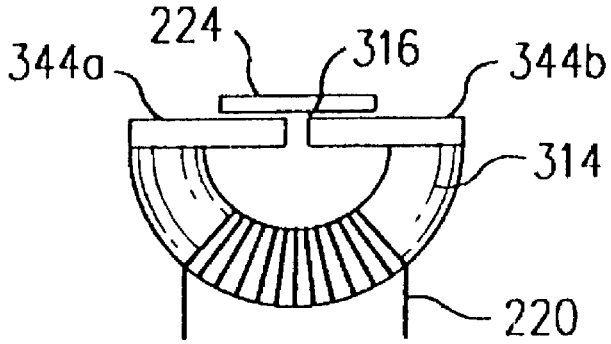
*Fig. 3*
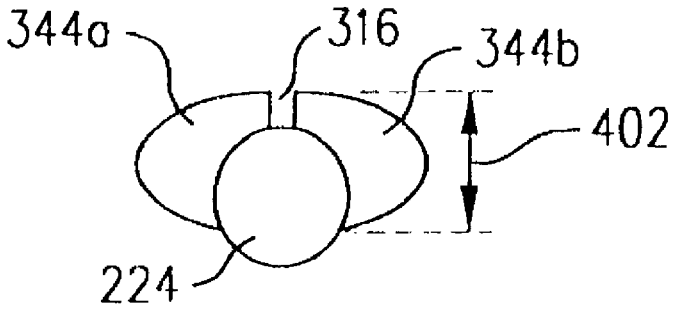
*Fig. 4*
| | | | | |
|---|---|---|---|---|
| FIG. 31A | FIG. 31B | FIG. 31C | FIG. 31D | FIG. 31E |
| | FIG. 31F | FIG. 31G | FIG. 31H | FIG. 31 I |
*Fig. 31*

| FIG. 8B-1 | FIG. 8B-2 |
|---|---|

| FIG. 35A | FIG. 35B |
|---|---|

22A 2112
2111
2116
2606
2106a
2106b
2152
2106c
2104
56
2108a
2114
2154
2108b
2156
2108c
2112
2134
2133
2114
2132
2108c
2104
62
2308a
2136b
2308b
2109
2306
2304
2812a
2812b
58
2306
2106
2104
2307
2332
2336
2342
62
2335
2334
2344
2308a
2306
2106
2312
2323
62
2306
56
2104
2106b
2132
2392
2136a
2134

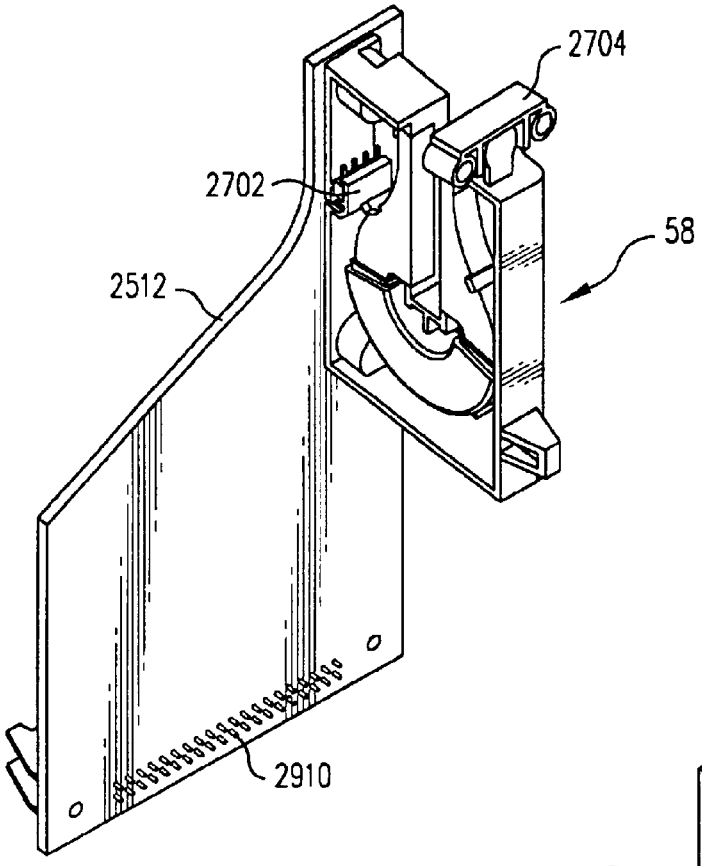
*Fig. 27A*
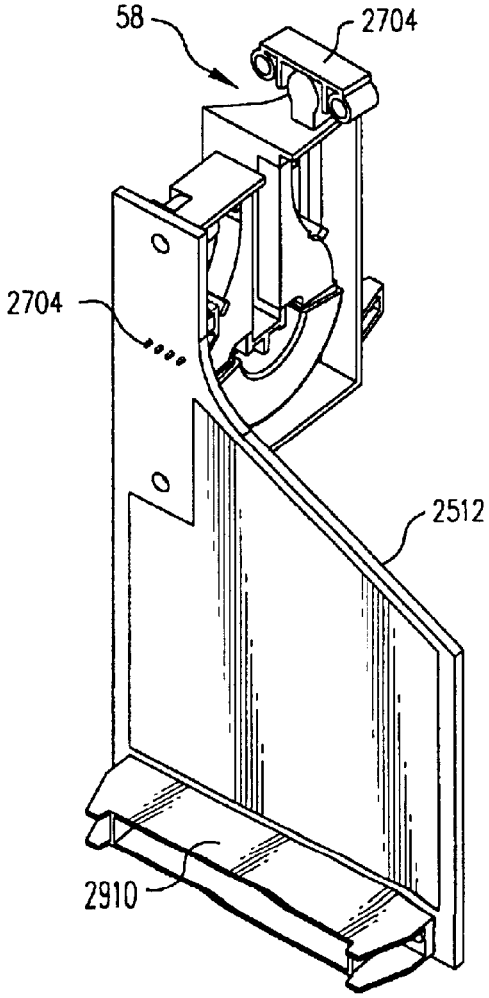
*Fig. 27B*
| FIG. 29A | FIG. 29B |
|---|---|
*Fig. 29*

COIN DISCRIMINATION APPARATUS AND METHOD

The present application is a continuation of U.S. application Ser. No. 09/703,946 filed Oct. 31, 2000 now U.S. Pat. No. 6,520,308, which is a continuation of U.S. application Ser. No. 09/105,403 filed Jun. 26, 1998 (now U.S. Pat. No. 6,196,371), which is a continuation-in-part of U.S. application Ser. No. 08/883,780 filed Jun. 27, 1997 (now U.S. Pat. No. 5,988,348), which is a continuation-in-part of U.S. application Ser. No. 08/807,046 filed Feb. 24, 1997, now abandoned, which is a continuation of U.S. application Ser. No. 08/672,639 filed Jun. 28, 1996, now abandoned; all are incorporated herein in their entireties by reference.

The present invention relates to an apparatus and method for sensing coins and other small discrete objects, and in particular to an apparatus which may be used in coin counting or handling.

BACKGROUND INFORMATION

A number of devices are intended to identify and/or discriminate coins or other small discrete objects. One example is coin counting or handling devices, (such as those described in U.S. patent application Ser. No. 08/255,539, now U.S. Pat. No. 5,564,546, and its continuation application Ser. Nos. 08/689,826, 08/237,486, now U.S. Pat. No. 5,620,079 and its continuation Ser. Nos. 08/834,952, filed Apr. 7, 1997, and 08/431,070, all of which are incorporated herein by reference). Other examples include vending machines, gaming devices such as slot machines, bus or subway coin or token "fare boxes," and the like. Preferably, for such purposes, the sensors provide information which can be used to discriminate coins from non-coin objects and/or which can discriminate among different coin denominations and/or discriminate coins of one country from those of another.

Previous coin handling devices, and sensors therein, however, have suffered from a number of deficiencies. Many previous sensors have resulted in an undesirably large proportion of discrimination errors. At least in some cases this is believed to arise from an undesirably small signal to noise ratio in the sensor output. Accordingly, it would be useful to provide coin discrimination sensors having improved signal to noise ratio.

Many previous coin handling devices, and associated sensors, were configured to receive only one coin at a time, such as a typical vending machine which receives a single coin at a time through a coin slot. These devices typically present an easier coin handling and sensing environment because there is a lower expectation for coin throughput, an avoidance of the deposit of foreign material, an avoidance of small inter-coin spacing (or coin overlap), and because the slot naturally defines maximum coin diameter and thickness. Coin handlers and sensors that might be operable for a one-at-a-time coin environment may not be satisfactory for an environment in which a mass or plurality of coins can be received in a single location, all at once (such as a tray for receiving a mass of coins, poured into the tray from, e.g., a coin jar). Accordingly it would be useful to provide a coin handler and/or sensor which, although it might be successfully employed in a one-coin-at-a-time environment, can also function satisfactorily in a device which receives a mass of coins.

Many previous sensors and associated circuitry used for coin discrimination were configured to sense characteristics or parameters of coins (or other objects) so as to provide data relating to an average value for a coin as a whole. Such sensors and circuitry were not able to provide information specific to certain regions or levels of the coin (such as core material vs. cladding material). In some currencies, two or more denominations may have average characteristics which are so similar that it is difficult to distinguish the coins. For example, it is difficult to distinguish U.S. dimes from pre-1982 U.S. pennies, based only on average differences, the main physical difference being the difference in cladding (or absence thereof). In some previous devices, inductive coin testing is used to detect the effect of a coin on an alternating electromagnetic field produced by a coil, and specifically the coin's effect upon the coil's impedance, e.g. related to one or more of the coin's diameter, thickness, conductivity and permeability. In general, when an alternating electromagnetic field is provided to such a coil, the field will penetrate a coin to an extent that decreases with increasing frequency. Properties near the surface of a coin have a greater effect on a higher frequency field, and interior material have a lesser effect. Because certain coins, such as the United States ten and twenty-five cent coins, are laminated, this frequency dependency can be of use in coin discrimination, but, it is believed, has not previously been used in this manner. Accordingly, it would further be useful to provide a device which can provide information relating to different regions of coins or other objects.

Although there are a number of parameters which, at least theoretically, can be useful in discriminating coins and small objects (such as size, including diameter and thickness), mass, density, conductivity, magnetic permeability, homogeneity or lack thereof (such as cladded or plated coins), and the like, many previous sensors were configured to detect only a single one of such parameters. In embodiments in which only a single parameter is used, discrimination among coins and other small objects was often inaccurate, yield both misidentification of a coin denomination (false positives), and failure to recognize a coin denomination (false negatives). In some cases, two coins which are different may be identified as the same coin because a parameter which could serve to discriminate between the coins (such as presence or absence of plating, magnetic non-magnetic character of the coin, etc.) is not detected by the sensor. Thus, using such sensors, when it is desired to use several parameters to discriminate coins and other objects, it has been necessary to provide a plurality of sensors (if such sensors are available), typically one sensor for each parameter to be detected. Multiplying the number of sensors in a device increases the cost of fabricating, designing, maintaining and repairing such apparatus. Furthermore, previous devices typically required that multiple sensors be spaced apart, usually along a linear track which the coins follow, and often the spacing must be relatively far apart in order to properly correlate sequential data from two sensors with a particular coin (and avoid attributing data from the two sensors to a single coin when the data was related, in fact, to two different coins). This spacing increases the physical size requirements for such a device, and may lead to an apparatus which is relatively slow since the path which the coins are required to traverse is longer.

Furthermore, when two or more sensors each output a single parameter, it is typically difficult or impossible to base discrimination on the relationship or profile of one parameter to a second parameter for a given coin, because of the difficulty in knowing which point in a first parameter profile corresponds to which point in a second parameter profile. If there are multiple sensors spaced along the coin path, the software for coin discrimination becomes more complicated, since it is necessary to keep track of when a coin passes by the various sensors. Timing is affected, e.g., by speed variations in the coins as they move along the coin patch, such as rolling down a rail.

Even in cases where a single core is used for two different frequencies or parameters, many previous devices take measurements at two different times, typically as the coin moves through different locations, in order to measure several different parameters. For example, in some devices, a core is arranged with two spaced-apart poles with a first measurement taken at a first time and location when a coin is adjacent a first pole, and a second measurement taken at a second, later time, when the coin has moved substantially toward the second pole. It is believed that, in general, providing two or more different measurement locations or times, in order to measure two or more parameters, or in order to use two or more frequencies, leads to undesirable loss of coin throughput, occupies undesirably extended space and requires relatively complicated circuits and/or algorithms (e.g. to match up sensor outputs as a particular coin moves to different measurement locations).

Some sensors relate to the electrical or magnetic properties of the coin or other object, and may involve creation of an electromagnetic field for application to the coin. With many previous sensors, the interaction of generated magnetic flux with the coin was too low to permit the desired efficiency and accuracy of coin discrimination, and resulted in an insufficient signal-to-noise ratio.

Many previous coin handling devices and sensors had characteristics which were undesirable, especially when the devices were for use by untrained users. Such previous devices had insufficient accuracy, short service life, had an undesirably high potential for causing user injuries, were difficult to use, requiring training or extensive instruction, failed, too often, to return unprocessed coins to the user, took too long to process coins, had an undesirably low throughput, were susceptible to frequent jamming, which could not be cleared without human intervention, often requiring intervention by trained personnel, could handle only a narrow range of coin types, or denominations, were overly sensitive to wet or sticky coins or foreign or non-coin objects, either malfunctioning or placing the foreign objects in the coin bins, rejected an undesirably high portion of good coins, required frequent and/or complicated set-up, calibration or maintenance, required too large a volume or footprint, were overly-sensitive to temperature variations, were undesirably loud, were hard to upgrade or retrofit to benefit from new technologies or ideas, and/or were difficult or expensive to design and manufacture Accordingly, it would be advantageous to provide a coin handler and/or sensor device having improved discrimination and accuracy, reduced costs or space requirements, which is faster than previous devices, easier or less expensive to design, construct, use and maintain, and/or results in improved signal-to-noise ratio.

SUMMARY OF THE INVENTION

The present invention provides a device for processing and/or discriminating coins or other objects, such as discriminating among a plurality of coins or other objects received all at once, in a mass or pile, from the user, with the coins or objects being of many different sizes, types or denominations. The device has a high degree of automation and high tolerance for foreign objects and less-than-pristine objects (such as wet, sticky, coated, bent or misshapen coins), so that the device can be readily used by members of the general public, requiring little, if any, training or instruction and little or no human manipulation or intervention, other than inputting the mass of coins.

According to one embodiment of the invention, after input and, preferably, cleaning, coins are singulated and move past a sensor for discrimination, counting and/or sorting. In general, coin slowing or adhesion is reduced by avoiding avoiding extensive flat regions in surfaces which contact coins (such as making such surfaces curved, quilted or dimpled). Coin paths are configured to flare or widen in the direction of coin travel to avoid jamming.

A singulating coin pickup assembly is preferably provided with two or more concentrically-mounted disks, one of which includes an integrated exit ledge. Movable paddles flex to avoid creating or exacerbating jams and deflect over the coin exit ledge. Vertically stacked coins tip backwards into a recess and slide over supporting coins to facilitate singulation. At the end of a transaction, coins are forced along the coin path by a rake, and debris is removed through a trap door. Coins exiting the coin pickup assembly are tipped away from the face-support rail to minimize friction.

According to one embodiment of the present invention, a sensor is provided in which nearly all the magnetic field produced by the coil interacts with the coin providing a relatively intense electromagnetic field in the region traversed by a coin or other object. Preferably, the sensor can be used to obtain information on two different parameters of a coin or other object. In one embodiment, a single sensor provides information indicative of both size, (diameter) and conductivity. In one embodiment, the sensor includes a core, such as a ferrite or other magnetically permeable material, in a curved (e.g., torroid or half-torroid) shape which defines a gap. The coin being sensed moves through the vicinity of the gap, in one embodiment, through the gap. In one embodiment, the core is shaped to reduce sensitivity of the sensor to slight deviations in the location of the coin within the gap (bounce or wobble). As a coin or the object passes through the field in the vicinity of the gap, data relating to coin parameters are sensed, such as changes in inductance (from which the diameter of the object or coin, or portions thereof, can be derived), and the quality factor (Q factor), related to the amount of energy dissipated (from which conductivity of the object or coin, or portions thereof, can be obtained).

In one embodiment, data relating to conductance of the coin (or portions thereof) as a function of diameter are analyzed (e.g. by comparing with conductance-diameter data for known coins) in order to discriminate the sensed coins. Preferably, the detection procedure uses several thresholds or window parameters to provide high recognition accuracy.

According to one aspect of the invention, a coin discrimination apparatus and method is provided in which an oscillating electromagnetic field is generated on a single sensing core. The oscillating electromagnetic field is composed of one or more frequency components. The electromagnetic field interacts with a coin, and these interactions are monitored and used to classify the coin according to its physical properties. All frequency components of the magnetic field are phase-locked to a common reference frequency. The phase relationships between the various frequencies are locked in order to avoid interference between frequencies and with any neighboring cores or sensors and to facilitate accurate determination of the interaction of each frequency component with the coin.

In one embodiment, low and high frequency coils on the core form a part of oscillator circuits. The circuits are configured to maintain oscillation of the signal through the coils at a substantially constant frequency, even as the effective inductance of the coil changes (e.g. in response to passage of a coin). The amount of change in other components of the circuit needed to offset the change in inductance (and thus maintain the frequency at a substantially constant value) is a measure of the magnitude of the change in the inductance caused by the passage of the coin, and indicative of coin diameter.

In addition to providing information related to coin diameter, the sensor can also be used to provide information related to coin conductance, preferably substantially simultaneously with providing the diameter information. As a coin moves past the coil, there will be an amount of energy loss and the amplitude of the signal in the coil will change in a manner related to the conductance of the coin (or portions thereof). For a given effective diameter of the coin, the energy loss in the eddy currents will be inversely related to the conductivity of the coin material penetrated by the magnetic field.

Preferably, the coin pickup assembly and sensor regions are configured for easy access for cleaning and maintenance, such as by providing a sensor block which slides away from the coin path and can be re-positioned without recalibration. In one embodiment, the diverter assembly is hinged to permit it to be tipped outward for access. Preferably, coins which stray from the coin path are deflected, e.g. via a ramped sensor housing and/or bypass chutes, to a customer return area.

Coins which are recognized and properly positioned or spaced are deflected out of the default (gravity-fed) coin path into an acceptance bin or trolley. Any coins or other objects which are not thus actively accepted travel along a default path to the customer return area. Preferably, information is sensed which permits an estimate of coin velocity and/or acceleration so that the deflector mechanism can be timed to deflect coins even though different coins may be traveling at different velocities (e.g. owing to stickiness or adhesion). In one embodiment, each object is individually analyzed to determine if it is a coin that should be accepted (i.e. is recognized as an acceptable coin denomination), and, if so, if it is possible to properly deflect the coin (e.g. it is sufficiently spaced from adjacent coins). By requiring that active steps be taken to accept a coin (i.e. by making the default path the "reject" path), it is more likely that all accepted objects will in fact be members of an acceptable class, and will be accurately counted.

BRIEF DESCRIPTION OF THE DRAWINGS

FIG. 3 is a front elevational view of a sensor and adjacent coin, according to another embodiment of the present invention;

FIG. 4 is a top plan view of the sensor of FIG. 3;

FIGS. 22–22A are perspective views of the system of FIG. 17, showing an example of coin locations;

FIGS. 27A and 27B are front and rear perspective views of a sensor and sensor board according to an embodiment of the present invention;

DETAILED DESCRIPTION OF THE PREFERRED EMBODIMENTS

Figure 1A:
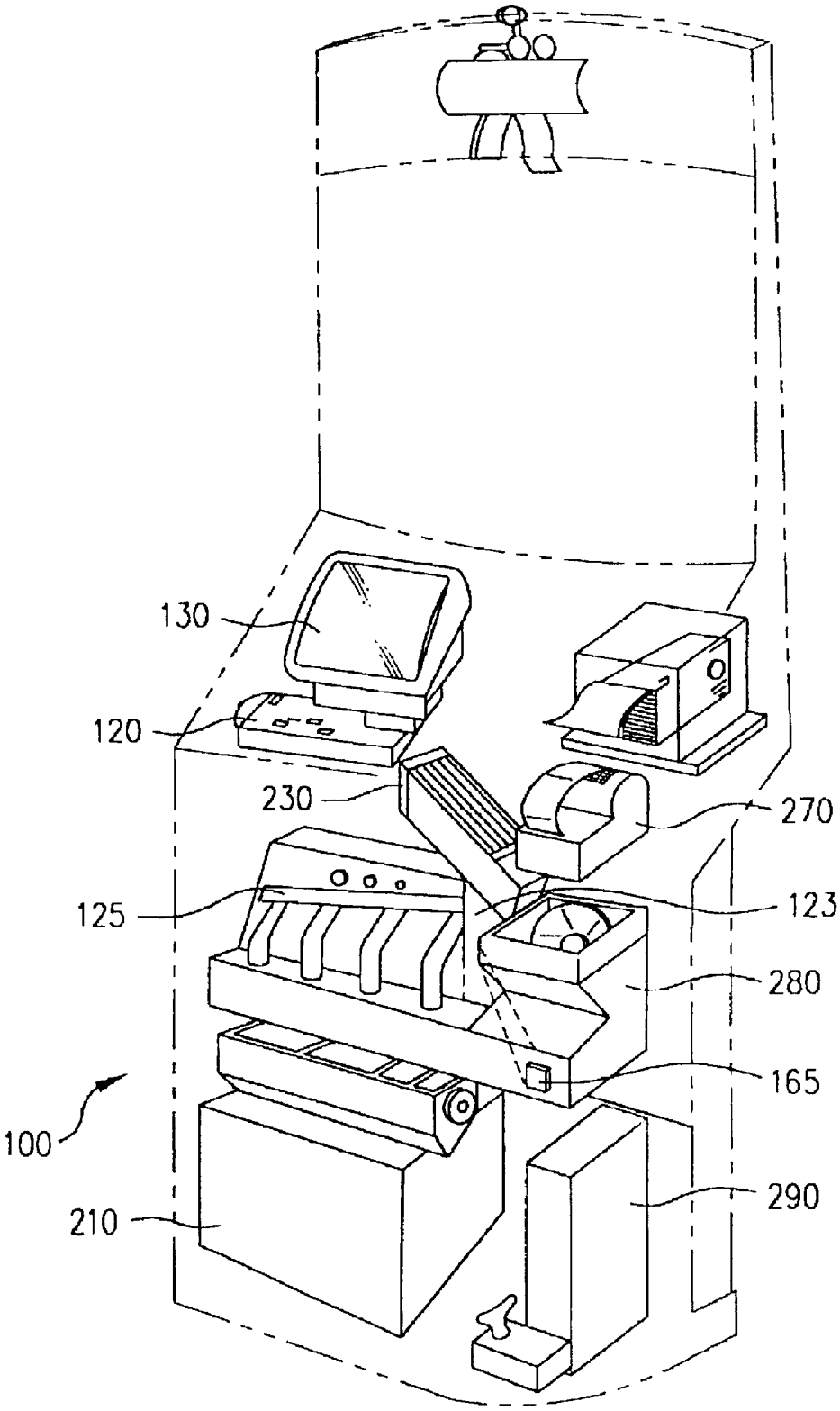
FIG. 1A depicts a coin handling apparatus that may be used in connection with an embodiment of the present invention.

The sensor and associated apparatus described herein can be used in connection with a number of devices and purposes. One device is illustrated in FIG. 1A. In this device, coins are placed into a tray 120, and fed to a sensor region 123 via a first ramp 230 and coin pickup assembly 280. In the sensor region 123, data is collected by which coins are discriminated from non-coin objects, and different denominations or countries of coins are discriminated. The data collected in the sensor area 123 is used by the computer at 290 to control movement of coins along a second ramp 125 in such a way as to route the coins into one of plurality of bins 210. The computer may output information such as the total value of the coins placed into the tray, via a printer 270, screen 130, or the like. In the depicted embodiment, the conveyance apparatus 230, 280 which is upstream of the sensor region 123 provides the coins to the sensor area 123 serially, one at a time.

Figure 1B:
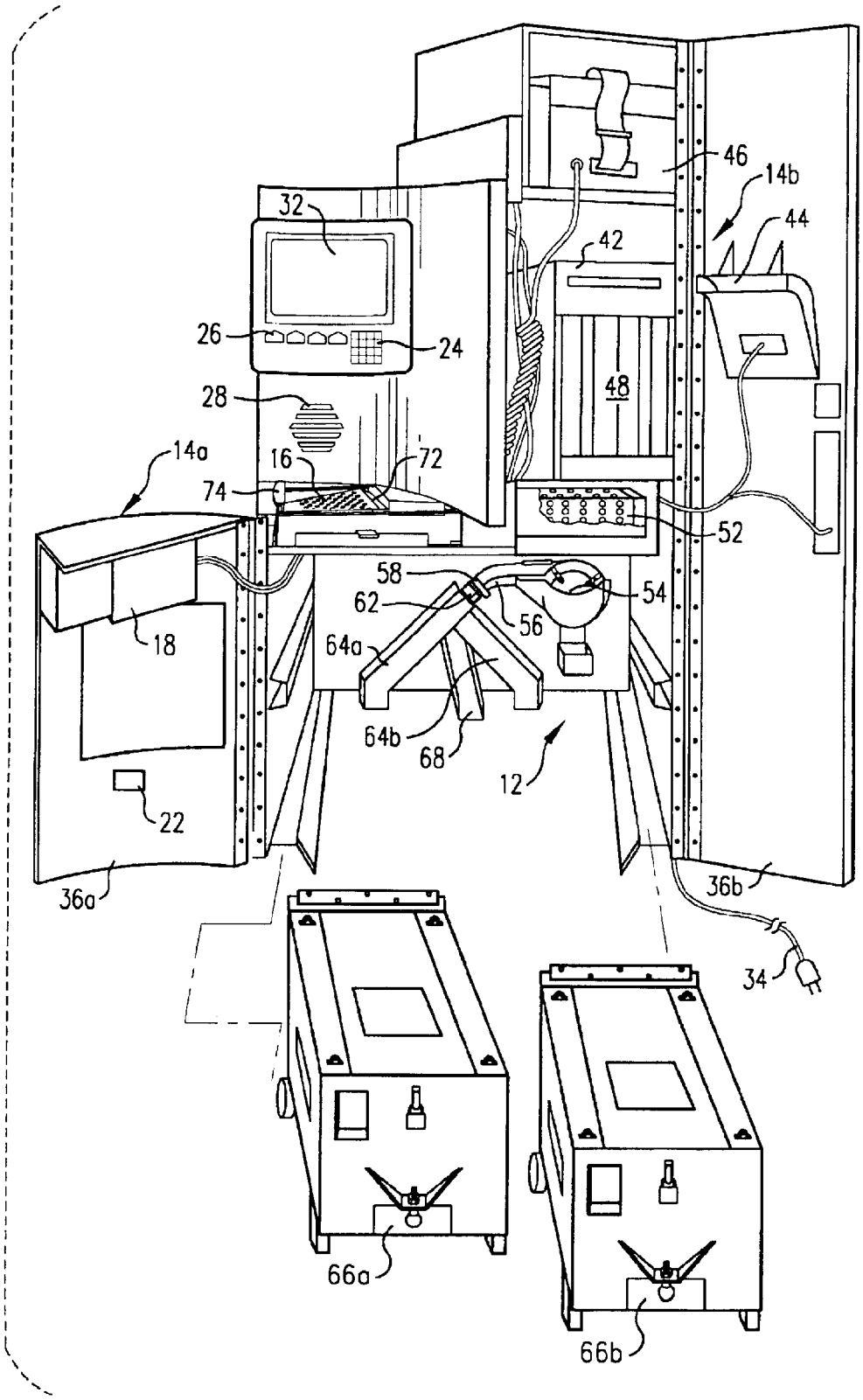
FIG. 1B depicts a coin handling apparatus according to an embodiment of the present invention.

The embodiment depicted in FIG. 1B generally includes a coin counting/sorting portion 12 and a coupon/voucher dispensing portions 14*a,b*. In the depicted embodiment, the coin counting portion 12 includes an input tray 16, a voucher dispensing region 18, a coin return region 22, and customer I/O devices, including a keyboard 24, additional keys 26, a speaker 28 and a video screen 32. The apparatus can include various indicia, signs, displays, advertisement and the like on its external surfaces. A power cord 34 provides power to the mechanism as described below.

Preferably, when the doors 36*a,* 36*b* are in the open position as shown, most or all of the components are accessible for cleaning and/or maintenance. In the depicted embodiment, a voucher printer 23 (FIG. 41) is mounted on the inside of the door 36*a*. A number of printers can be used for this purpose. In one embodiment, a model KLDS0503 printer, available from Axioh is used. The right-hand portion of the cabinet includes the coupon feeder 42 for dispensing e.g., pre-printed manufacturer coupon sheets through a chute 44 to a coupon hopper on the outside portion of the door 36*b*. A computer 46, in the depicted embodiment, is positioned at the top of the right hand portion of the cabinet in order to provide a relatively clean, location for the computer. An I/O board 48 is positioned adjacent the sheet feeder 42.

The general coin path for the embodiment depicted in FIG. 1B is from the input tray 16, down first and second chutes to a trommel 52, to a coin pickup assembly 54, along a coin rail 56 and past a sensor 58. If, based on sensor data, it is determined that the coin can and should be accepted, a controllable deflector door 62 is activated to divert coins from their gravitational path to coin tubes 64*a, b* for delivery to coin trolleys 66*a, b*. If it has not been determined that a coin can and should be accepted, the door 62 is not activated and coins (or other objects) continue down their gravitational or default path to a reject chute 68 for delivery to a customer-accessible reject or return box 22.

Devices that may be used in connection with the input tray are described in U.S. Ser. Nos. 08/255,539, now U.S. Pat. No. 5,564,546, 08/237,486, now U.S. Pat. No. 5,620,079, supra.

Devices that may be used in connection with the coin trolleys 66*a,* 66*b* are described in Ser. No. 08/883,776, for COIN BIN WITH LOCKING LID, incorporated herein by reference.

Figure 48:
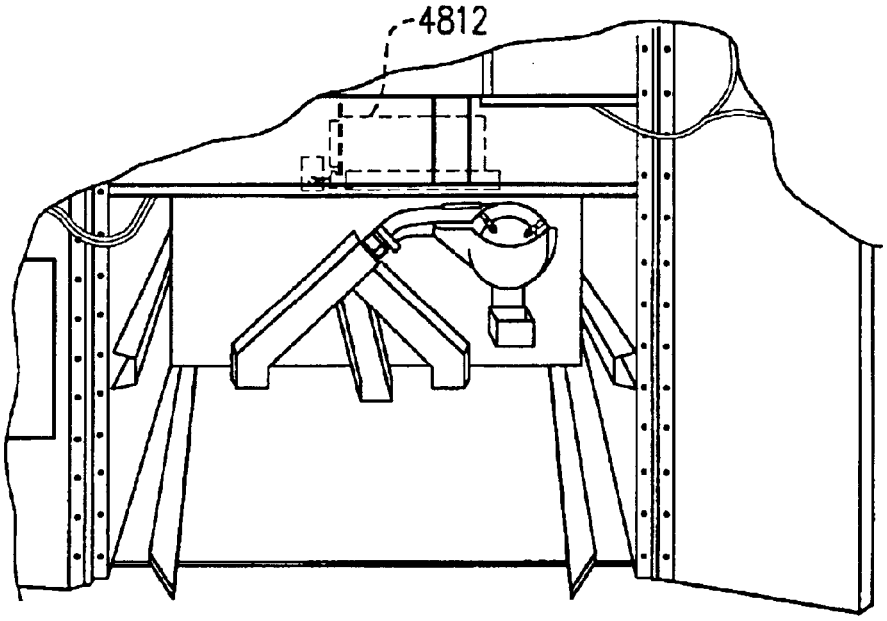
FIG. 48 is a partial perspective view showing the relative position of a trommel according to an embodiment of the present invention.
Figure 49:
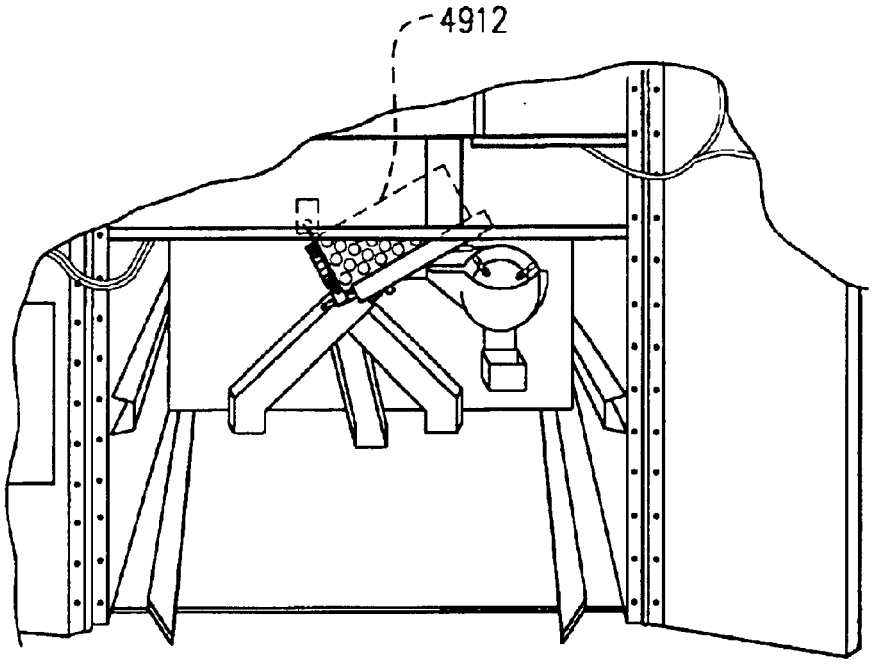
FIG. 49 is a partial perspective view corresponding to FIG. 48 but with the trommel tilted downward.
Figure 50:
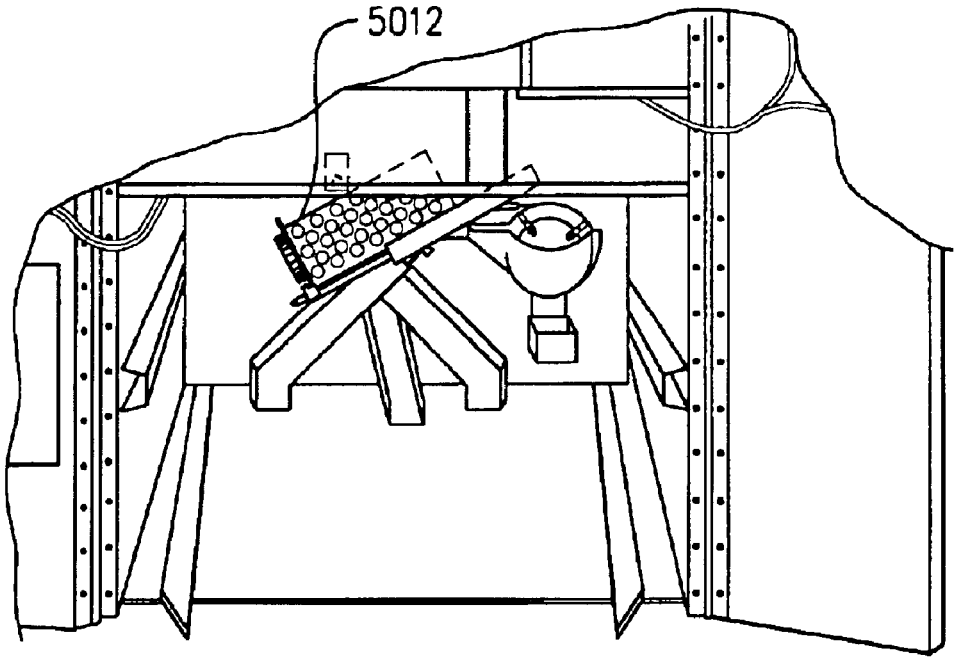
FIG. 50 is a partial perspective view corresponding to FIG. 49 but with the trommel partially retracted from the cradle.
Figure 52:
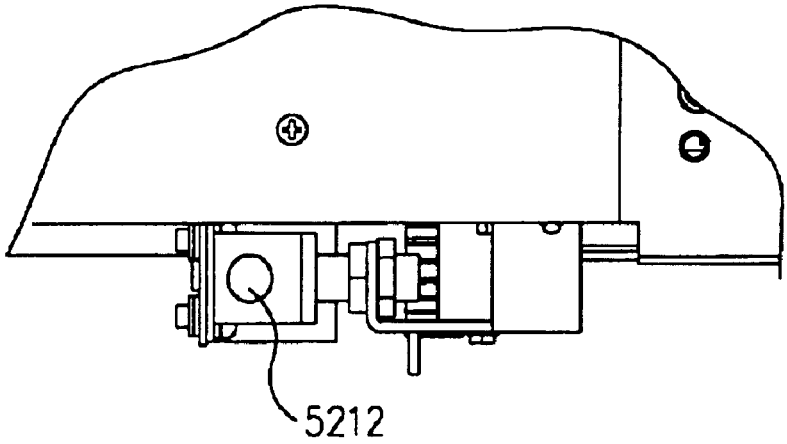
FIG. 52 is a partial rear elevational view showing a trommel release mechanism, according to an embodiment of the present invention.
Figure 51:
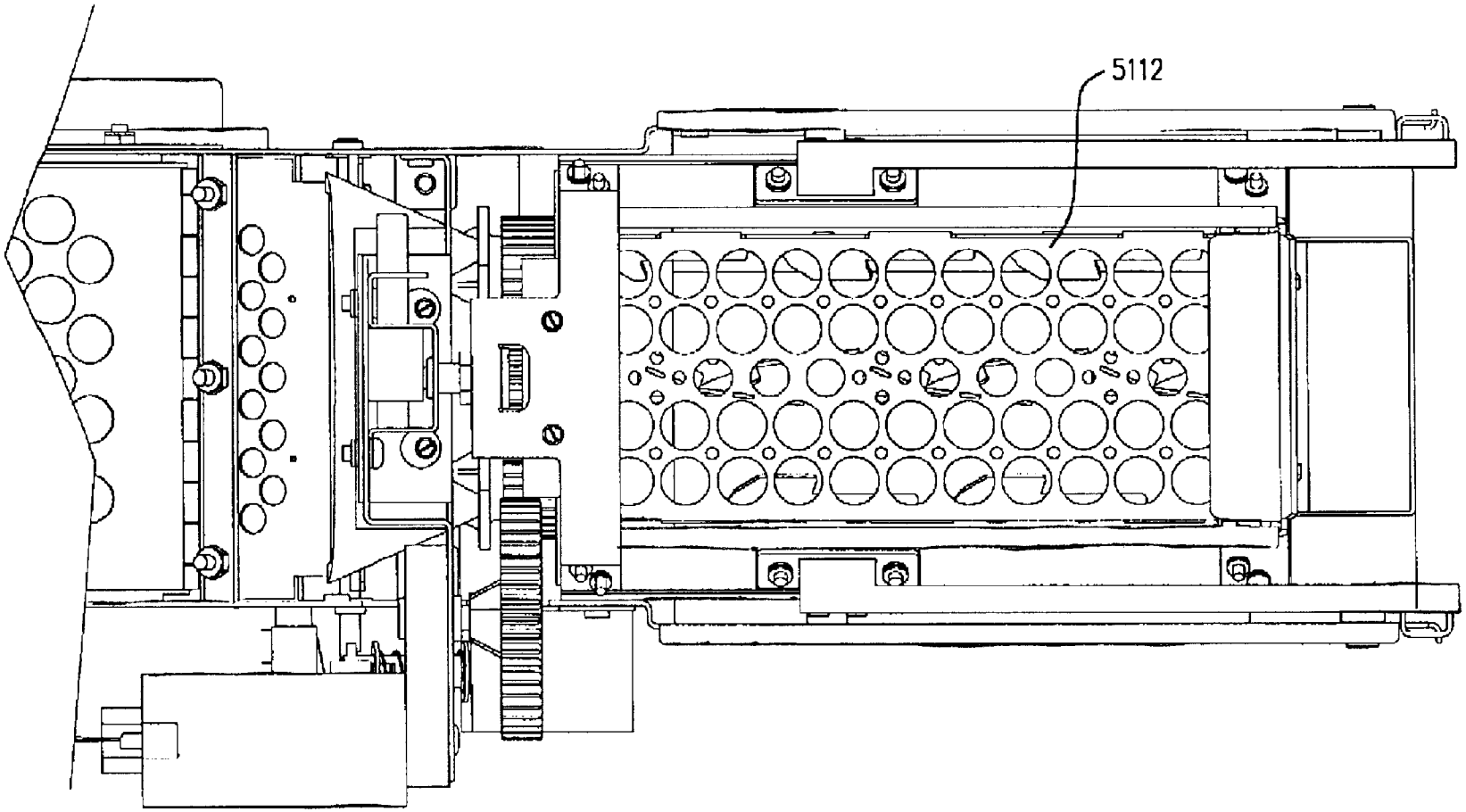
FIG. 51 is a partial top plan view showing a trommel according to an embodiment of the present invention.
Figure 53:
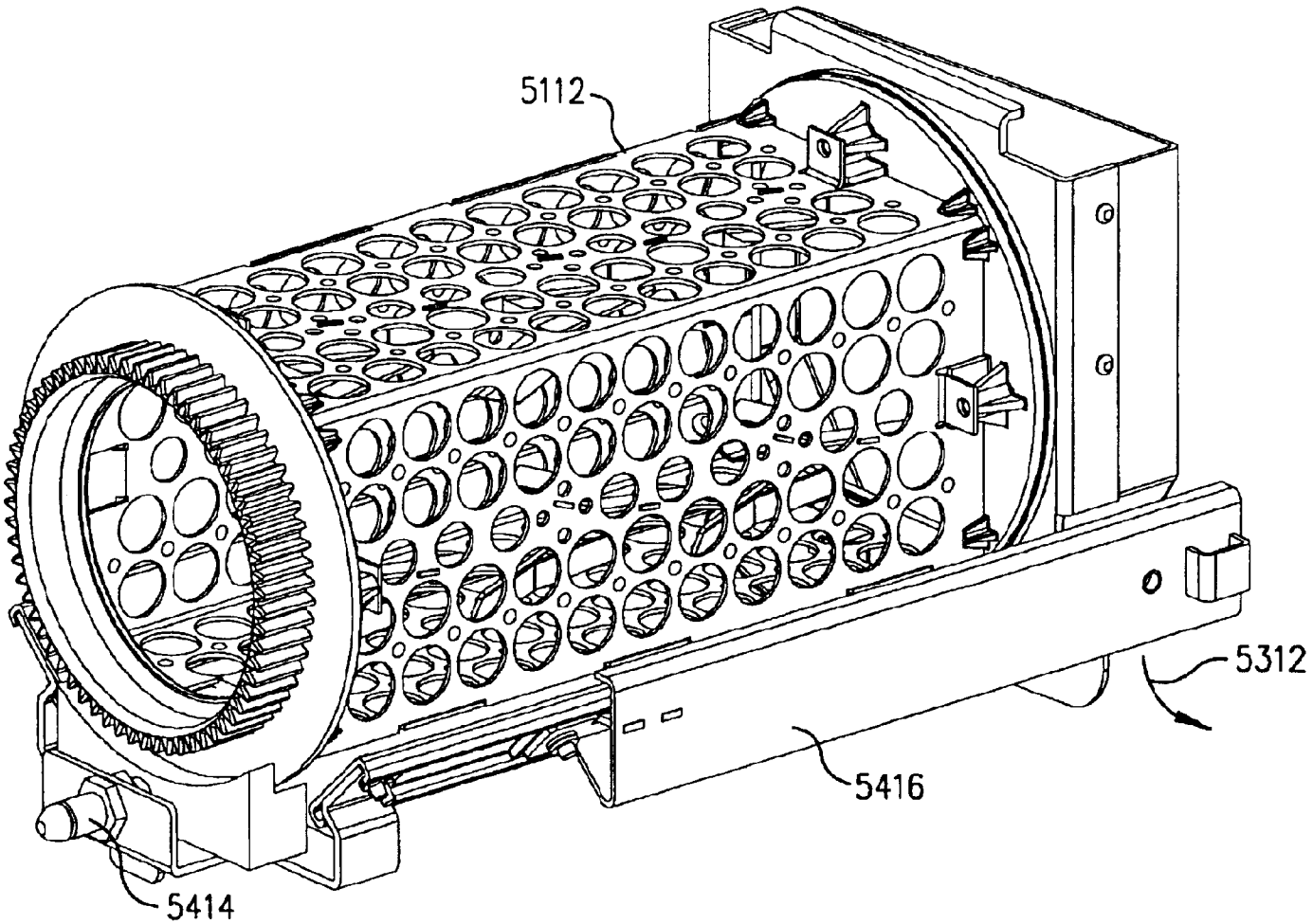
FIG. 53 is a perspective view of a trommel with endcaps and cradle according to an embodiment of the present invention.
Figure 54:
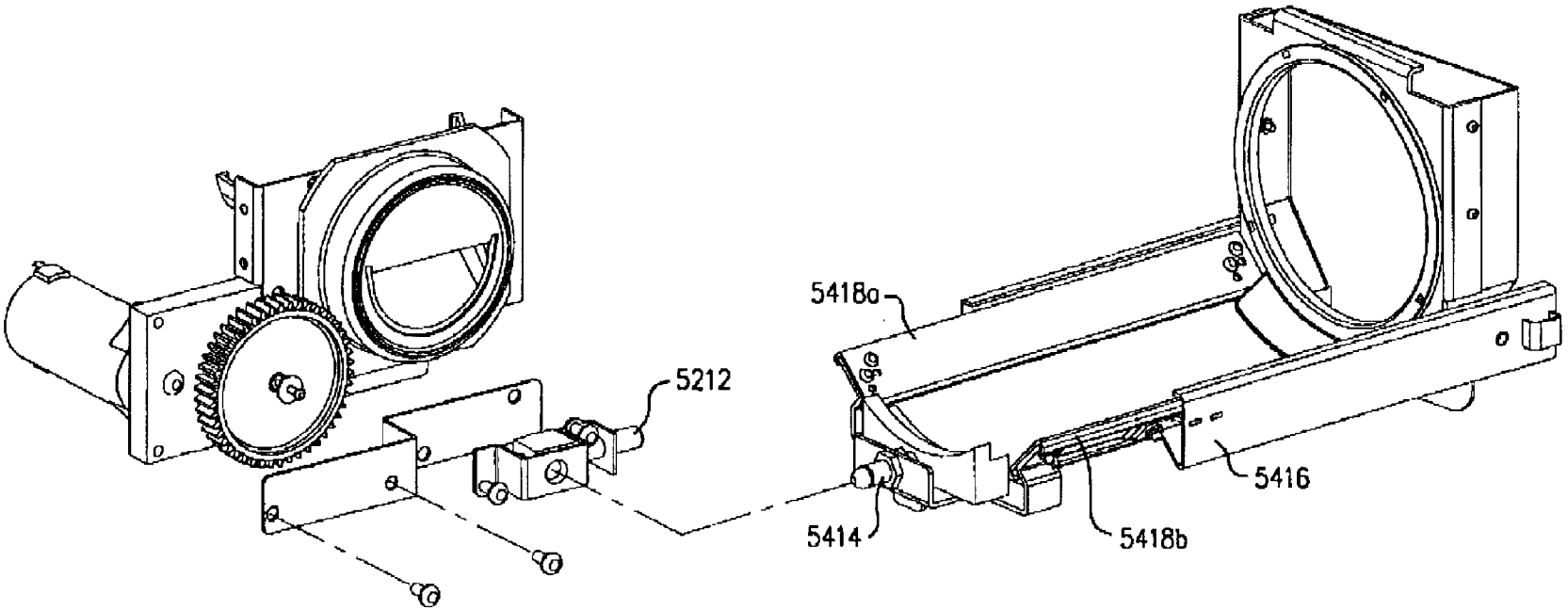
FIG. 54 is a perspective, partially exploded view of a trommel cradle according to an embodiment of the present invention.

Devices that may be used in connection with the coin chutes and the trommel 52 are described in PCT/US97/03136 Feb. 28, 1997 and its parent provisional application U.S. Ser. No. 60/012,964, both of which are incorporated by reference. In one embodiment, depicted in FIGS. 51 and 53, the trommel cage 5112 is configured to facilitate removal, e.g. for cleaning or maintenance purposes or the like. In the embodiment depicted in FIGS. 48–54, trommel removal can be accomplished with only one hand, particularly by pressing button 5212 (FIGS. 52 and 54) which moves socket 5414 (FIG. 54) out of engagement with cradle pin 5414 (FIG. 54) permitting the cradle 5416 which bears the trommel cage (as shown in FIG. 53) to pivot downward 5312 (FIG. 53) from the position 4812 shown in FIG. 48 to the position 4912 shown in FIG. 49. The cradle 5416 includes a telescoping section 5418*a,b* for permitting the trommel cage to be further retracted to the position 5012 shown in FIG. 50 where it can be easily lifted from the cradle.

Briefly, and as described more thoroughly below and in the above-noted applications, a user is provided with instructions such as on computer screen 32. The user places a mass of coins, typically of a plurality of denominations (typically accompanied by dirt or other non-coin objects and/or foreign or otherwise non-acceptable coins) in the input tray 16. The user is prompted to push a button to inform the machine that the user wishes to have coins discriminated. Thereupon, the computer causes an input gate 17 (FIG. 41) to open and illuminates a signal to prompt the user to begin feeding coins The gate may be controlled to open or close for a number of purposes, such as in response to sensing of a jam, sensing of load in the trommel or coin pickup assembly, and the like. In one embodiment, signal devices such as LEDs can provide a user with an indication of whether the gate is open or closed (or otherwise to prompt the user to feed or discontinue feeding coins or other objects). Although instructions to feed or discontinue may be provided on the computer screen 32, indicator lights (although involving additional wiring and attendant difficulties) are believed useful since users often are watching the throat of the chute, rather than the computer screen, during the feeding of coins or other objects. When the gate is open, a motor 19 (FIG. 41) is activated to begin rotating the trommel assembly 52. The user moves coins over the peaked output edge 72 of the input tray 16, typically by lifting or pivoting the tray by handle 74, and/or manually feeding coins over the peak 72. The coins pass the gate (typically set to prevent passage of more than a predetermined number of stacked coins, such as by defining an opening equal to about 3.5 times a typical coin thickness). Instructions on the screen 32 may be used to tell the user to continue or discontinue feeding coins, can relay the status of the machine, the amount counted thus far, provide encouragement or advertising messages and the like.

First and second chutes (not shown in FIG. 1B) are positioned between the output edge 72 of the input tray 16 and the input to the trommel 52. Preferably, the second chute provides a funneling effect by having a greater width at its upstream edge than its downstream edge. Preferably, the coins cascade or "waterfall" when passing from the first chute to the second chute, e.g. to increase momentum and tumbling of the coins.

Preferably, some or all of the surfaces that contact the coin along the coin path, including the chutes, have no flat region large enough for a coin to contact the surface over all or substantially all of one of the faces of the coin. Some such surfaces are curved to achieve this result, such that coins make contact on, at most, two points of such surfaces. Other surfaces may have depressions or protrusions such as being provided with dimples, quilting or other textures. Preferably, the surface of the second chute is constructed such that it has a finite radius of curvature along any plane normal to its longitudinal axis, and preferably with such radii of curvature increasing in the direction of coin flow.

In one embodiment, the chutes are formed from injected molded plastic such as an acetal resin e.g. Delrin®, available from E.I. DuPont de Nemours & Co., or a polyamide polymer, such as a nylon, and the like. Other materials that can be used for the chute include metals, ceramics, fiberglass, reinforced materials, epoxies, ceramic-coated or -reinforced materials and the like. The chutes may contain devices for performing additional functions such as stops or traps, e.g., for dealing with various types of elongate objects.

The trommel 52, in the depicted embodiment is a perforated-wall, square cross-section, rotatably mounted container. Preferably, dimples protrude slightly into the interior region of the trommel to avoid adhesion and/or reduce friction between coins and the interior surface of the trommel. The trommel is rotated about its longitudinal axis. Preferably, operation of the device is monitored, such as by monitoring current draw for the trommel motor using a current sensor 21. A sudden increase or spike in current draw may be considered indicative of an undesirable load and/or jam of the trommel. The system may be configured in various ways to respond to such a sensed jam such as by turning off the trommel motor to stop attempted trommel rotation and/or reversing the motor, or altering motor direction periodically, to attempt to clear the jam. In one embodiment, when a jam or undesirable load is sensed, coin feed is stopped or discouraged, e.g., by closing the gate and/or illuminating a "stop feed" indicator. As the trommel motor 19 rotates the trommel, one or more vanes protruding into the interior of the trommel assist in providing coin-lifting/free-fall and moving the coins in a direction towards the output region. Objects smaller than the smallest acceptable coin (about 17.5 mm, in one embodiment) pass through the perforated wall as the coins tumble. In one embodiment, the holes have a diameter of about 0.61 inches (about 1.55 cm) to prevent passage of U.S. dimes. An output chute directs the (at least partially) cleaned coins exiting the trommel towards the coin pickup assembly 54. The depicted horizontal disposition of the trommel, which relies on vanes rather than trommel inclination for longitudinal coin movements, achieves a relatively small vertical space requirement for the trommel. Preferably the trommel is mounted in such a way that it may be easily removed and/or opened or disassembled for cleaning and maintenance, as described, e.g., in PCT Application US97/03136, supra.

Figure 17:
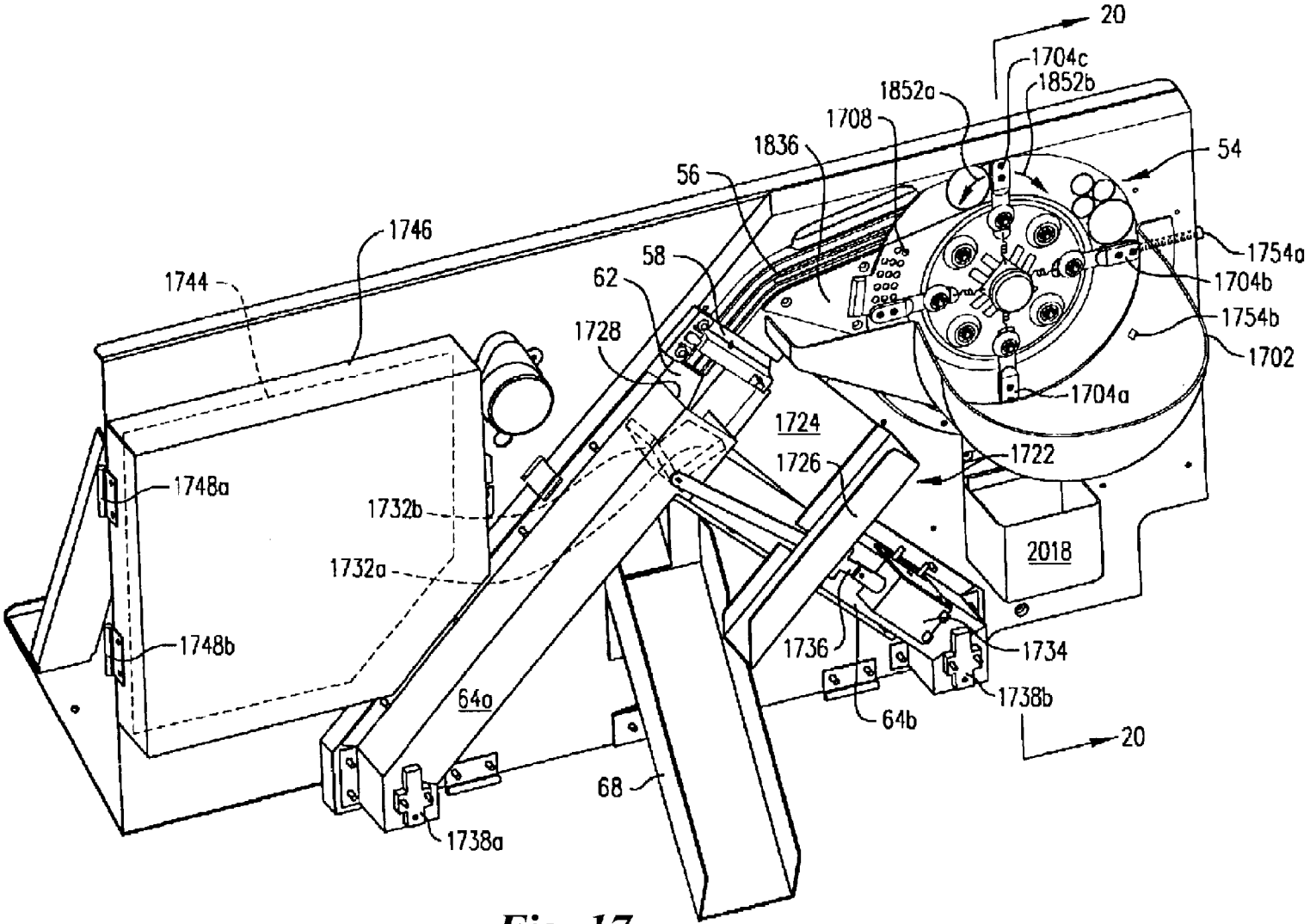
FIG. 17 is a perspective view of a coin pickup assembly, rail, sensor and chute system, according to an embodiment of the present invention.

As depicted in FIG. 17, coin pickup assembly 54 includes a hopper 1702 for receiving coins output from the trommel 52. The hopper 1702 may be made at relatively low cost such as by vacuum forming. In one embodiment, the hopper 1702 is formed of a plastic material, such as polyethylene, backed with sound-absorbing foam for reducing noise. Preferably, the hopper (or other components along the coin path) are configured to avoid slow-up, jams or other difficulties, such as may otherwise result particularly from wet or sticky coins. Without being bound by any theory, it is believed that polyethylene is useful to reduce coin sticking. Thus, it may be desirable to include a mechanical or other transducer for providing energy, in response to a sensed jam, slow-up or other abnormality. One configuration for providing energy is described in U.S. Pat. No. 5,746,299 incorporated herein by reference. In one embodiment, slow or stuck coins are automatically provided with kinetic energy. In one embodiment, vibrational or other kinetic energy is imparted by pulsing, alternating, reversing or otherwise activating the hopper motor. Other features which may be provided for the hopper include shaping to provide a curvature sufficient to avoid face-to-face contact between coins and the hopper surface and/or providing surface texture (such as embossing, dimpling, faceting, quilting, ridging or ribbing) on the hopper interior surface. The hopper 1702 preferably has an amount of flexibility, rather than being rigid, which reduces the occurrence of jams and assists in clearing jams since coins are not forced against a solid, unyielding surface.

As described below, the coins move into an annular coin path defined, on the outside, by the edge of a circular recess 1802 (FIG. 18) and, on the inside, by a ledge 1804 formed on a rail disk 1806. The coins are moved along the annular path by paddles 1704*a, b, c, d* for delivery to the coin rail 56.

A circuit board 1744 for providing certain control functions, as described below, is preferably mounted on the generally accessible front surface of the chassis 1864. An electromagnetic interference (EMI) safety shield 1746 normally covers the circuit board 1744 and swings open on hinges 1748*a,b* for easy service access.

Figures 18, 35:
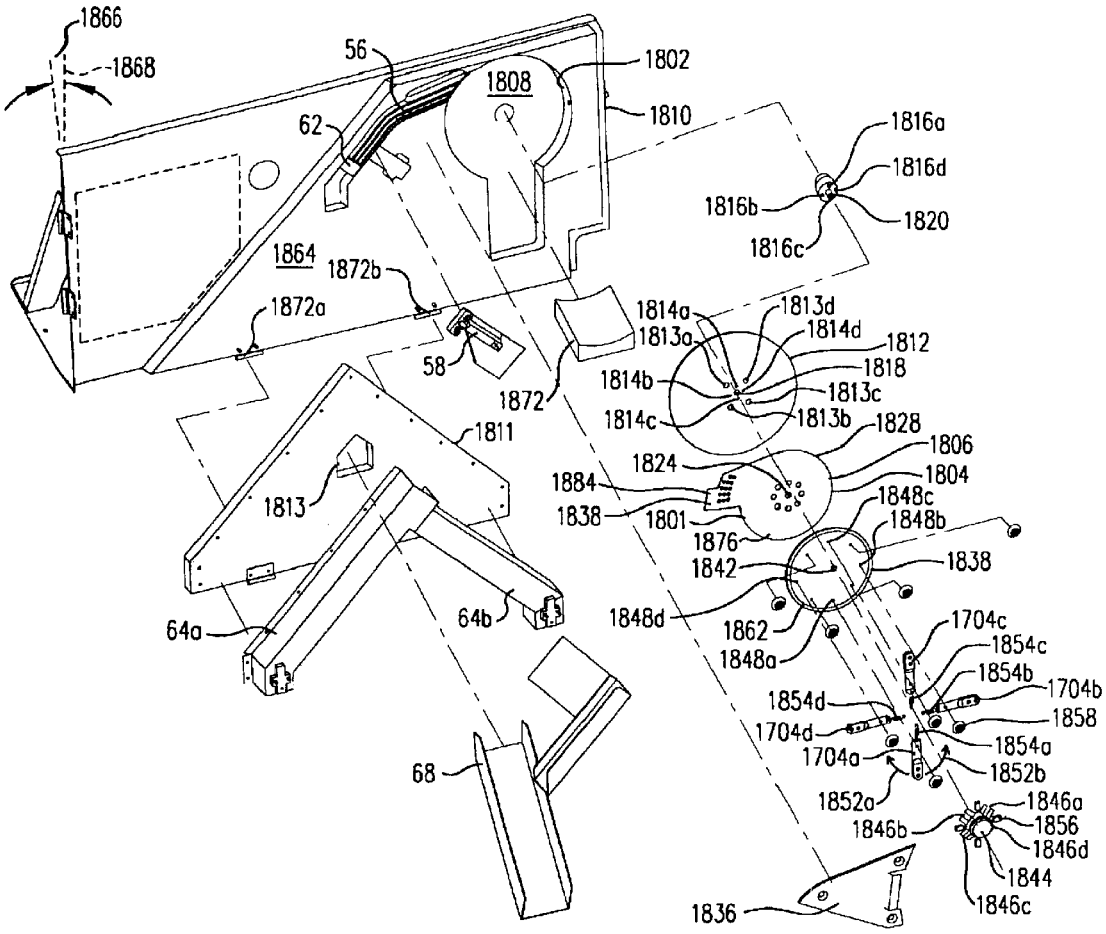
FIG. 18 is an exploded view of the system of FIG. 17.

In the embodiment depicted in FIGS. 17 and 18, the coin rail 56 and the recess 1808 for the disks are formed as a single piece or block, such as the depicted base plate 1810. In one embodiment, the base plate 1810 is formed from high density polyethylene (HDPE) and the recess 1808 and coin rail 56, as well as the various openings depicted, are formed by machining a sheet or block of HDPE. HDPE is a useful material because, among other reasons, components may be mounted using self-tapping screws, reducing manufacturing costs. Furthermore, use of a non-metallic back plate is preferred in order to avoid interference with the sensor. In one embodiment, electrically conductive HDPE may be used, e.g. to dissipate static electricity.

Figure 19:
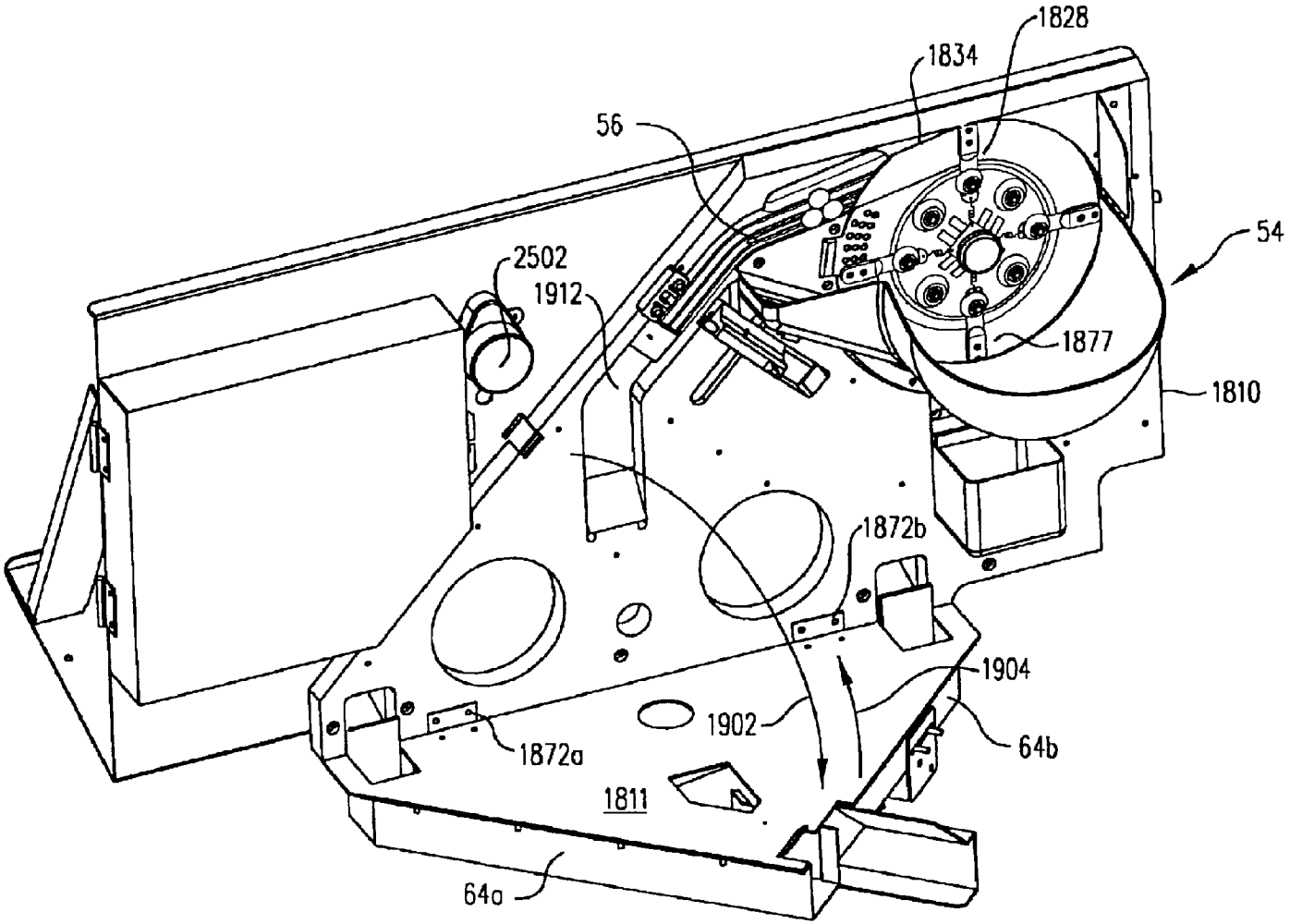
FIG. 19 depicts the system of FIG. 17 with the front portion pivoted.

The base plate 1810 is mounted on a chassis 1864 which is positioned within the cabinet (FIG. 1B) such that the base plate 1810 is disposed at an angle 1866 with respect to vertical 1868 of between about 0° and about 45°, preferably between about 0° and about 15°, more preferably about 20°. Preferably, the diverter cover 1811 is pivotally coupled to the baseplate 1810, e.g. by hinges 1872*a,* 1872*b,* so that the diverter cover 1811 may be easily pivoted forward (FIG. 19), e.g. for cleaning and maintenance.

A rotating main disk 1812 is configured for tight (small clearance) fit against the edge 1802 of recess 1808. Finger holes 1813*a, b, c, d* facilitate removal of the disk for cleaning or maintenance. Relatively loose (large clearance) fit is provided between disk holes 1814*a, b, c, d* and hub pins 1816*a, b, c, d* and between central opening 1818 and motor hub 1820. The loose fit of the holes and the tight fit of the edge of disk 1812 assist in reducing debris entrapment and motor jams. Because the main disk is received in recess 1802, it is free to flex and/or tilt, to some degree, e.g. in order to react to coin jams.

A stationary rail disk 1806 is positioned adjacent the main disk 1812 and has a central opening 1824 fitting loosely with respect to the motor hub 1820. In one embodiment, the rail disk is formed of graphite-filled phenolic.

The ledge 1804 defined by the rail disk 1806 is preferably configured so that the annular coin path flares or widens in the direction of coin travel such that spacing between the ledge and the recess edge near the bottom or beginning of the coin path (at the eight o'clock position 1876) is smaller (such as about 0.25 inches, or about 6 mm smaller) than the corresponding distance 1827 at the twelve o'clock position 1828. In one embodiment, the rail disk 1806 (and motor 2032) are mounted at a slight angle to the plane formed by the attachment edge 2042 of the hopper 1702 such that, along the coin path, the coin channel generally increases in depth (i.e. in a direction perpendicular to the face of the rail disk).

As the coins travel counterclockwise from approximately a 12:00 position 1828 of the rail disk, the ledge is thereafter substantially linear along a portion 1834 (FIG. 19) extending to the periphery of the rail disk 1806 and ending adjacent the coin backplate 56 and rail tip 1836. A tab-like protrusion 1838 is engaged by rail tip 1836, holding the rail disk 1806 in position. The rail disk is believed to be more easily manufactured and constructed than previous designs, such as those using a coin knife. Furthermore, the present design avoids the problem, often found with a coin knife, in which the tip of the knife was susceptible to prying outward by debris accumulated behind the tip of the coin knife.

A tension disk 1838 is positioned adjacent the rail disk. The tension disk 1838 is mounted on the motor hub 1820 via central opening 1842 and threaded disk knob 1844. As the knob 1844 is tightened, spring fingers 1846*a, b, c, d* apply force to keep the disks 1838, 1806, 1812 tightly together, reducing spaces or cracks in which debris could otherwise become entrapped. Preferably, the knob 1844 can be easily removed by hand, permitting removal of all the disks 1812, 1806, 1838 (e.g., for maintenance or cleaning) without the need for tools.

In one embodiment, the tension disk 1838 and main disk 1812 are formed of stainless steel while the rail disk 1806 is formed of a different material such as graphite-filled phenolic, which is believed to be helpful in reducing galling. The depicted coin disc configuration, using the described materials, can be manufactured relatively easily and inexpensively, compared to previous devices. Paddles 1704*a, b, c, d* are pivotally mounted on tension disk pins 1848*a, b, c, d* so as to permit the paddles to pivot in directions 1852*a,* 1852*b* parallel to the tension disk plane 1838. Such pivoting is useful in reducing the creation or exacerbation of coin jams since coins or other items which are stopped along the coin path will cause the paddles to flex, or to pivot around pins 1848*a, b, c, d,* rather than requiring the paddles to continue applying full motor-induced force on the stopped coins or other objects. Springs 1854*a, b, c, d* resist the pivoting 1852*a,* 1852*b,* urging the paddles to a position oriented radially outward, in the absence of resistance e.g. from a stopped coin or other object.

Preferably, sharp or irregular surfaces which may stop or entrap coins are avoided. Thus, covers 1856 are placed over the springs 1854*a, b, c, d* and conically-shaped washers 1858*a, b, c, d* protect the pivot pins 1848*a, b, c, d.* In a similar spirit, the edge of the tension disk 1862 is angled or chamfered to avoid coins hanging on a disk edge, potentially causing jamming.

Figure 25:
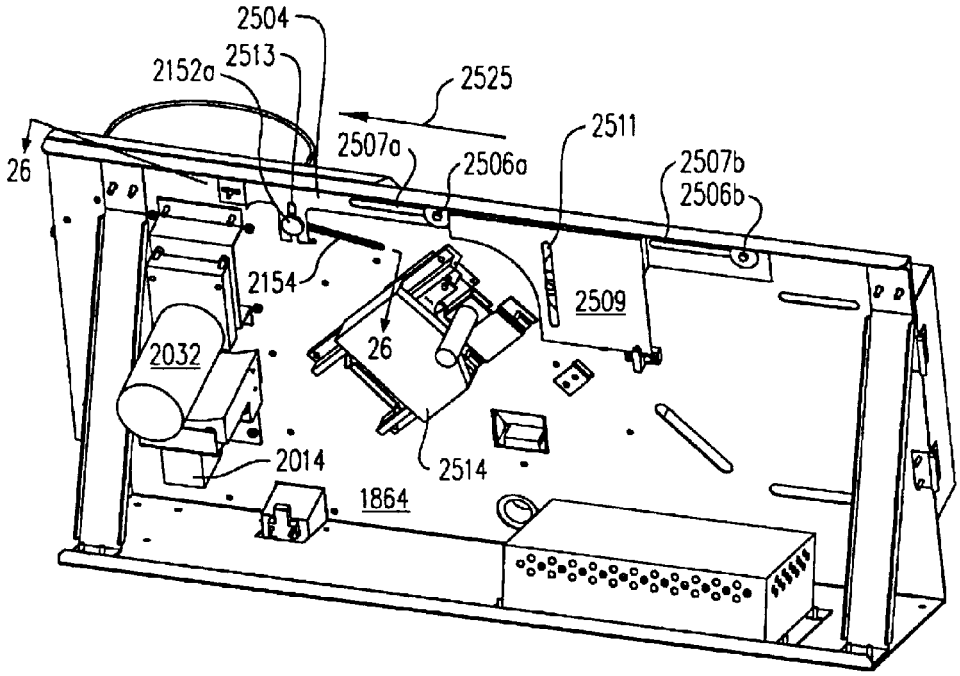
FIG. 25 is a rear elevational view of the system of FIG. 17.
Figure 25A:
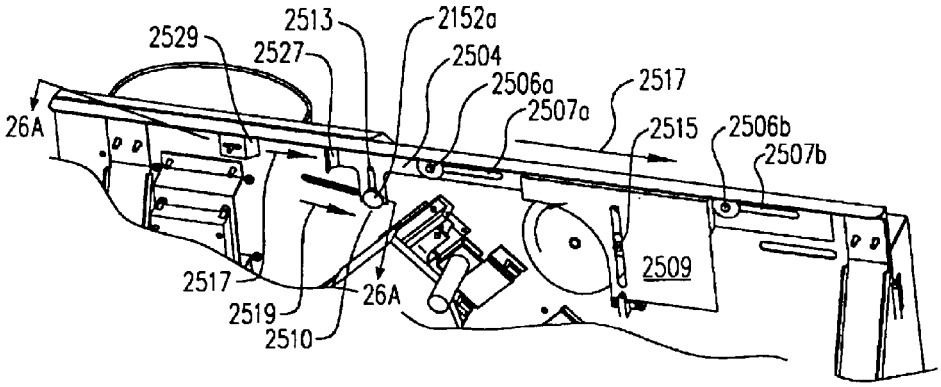
FIG. 25A is a partial view corresponding to FIG. 25, but showing the rake in the downstream position.

As depicted in FIG. 25, a number of components are mounted on the rear surface of the chassis 1864. A motor, such as model 2032 drives the rotation of disks 1812, 1838 via motor drive hub 1820. An actuator such as solenoid 2014 controls movement of the trap door 1872 (described below). A sensor assembly including sensor printed circuit board (PCB) 2512 is slidably mounted in a shield 2514.

Figure 20:
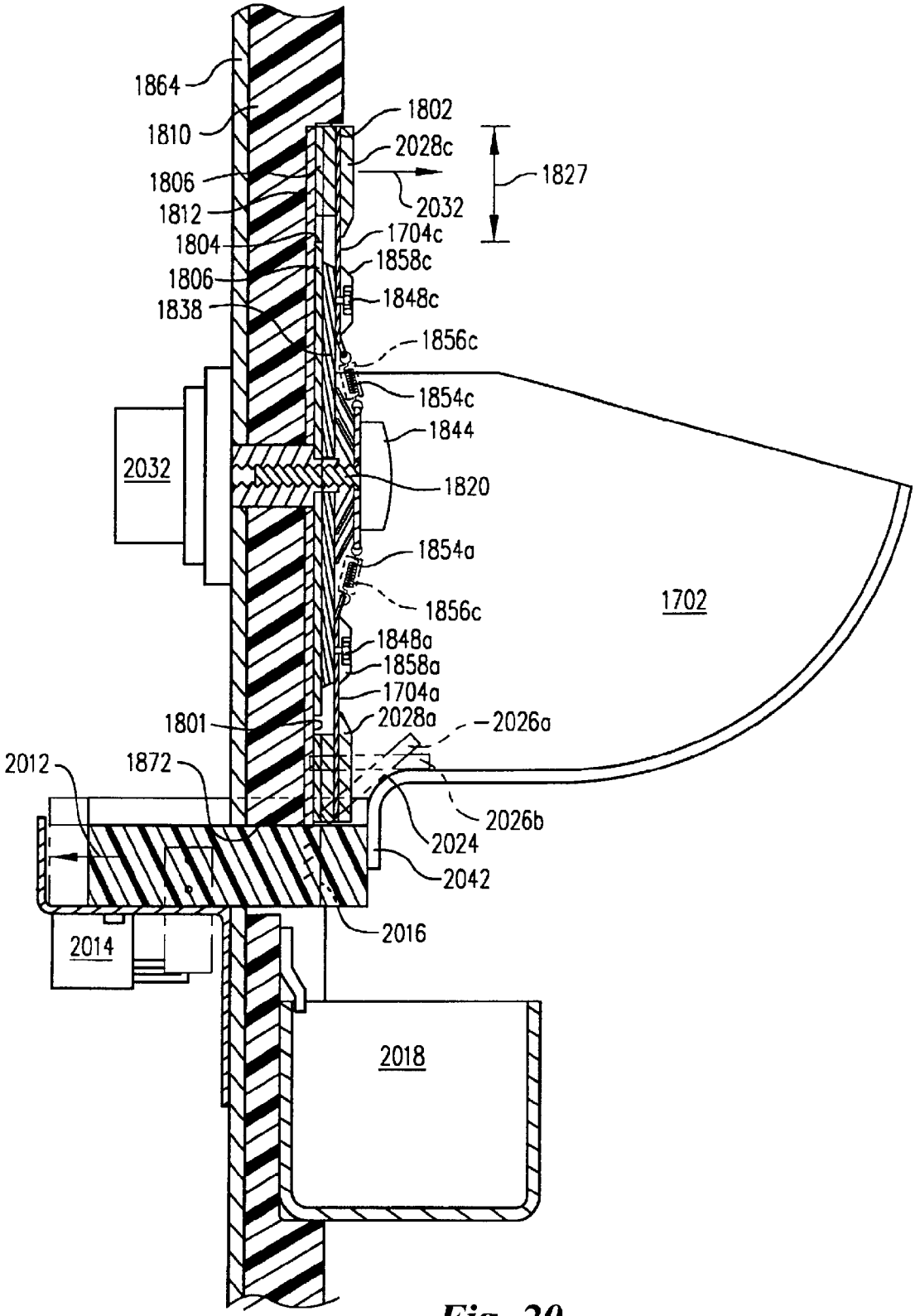
FIG. 20 is a cross-sectional view taken along line 20—20 of FIG. 17.

The lower edge of the recess 1808 is formed by a separate piece 1872 which is mounted to act as a trap door. The trap door 1872 is configured to be moved rearwardly 2012 (FIG. 20) by actuator 2014 to a position 2016 to enable debris to fall into debris cup 2018. Solenoid 2014 is actuated under control of a microcontroller as described below. Preferably, the trap door 1872 retracts substantially no further than the front edge of the coin rail disk, to avoid catching, which could lead to a failure of the trap door to close. Preferably, a sensor switch provides a signal to the microcontroller indicating whether the trap door has completely shut. Preferably the trap door is resiliently held in the closed position in such a manner that it can be manually opened if desired.

Coins which fall into the hopper 1702 from the trommel 52 are directed by the curvature of the hopper towards the 6:00 position 1877 (FIG. 19) of the annular coin path. In general, coins traveling over the downward-turning edge 2024 of the hopper 1702 are tipped onto edge and, partially owing to the backward inclination 1866 of the apparatus, tend to fall into the annular space 1801. Coins which are not positioned in the space 1801 with their faces adjacent the surface of the rail disk (such as coins that may be tipped outward 2026*a* or may be perpendicular to the rail disk 2026*b*) will be struck by the paddle 1704 as it rotates, agitating the coins and eventually correctly positioning coins in the annular space 1801 with their faces adjacent the face 1801 of the annular space defined by the rail disk 1806. It is believed that the shape of the paddle head 2028*a,* 2028*c,* in particular the rounded shape of the radially outmost portion 2206 of the head, assists in agitating or striking coins in such a manner that they will assume the desired position.

Once coins are positioned along the annular path, the leading edge of the paddle heads 2028 contact the trailing edge of the coins, forcing them along the coin path, e.g. as depicted in FIG. 17. Preferably each paddle can move a plurality of coins, such as up to about 10 coins. The coins are thus eventually forced to travel onto and along the linear portion 1834 of the rail disk ledge 1804 and are pushed onto the coin rail tip 1836. Some previous devices were provided with an exit gate for coins exiting the coin pickup assembly which, in some cases, was susceptible to jamming. According to an embodiment of the present invention, such jamming is eliminated because no coin pickup assembly exit gate is provided.

As the paddle heads 2028 continue to move along the circular path, they contact the linear portion 1834 (FIG. 19) of the ledge 1804 and flex axially outward, facilitated by a tapered shape of the radially inward portion of the paddle pad 2028 to ride over (i.e. in front of) a portion 1884 of the rail disk. In one embodiment, openings or holes 1708 are provided in this portion to reduce frictional drag and to receive e.g. trapped debris, which is thus cleared from the annular coin path.

Figure 21:
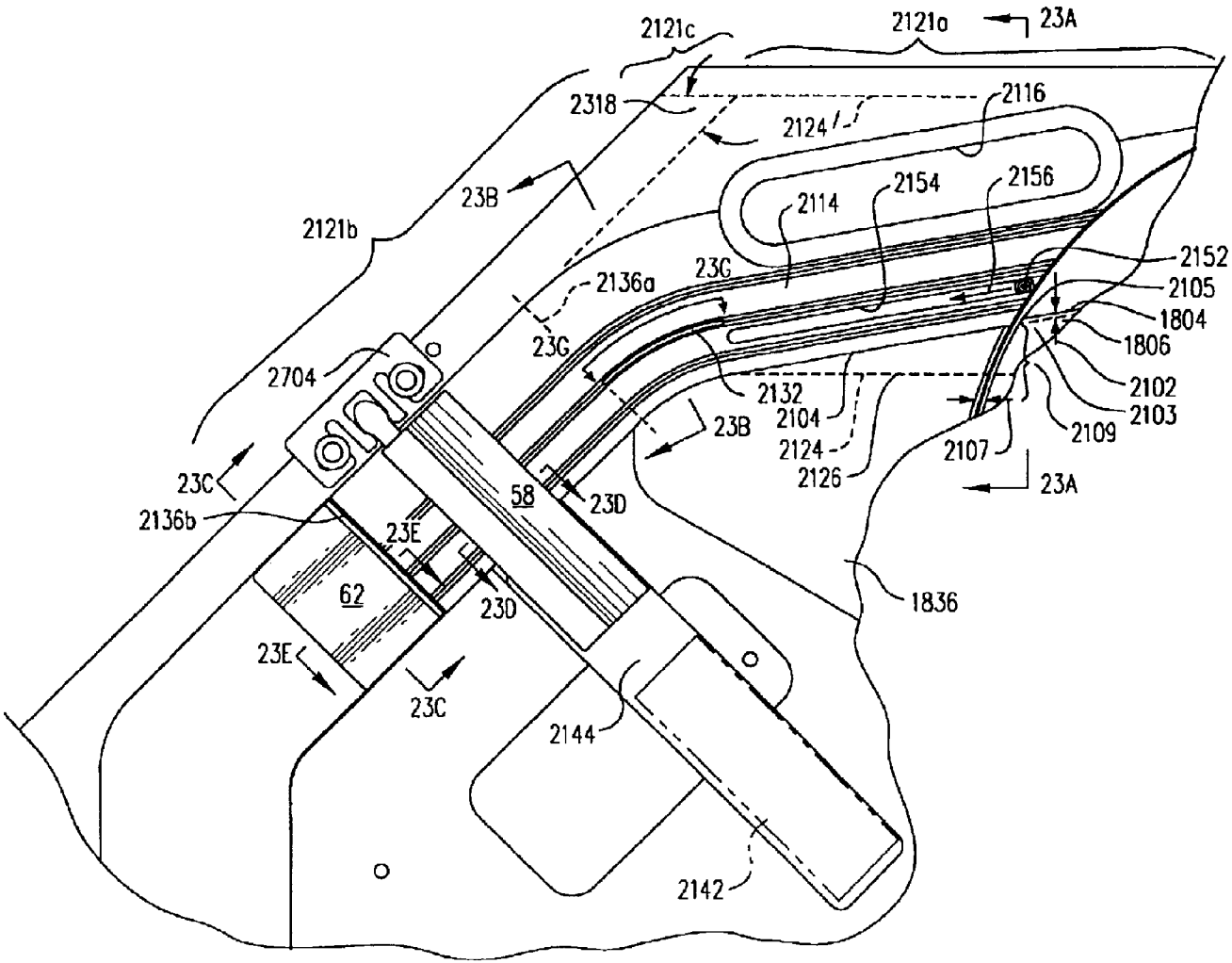
FIG. 21 is a front elevational view of the coin rail portion of FIG. 17.

As seen in FIG. 21, the ledge 1804 as defined by the rail disk 1806 is displaced upwardly 2102 with respect to the ledge 2104 of the coin rail tip 1836. The distance 2102 may be, for example, about 0.1 inches (about 2.5 mm). The difference in height 2102 assists in gravitationally moving coins from the rail disk ledge 1804 over the upper portion of the "V" gap (described below) and onto the ledge of coin rail tip 1836.

The terminal point 2105 of the rail disk ledge is laterally spaced a distance 2107 from the initial edge of the coin rail ledge 2104 to define a "V" gap therebetween. This gap, which extends a certain distance 2109 circumferentially, as seen in FIG. 21, receives debris which may be swept along by the coin paddles. The existence of the gap 2107, and its placement, extending below the rail ledge, by providing a place for debris swept up by the paddles, avoids a problem found in certain previous devices in which debris tended to accumulate where a disk region met a linear region, sometimes accumulating to the point of creating a bump or obstruction which could cause coins to hop or fly off the ledge or rail.

The coin rail 56 functions to receive coins output by the coin pickup assembly 54, and transports the coins in a singulated (one-at-a-time) fashion past the sensor 58 to the diverting door 62. Singulation and separation of coins is of particular use in connection with the described sensor, although other types of sensors may also benefit from coin singulation and spacing. In general, coins are delivered to the coin rail 56 rolling or sliding on their edge or rim along the rail ledge 2104. The face of the coins as they slide or roll down the coin rail are supported, during a portion of their travel, by rails or stringers 2106*a, b, c.* The stringers are positioned (FIG. 23A), respectively, at heights 2108*a, b, c* (with respect to the height of the ledge 2104) to provide support suitable for the range of coin sizes to be handled while providing a relatively small area or region of contact between the coin face and the stringers. Although some previous devices provide for flat-topped or rounded-profile rails or ridges, the present invention provides ridges or stringers which at least in the second portion, 2121*b,* have a triangular or peaked profile. This is believed to be easier to manufacture (such as by machining into the baseplate 1810) and also maintains relatively small area of contact with the coin face despite stringer wear.

The position and shape of the stringers and the width of the rail 2104 are selected depending on the range of coin sizes to be handled by the device. In one embodiment, which is able to handle U.S. coins in the size range between a U.S. dime and a U.S. half-dollar, the ledge 2104 has a depth 2111 (from the backplate 2114) of about 0.09 inches (about 23 mm). The top stringer 2106*a* is positioned at a height 2108*a* (above the ledge 2104), of about 0.825 inches (about 20 mm), (the middle stringer 2106*b* is positioned at a height 2108*b* of about 0.49 inches (about 12.4 mm), and the bottom stringer 2106*c* is positioned at a height of about 0.175 inches (about 4.4 mm). In one embodiment, the stringers are about 0.8 inches (about 2 mm) wide 2109 (FIG. 23C) and protrude about 0.05 inches (about 1.3 mm) 2112 above the back plate 2114 of the coin rail.

Figure 22:
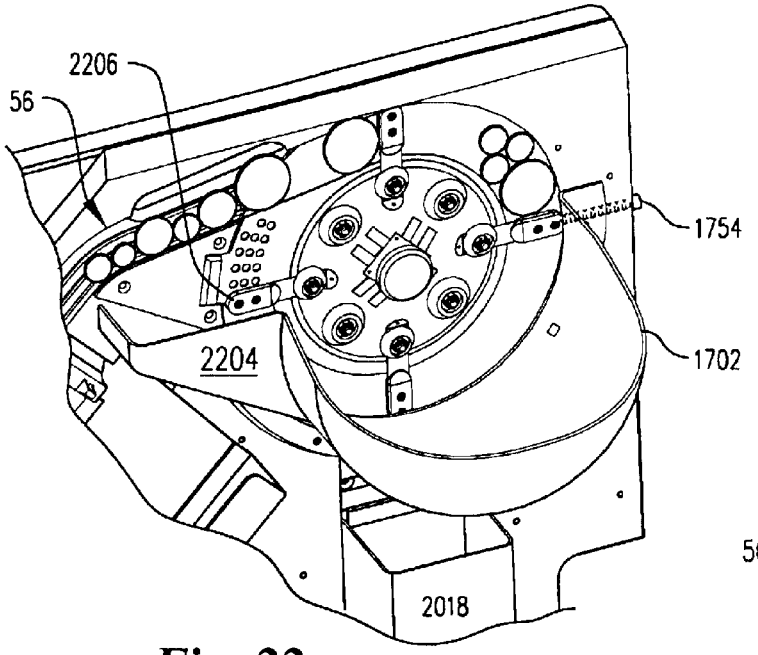
Figure 24:
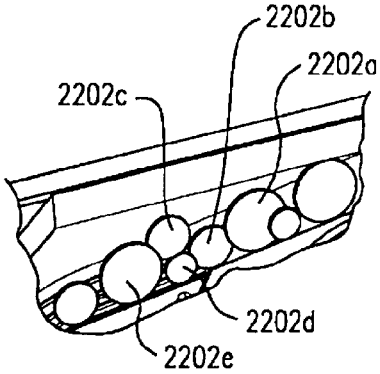
FIG. 24 is a cross sectional view taken along line 24—24 of FIG. 22.
Figure 24:
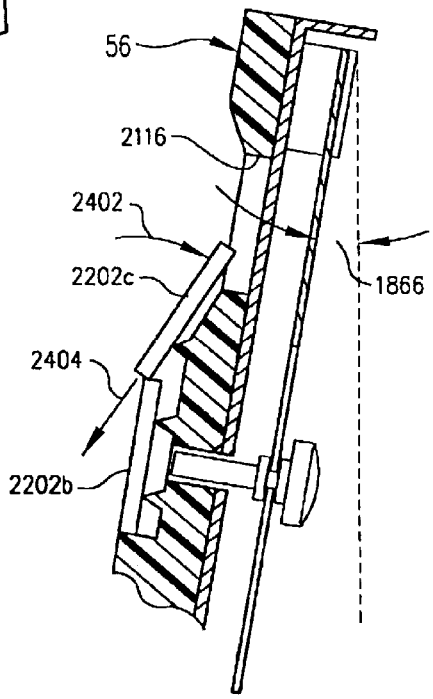

As seen in FIG. 22, as the coins enter the coin rail 56, the coins are typically horizontally singulated, i.e., coins are in single file, albeit possibly adjacent or touching one another. The singulated configuration of the coins can be contrasted with coins which are horizontally partially overlapped 2202*a, b* as shown in FIG. 22A. FIG. 22A also illustrates a situation in which some coins are stacked on top of one another vertically 2202*c, d.* A number of features of the coin rail 56 contribute to changing the coins from the bunched configuration to a singulated, and eventually separated, series of coins by the time they move past the sensor 58. One such feature is a cut-out or recess 2116 provided in or adjacent the top portion of the rail along a first portion of its extent. As seen in FIG. 24, when coins which are vertically stacked such as coins 2202*c, b,* illustrated in FIG. 22, reach the cut-out portion 2116, the top coin, aided by the inclination 1866 of the rail, tips backward 2402 an amount sufficient that it will tend to slide forward 2404 in front of the lower coin 2202, falling into the hopper extension 2204 which is positioned beneath the cut-out region 2116, and sliding back into the main portion of the hopper 1702 to be conveyed back on to the coin rail.

Another feature contributing to singulation is the change in inclination of the coin rail from a first portion 2121*a* which is inclined, with respect to a horizontal plane 2124 at an angle 2126 of about 0° to about 30°, preferably about 0° to about 15° and more preferably about 10°, to a second portion 2121*b* which is inclined with respect to a horizontal plane 2124 by an angle of about 30° to about 60°, preferably between about 40° and about 50° and more preferably about 45°. Preferably, the coin path in the transitional region 2121*c* between the first portion 2121*a* and second portion 2121*b* is smoothly curved, as shown. In one embodiment, the radius of curvature of the ledge 2104 in the transition region 2121*c* is about 1.5 inch (about 3.8 cm).

One feature of singulating coins, according to the depicted embodiment, is to primarily use gravitational forces for this purpose. Use of gravity force is believed to, in general, reduce system cost and complexity. This is accomplished by configuring the rail so that a given coin, as it approaches and then enters the second portion 2121*b,* will be gravitationally accelerated while the next ("following") coin, on a shallower slope, is being accelerated to a much smaller degree, thus allowing the first coin to move away from the following coin, creating a space therebetween and effectively producing a gap between the singulated coins. Thereafter, the following coin moves into the region where it is, in turn, accelerated away from the successive coin. As a coin moves from the first region 2121*a* toward and into the second region 2121*b,* the change in rail inclination 2126, 2318 (FIG. 21) causes the coin to accelerate, while the following coins, which are still positioned in the first region 2121*a,* have a relatively lower velocity.

Figures 23A, 23B, 23C, 23D, 23E, 23F, 23G:
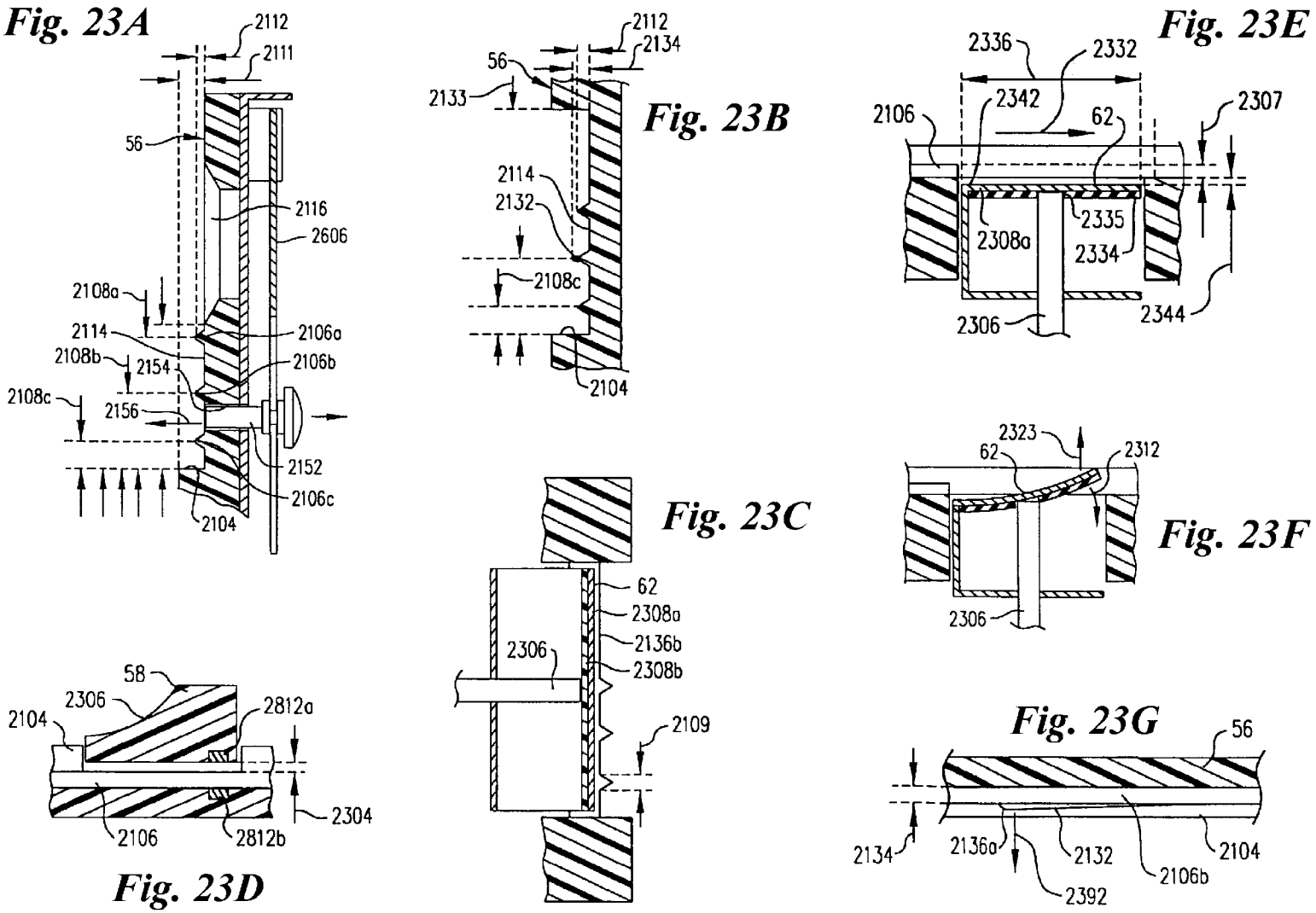
FIGS. 23A through 23G are cross sectional views taken along lines 23A—23A through 23G—23G, respectively, of FIG. 21.

In one embodiment, acceleration of a coin as it moves into the second rail region 2121*b* is also enhanced by placement of a short, relatively tall auxiliary stringer 2132 generally in the transition region 2121*c*. The auxiliary stringer 2132 projects outwardly from the back surface 2114 of the coin rail, a distance 2134 (FIG. 23B) greater than the distance 2112 of projection of the normal stringers 2106*a, b, c*. Thus, as a coin moves into the transition region 2121*c,* the auxiliary stringer 2132 tips the coin top outward 2392, away from contact with the normal stringers 2106*a, b, c* so that it tends to "fly" (roll or slide on its edge or rim along the coin rail ledge 2104 without contact with the normal stringers 2106*a, b, c*) and, for at least a time period following movement past the auxiliary stringer 2132, continues to contact the coin rail only along the ledge 2104, further minimizing or reducing friction and allowing the coin to accelerate along the second region 2121*b* of the coin rail. In one embodiment, the coin-contact portion of the stringers in the first portion 2121*a* are somewhat flattened (FIG. 23A) to increase friction and exaggerate the difference in coin acceleration between the first section 2121*a* and the second section 2121*b,* where the stringer profiles are more pointed, such as being substantially peaked (FIG. 23C).

Another feature of the coin rail contributing to acceleration is the provision of one or more free-fall regions where coins will normally be out of contact with the stringers and thus will contact, at most, only the ledge portion 2104 of the rail. In the depicted embodiment, a first free-fall region is provided at the area 2136*a* wherein the auxiliary stringer 2132 terminates. As noted above, coins in this region will tend to contact the coin rail only along the ledge 2104. Another free-fall region occurs just downstream of the upstream edge 2342 of the door 62. As seen in FIG. 23E, the door 62 is preferably positioned a distance 2344 (such as about 0.02 inches, about 0.5 mm) from the surface 2114 of the rail region. This setback 2344, combined with the termination of the stringers 2106, provides a free-fall region adjacent the door 62. If desired, another free-fall region can be provided downstream from the door 62, e.g., where the reject coin path 1921 meets the (preferably embossed) surface of the reject chute or reject chute entrance which may be set back a distance such as about ⅛ inch (about 3 mm).

Another free-fall region may be defined near the location 2103 where coins exit the disks 1812, 1806 and enter the rail 56, e.g., by positioning the disk 1812 to have its front surface in a plane slightly forward (e.g., about 0.3 inches, or about 7.5 mm) of the plane defined by rail stringers 2106. This free-fall region is useful not only to assist the transition from the disk onto the rail but makes it more likely that coins which may be slowed or stopped on the rail near the end of a transaction will be positioned downstream of the retract position (FIG. 21) of the rake 2152 such that when the rake operates (as described below), it is more likely to push slowed or stopped coins down the rail than to knock such coins off the rail. Providing periods of coin flying reduces friction, contributes to coin acceleration and also reduces variation in coin velocity since sticky or wet coins behave similarly to pristine coins when both are in a flying mode. Producing periods of flying is believed to be particularly useful in maintaining a desired acceleration and velocity of coins which may be wet or sticky.

The sensor 58 is positioned a distance 2304 (FIG. 23D) away from the surface of the stringers 2106*a, b, c* sufficient to accommodate passage of the thickest coin to be handled. Although certain preferred sensors, and their use, are described more thoroughly below, it is possible to use features of the present invention with other types of sensors which may be positioned in another fashion such as embedded in the coin rail 56.

The leading surface of the sensor housing is preferably ramped 2306 such that coins or other objects which do not travel into the space 2304 (such as coins or other objects which are too large or have moved partially off the coin path) will be deflected by the ramp 2306 onto a bypass chute 1722 (FIG. 17), having a deflector plane 1724 and a trough 1726 for delivery to the coin return or reject chute 68 where they may be returned to the user. The sensor housing also performs a spacer function, tending to hold any jams at least a minimum distance from the sensor core, preferably sufficiently far that the sensor reading is not affected (which could cause misdetection). If desired, the sensor housing can be configured such that jams may be permitted within the sensing range of the sensor (e.g., to assist in detecting jam occurrence).

Figure 44:
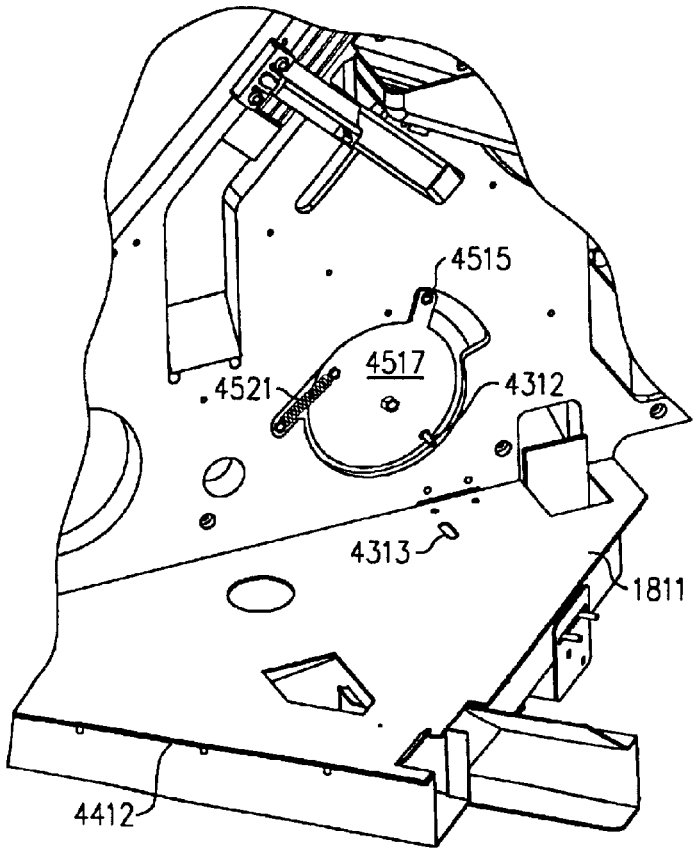
FIG. 44 is a partial perspective view, similar to the view of FIG. 43, but with the diverter cover in an open configuration.
Figure 45:
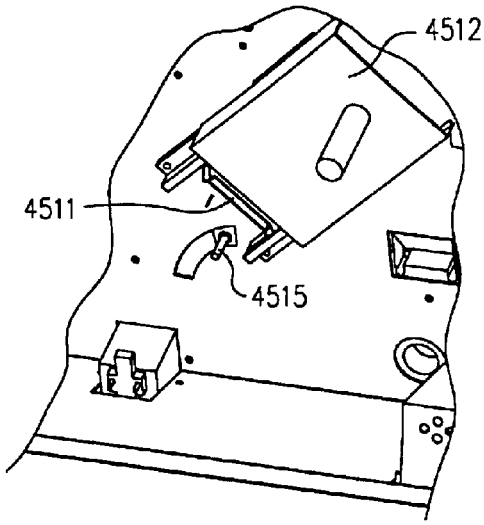
FIG. 45 is a partial rear perspective view corresponding to FIG. 43.
Figure 46:
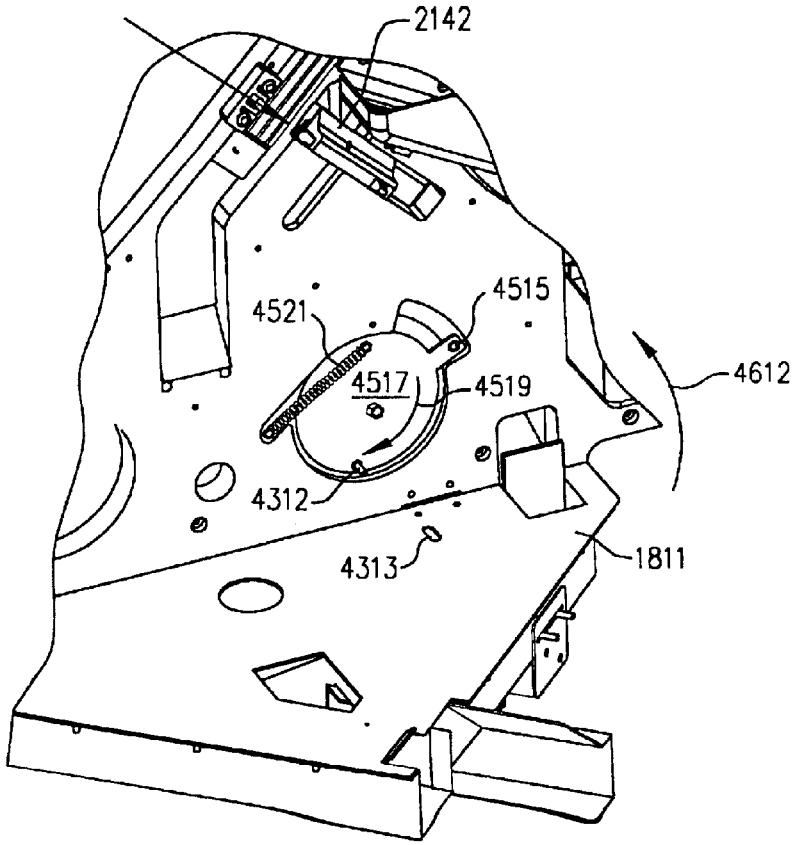
FIG. 46 is a partial perspective view corresponding to FIG. 44 but with the sensor retracted.
Figure 47:
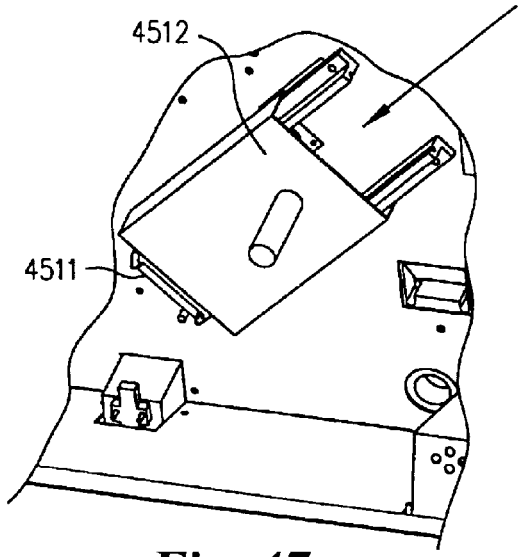
FIG. 47 is a partial rear perspective view corresponding to FIG. 45, but with the sensor retracted.

In the depicted configuration, the sensor 58 is configured so that it can be moved to a position 2142 away from the coin rail 56, for cleaning or maintenance, such as by sliding along slot 2144. Preferably, the device is constructed with an interference fit so that the sensor 58 may be moved out of position only when the diverter cover 1811 has been pivoted forward 1902 (FIG. 19) and such that the diverter cover 1811 may not be repositioned 1904 to its operating configuration until the sensor 2142 has been properly positioned in its operating location (FIG. 21). In another embodiment, depicted in FIGS. 43A–47, closing the diverter cover 1811 before the sensor 2142 has been properly positioned, is prevented by interference with a pin 4312 (rather than interference with the sensor itself, which could result in impact and/or damage to the sensor). In the depicted embodiment, the pin 4312 is registered with a hole 4313 in the diverter cover 1811 when the sensor 2142 is in the unretracted position shown in FIG. 43A. FIG. 44 shows the configuration with the diverter cover 1811 open. With the diverter cover 1811 in the open position, the sensor 2142 can be moved from the unretracted position (FIGS. 43A, 44) to the retracted position (FIG. 46), eg. For purposes of cleaning, maintenance and the like. FIG. 45 is a rear view showing the bottom edge 4511 of the sensor assembly protruding from under a sensor cover 4512. In the depicted embodiment, when the sensor is retracted the bottom edge 4511 moves from the position shown in FIG. 45 to the position shown in FIG. 47. (Although FIG. 47 shows the cover 4512 moving with the sensor, it is also possible to configure the cover 4512 to be stationary while the sensor 2142 is retracted.) To avoid accidentally leaving the sensor in the retracted position when the cleaning and maintenance operations are completed, as the sensor is retracted, the bottom edge 4511 moves a pin 4515, projecting rearwardly from a rotatably-mounted disk 4517. Movement of the pin 4515 causes the disk 4517 to rotate 4519, against the urging of spring 4521, carrying the pin 4312 to the position shown in FIG. 46, out of registration with the hole 4313. When thus moved, the pin 4312 is positioned such that, if an attempt is made to close 4612 the diverter cover 1811 while the sensor is retracted (FIG. 46) the rear surface of the diverter cover 1811 will strike the pin 4312, preventing closure of the cover 1811. By sliding the sensor to its unretracted position (FIG. 44) the spring 4521 rotates the disk 4517 to return the pin 4312 to the position depicted in FIG. 44, registered with the hole 4313, permitting closure of the cover 1811. Preferably, the sensor apparatus is configured so that it will seat reliably and accurately in a desired position with respect to the coin rail such as by engagement of a retention clip 2704 (FIG. 21). Such seating, preferably combined with a relatively high tolerance for positional variations of coins with respect to the sensor (described below), means that the sensor may be moved to the maintenance position 2142 and returned to the operating position repeatedly, without requiring recalibration of the device.

As noted above, in the depicted embodiment, a door 62 is used to selectively deflect coins or other objects so the coins ultimately travel to either an acceptable-object or coin bin or trolley, or a reject chute 68.

Figure 43:
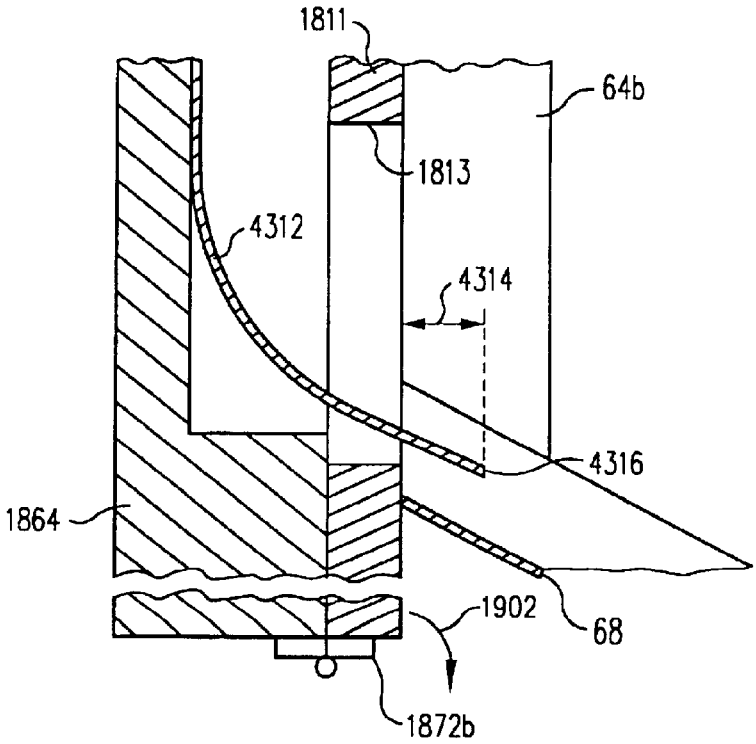
FIG. 43 is a partial perspective view showing a coin return path according to an embodiment of the present invention.
Figure 43A:
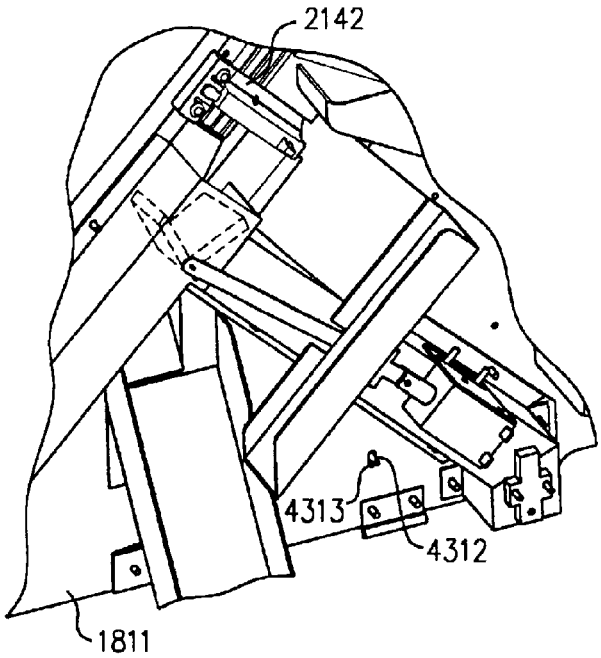
FIG. 43A is a partial perspective view showing the diverter cover in a closed or normal position, according to an embodiment of the present invention.

In the embodiment depicted in FIG. 43, a coin return ramp 4312 extends from the coin return region 1912, through the opening 1813 of the diverter cover 1811 and extends a distance 4314 outward and above the initial portion of the coin return chute 68. Thus, coins which are not deflected by the door 62 travel down the ramp 4312 and fly off the end 4316 of the ramp in a "ski jump" fashion before landing on the coin return chute surface 68. Even though preferably, coin contact surfaces such as the ramp 4312 and coin return chute 68 are embossed or otherwise reduce facial contact with coins, providing the "ski jump" flying region further reduces potential for slowing or adhesion of coins (or other objects) as they travel down the return chute towards the customer return box.

Preferably the device is configured such that activation of the door deflects coins to an acceptable coin bin and non-activation allows a coin to move along a default path to the reject chute 68. Such "actuate-to-accept" technique not only avoids accumulation of debris in the exit bins but improves accuracy by accepting only coins that are recognized and, further, provides a configuration which is believed superior during power failure situations. The actuate-to-accept approach also has the advantage that the actuation mechanism will be operating on an object of known characteristics (e.g. known diameter, which may be used, e.g. in connection with determining velocity and/or acceleration, or known mass, which may be used, e.g. for adjustment of forces, such as deflection forces). This affords the opportunity to adjust, e.g. the timing, duration and/or strength of the deflection to the speed and/or mass of the coin. In a system in which items to be rejected are actively deflected, it would be necessary to actuate the deflection mechanism with respect to an object which may be unrecognized or have unknown characteristics.

Although in one embodiment the door 62 is separately actuated for each acceptable coin (thus reducing solenoid 2306 duty cycle and heat generation), it would also be possible to configure a device in which, when there are one or two or more sequential accepted coins, the door 62 is maintained in its flexed position continuously until the next non-accepted coin (or other object) approaches the door 62.

An embodiment for control and timing of the door 62 deflection will be described more thoroughly below. In the depicted embodiment, the door 62 is deflected by activation of a solenoid 2306. The door 62, in one embodiment, is made of a hard resilient material, such as 301 full hard stainless steel which may be provided in a channel shape as shown. In one embodiment, the back surface of the coin-contact region of the door 2308*a* is substantially covered with a sound-deadening material 2334 such as a foam tape (available from 3M Company). Preferably the foam tape has a hole 2335 adjacent the region where the solenoid 2306 strikes the door 62.

In one embodiment, the door 62 is not hinged but moves outwardly from its rest position (FIG. 23E) to its deflected position (FIG. 23F) by bending or flexing, rather than pivoting. Door 62, being formed of a resilient material, will then deflect back 2312 to its rest position once the solenoid 2306 is no longer activated. By relying on resiliency of an unhinged door for a return motion, there is no need to provide a door return spring. Furthermore, the resiliency of the door, in general, provides a force greater than the solenoid spring return force normally provided with a solenoid, so that the door 62 will force the solenoid back to its rest position (FIG. 23E) (after cessation of the activation pulse), more quickly than would have been possible if relying only on the force of the solenoid return spring. As a result, the effective cycle time for the solenoid/door system is reduced. In one embodiment, a solenoid is used which has a normal cycle time of about 24 milliseconds but which is able to achieve a cycle time of about 10 milliseconds when the resilient-door-closing feature is used for solenoid return, as described. In one embodiment, a solenoid is used which is rated at 12 volts but is activated using a 24-volt pulse.

Figure 26:
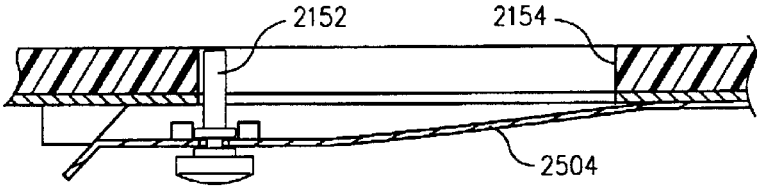
FIGS. 26 and 26A are cross-sectional views taken along lines 26—26 and 26A—26A of FIGS. 25 and 25A.
Figure 26A:
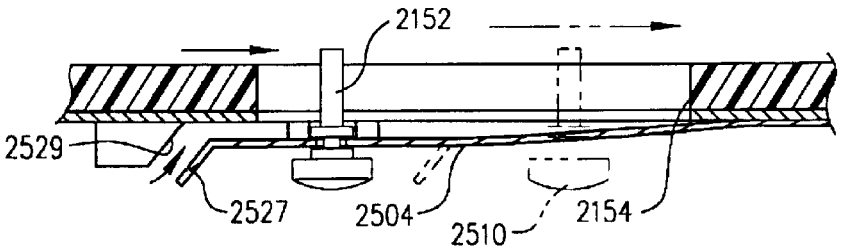

In some situations, particularly at the end of a coin discrimination cycle or transaction, one or more coins, especially wet or sticky coins, may reside on the first portion 2121*a* of the rail such that they will not spontaneously (or will only slowly) move toward the sensor 58. Thus, it may be desirable to include a mechanical or other transducer for providing energy, in response to a sensed jam, slow-up or other abnormality. One configuration for providing energy is describe in U.S. Pat. No. 5,746,299, incorporated herein by reference. According to one embodiment for providing energy, a coin rake 2152, normally retracted into a rake slot 2154 (FIG. 23A), may be activated to extend outward 2156 from the slot 2154 and move lengthwise 2156 down the slot 2154 to push slow or stopped coins down the coin path, such as onto the second portion 2121*b* of the coin rail, or off the rail to be captured by the hopper extension 2204. An embodiment for timing and control of the rake is described more thoroughly below. In one embodiment, rake movement is achieved by activating a rake motor 2502 (FIG. 19) coupled to a link arm 2504 (FIG. 25). This link 2504 is movably mounted to the rear portion of the chassis 1864 by a pin and slot system 2506*a,b,* 2507*a,b.* A plate section 2509 of the link 2504 is coupled via slot 2511 to an eccentric pin of motor 2502. A slot 2513 of the link arm 2504 engages a rear portion of the rake 2152. Activation of the motor 2502 rotates eccentric pin 2515 and causes link 2504 to move longitudinally 2517. A slot 2513 of the link arm 2504, forces the rake 2152 to move 2519 along the inclined slot 2154 toward a downstream position 2510 (FIG. 26A). The function of causing the rake to protrude or extend outward 2156 from the slot 2154 can be achieved in a number of fashions. In one embodiment, the link arm 2504 is shaped so that when the rake is positioned down the slot 2154, the rake 2152 is urged outwardly 2156 bu the shape of the resilient link arm 2504. As the rake is moved upstream 2525 toward the normal operating location, a cam follower formed on the free end 2527 of the link arm is urged rearwardly by a cam 2529 carrying the rake 2152 with it, rearwardly to the retracted position (FIG. 23A, FIG. 26).

Preferably, the rake position is sensed or monitored, such as by sensing the position of the rake motor 2502, in order to ensure proper rake operation. Preferably the system will detect (e.g. via activity sensor 1754) if the coin rake knocked coins off the rail or, via coin sensor 58, if the coin rake pushed coins down the coin rail to move past the sensor 58. In one embodiment if activation of the coin rake results in coins being knocked off the rail or moved down the rail, the coin rake will be activated at least a second time and the system may be configured to output a message indicating that the system should be cleaned or requires maintenance.

Between the time that a coin passes beneath the sensor 58 and the time it reaches the deflection door 62 (typically a period of about 30 milliseconds), control apparatus and software (described below) determine whether the coin should be diverted by the door 62. In general, it is preferred to make the time delay between sensing an object and deflecting the object (i.e., to make the distance between the sensor and the deflection door) as short as possible while still allowing sufficient time for the recognition and categorization processes to operate. The time requirements will be at least partially dependent on the speed of the processor which is used. In general, it is possible to shorten the delay by employing a higher-speed processor, albeit at increased expense. Shortening the path between the sensor and the deflector not only reduces the physical size of the device but also reduces the possibility that a coin or other object may become stuck or stray from the coin path after detection and before disposition (potentially resulting in errors, e.g. of a type in a coin is "credited" but not directed to a coin bin). Furthermore, shortening the separation reduces the chance that a faster following coin will "catch up" with a previous slow or sticky coin between the sensor and the deflector door. Shortening the separation additionally reduces the opportunity for coin acceleration or velocity to change to a significant degree between the sensor 58 and the door 62. Since the door, in one embodiment, is controlled based on velocity or acceleration measured or (calculated using data measured) at the sensor, a larger separation (and consequently larger rail length with potential variations is, e.g. friction) between the sensor 58 and the door 62 increases the potential for the measured or calculated coin velocity or acceleration to be in error (or misleading).

Because the coin deflector requires a certain minimum cycle time (i.e., the time from activation of the solenoid until the door has returned to a rest state and is capable of being reactivated), it is impossible to successfully deflect two coins which are too close together. Accordingly, when the system determines that two coins are too close together (e.g. by detecting successive "trail" times which are less than a minimum period apart), the system will refrain from activating the deflector door upon passage of one or both such coins, thus allowing one or both such coins to follow the default path to the reject chute, despite the fact that the coins may have been both successfully recognized as acceptable coins.

If a coin is to be diverted, when it reaches the door 62, solenoid 2306 is activated. Typically, because of the step 2136*b* and/or other flying-inducing features, by the time a coin reaches door 62 it will be spaced a short distance 2307 (such as 0.08 inches, or about 2 mm) above the door plane 62 and the door, as it is deflected to its activated position (FIG. 23F), will meet the flying coin and knock the coin in an outward direction 2323 to the common entrance 1728 of acceptable-coin tubes 64*a,* 64*b.* Preferably all coin contact surfaces of the return chute and coin tube are provided with a surface texture such as an embossed surface which will reduce friction and/or adhesion. Additionally, such surfaces may be provided with a sound-deadening material and/or a kinetic energy-absorbing material (to help direct coins accurately into the accept bins).

In one embodiment, the timing of deflection of the door 62 is controlled to increase the likelihood that the door will strike the coin as desired in such a fashion as to divert it to entrance to the coin tubes 1728. The preferred striking position may be selected empirically, if desired, and may depend, at lest partially, on the diameter and mass of the coins and the coin mix expected in the machine as well as the size and characteristics of the door 62. In one embodiment, the machine is configured to, on average, strike the coin when the leading edge of the coin is approximately 3 mm upstream ("upstream" indicating a direction opposite the direction of coin flow 2332) of the downstream edge 2334 of the actuator door 62 (FIG. 23E). In one embodiment, this strike position is the preferred position regardless of the diameter of the coin.

Preferably, there is a gap between coins as they stream past the door 62. The preferred gap between adjacent coins which have different destinations (i.e., when adjacent coins include an accepted coin and a not-accepted coin) depends on whether the accepted coin is before or after the non-accepted coin (in which the "accepted coin" is a coin which will be diverted by the door and the not-accepted coin will travel past the door without being diverted). The gap behind a not-accepted coin (or other object) which reaches the door 62 before an accepted coin is referred to herein as a "leading gap". The gap behind an accepted coin is referred to herein as a "trailing gap". In one embodiment, the preferred leading gap is described by the following equation:

$$GAP_{lead.min}=\Delta d_{StoA.lead}+Error_{Plus}+a \quad (1)$$

where:

$\Delta d_{StoA.lead}$ represents the change in the actual inter-coin gap from the time the coins pass the sensor 58 to the time when the coins reach the door 62 (approximately 3 mm);

$Error_{Plus}$ represents the distance error due to compensation uncertainties, assuming leading gap worst conditions of maximum initial velocity and a frictionless rail (approximately 6 mm); and a represents the dimension from the downstream edge of the actuator door 2334 to the leading edge of the coin at the preferred strike position (approximately 3 mm).

The preferred minimum leading gap of approximately 12 mm applies when a non-accepted coin (or other object) precedes an accepted coin. In the common case of a string of consecutive accepted coins, this constraint need not be enforced after the first coin in the stream.

In one embodiment, the preferred trailing gap is described by the following equation:

$$GAP_{tr.min}=\Delta d_{StoA.trail}+\Delta d_{ontime}+Error_{minus}+b-a-D_{coin.mi} \quad (2)$$

where:

$\Delta d_{StoA.trail}$ represents the change in actual inter-coin gap between the sensor 58 and the door 62 (approximately 2 mm);

$\Delta d_{ontime}$ represents the distance the coins travel during the time the actuator door is extended (approximately 5 mm);

$Error_{minus}$ represents the error due to compensation uncertainties, assuming trailing gap worst conditions of zero initial velocity and a sticky or high-fraction rail (approximately 6 mm);

b represents the length 2336 of the door 62; and $D_{coin.mi}$ represents the diameter of the accepted coin (in the worst case for a common U.S. coin mix, 17.5 mm).

This results in a preferred minimum trailing gap of 5.2 mm.

A process for verifying the existence of preferred leading and trailing gaps, in appropriate situations, and/or selecting or controlling the activation of the door 62 to strike coins at the preferred position, is described below.

In the depicted embodiment, the region of the common entrance 1728 (FIG. 17) is provided with a flapper movable from a first position 1732*a* which guides the coins into the first coin tube 64*a* for delivery, ultimately, to a first coin trolley 66*a,* to a second position 1732*b* for deflection to the second coin tube 64*b* for delivery to the second coin trolley 66*b.* In one embodiment, the flapper 1732 is made of plastic to reduce noise and the tendency to bind during operation. A solenoid actuator 1734, via link arm 1736, is used to move the flapper between the positions 1732*a,* 1732*b,* e.g. in response to control signals from a microcontroller (described below). The flapper 1732 may also be rapidly cycled between its extreme positions to self-clean material from the mechanism. In one embodiment, such self-cleaning is performed after each transaction. In one embodiment, coin detectors such as paired LEDs and optical detectors 1738*a, b* output signals to the microcontroller whenever passage of a coin is detected. These signals may be used for various purposes such as verifying that a coin deflected by the door 62 is delivered to a coin tube, verifying that the flapper 1732 is in the correct position, and detecting coin tube blockages such as may result from backup of coins from an over-filled coin bin. Thus, the sensor 1738*a,* 1738*b* at the end of each tube, each provides data used for performing two or more functions, such as verifying accepted-coin delivery, verifying flapper placement, and verifying and detecting coin bin overfill.

Figure 28A:
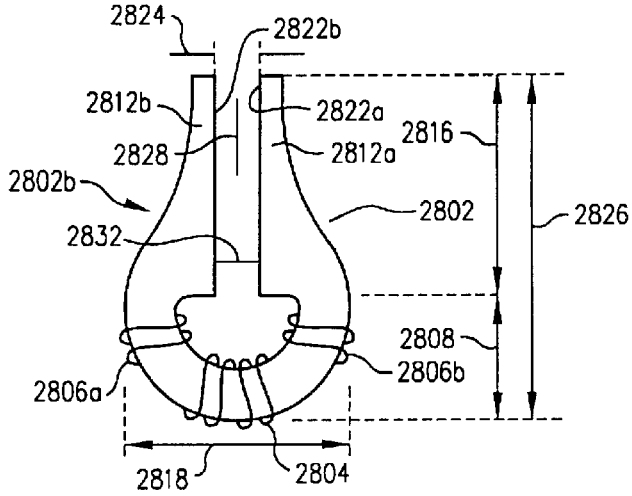
FIGS. 28A–28I are front, elevational and top views of sensor cores according to embodiments of the present invention.
Figure 28B:
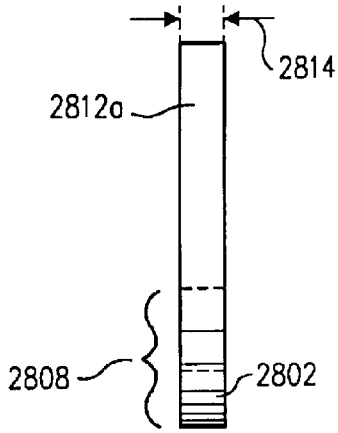

As best seen in FIGS. 27A and 27B, the sensor 58 is preferably directly mounted on the sensor PCB 2512 and communicates, electrically, therewith via a header 2702 with leads 2704 soldered onto the board 2512. Providing the sensor and the sensor board as a single integrated unit reduces manufacturing costs and eliminates cabling and associated signal noise. The sensor 58 is made of a core 2802 (FIGS. 28A, 28B) with a low-frequency 2804 and high frequency 2806 windings on the core. Polarity of the windings should be observed so that they are properly synchronized. Providing a winding in a reverse direction can cause signal cancellation.

The core 2802, in the depicted embodiment, is generally U-shaped with a lower annular, semicircular, rectangular cross-sectioned portion 2808 and an upper portion defining two spaced-apart legs 2812*a,* 2812*b.* The core 2802, in the depicted embodiment, has a thickness 2814 of less than about 0.5 inches, preferably about 0.2 inches (about 5 mm), a height 2816 of about 2.09 inches (about 53 mm) and a width 2818 of about 1.44 inches (about 3.65 cm) although other dimension can also be used, such as a thickness greater than about 0.5 inches.

Because the sensor 58 is preferably relatively thin, 2814, the magnetic field is relatively tightly focused in the longitudinal (streamwise) direction. As a result, the coin or other object must be relatively close to the sensor before the coin will have significant effect on sensor output. For this reason, it is possible to provide relatively close spacing of coins without substantial risk of undesirable influence of a leading or following coin on sensor output.

The facing surfaces 2822*a, b* of the legs 2812*a, b* are, in the depicted embodiment, substantially parallel and planar and are spaced apart a distance 2824 of about 0.3 inches (about 8 mm). The interior facing surfaces 2822*a, b* have a height at least equal to the width of the coin rail 2826, such as about 1.3 inches (about 33 mm). With the sensor positioned as depicted in FIG. 21 in the operating configuration, the upper leg 2812*a* of the core is spaced from the lower leg 2812*b* of the core (see FIG. 23D) by the inter-face gap 2824 to define a space 2304 for coin passage through the inter-leg gap. The core 2802 may be viewed as having the shape of a gapped torroid with extended legs 2812*a,* 2812*b* with parallel faces 2822*a, b.* In one embodiment, the legs 2812*a,b* are substantially parallel. In another embodiment, the legs 2812*a,b* are slightly inclined with respect to one another to define a tapered gap. Without wishing to be bound by any theory, it is believed that, as depicted in FIG. 28E, extended faces which are inclined to define a gap which slightly tapers 2832 (taper exaggerated, for at least some embodiments in FIG. 28E) vertically downward yields somewhat greater sensitivity near the rail (where the majority of the coins or other items will be located) but is relatively insensitive to the vertical 2828 or horizontal 2832 position of coins therein (so as to provide useful data regardless of moderate coin bounce and/or wobble) as a coin passes through the gap 2824. In the embodiment of FIG. 28F, the extended faces taper in the opposite vertical direction 2834. The faces may be configured at an angle 2836*a,b,c* to the lateral axis 2838 of the sensor, as depicted in FIGS. 28G, H, and I. By selecting the angle(s) 2836 ABC used, or otherwise selecting the shapes of the sensor faces, other tapered spaces between the legs can be provided. It is also possible to provide for changes in inter-leg spacing as a function of the distance along the longitudinal axis 2858 including changes which are non-linear, such as providing curved, angled, dog-legged or similar sensor face configurations.

In the depicted embodiment, the faces 2822*a,b* extend 2816 across the entire path width 2133, to sense all metallic objects that move along the path in the region of the sensor. It is also possible to provide face extents which are larger or smaller than the path width, such as equal to the diameter of the largest acceptable coin.

It is believed that providing a core with a larger gap (i.e. with more air volume) is partially responsible for decreasing the sensitivity to coin misalignments but tends to result in a somewhat lower magnetic sensitivity and an increase in cross-talk. In one embodiment, the sensor can provide reliable sensor output despite a vertical displacement ("bounce") of about 0.1 inch (about 2.5 mm) or more, and a sideways (away from the stringers) displacement or "wobble" of up to 0.015 inches (about 0.4 mm).

In the depicted embodiment the low frequency winding 2804 is positioned at the bottom of the semicircular portion 2808 and the high frequency winding is positioned on each leg 2806*a, b* of the semicircular portion. In one embodiment the low frequency winding is configured to have an inductance (in the driving and detection circuitry described below) of about 4.0 millihenrys and the high frequency winding 2806*a, b* to have an inductance of about 40 microhenrys. These inductance values are measured in the low frequency winding with the high frequency winding open and measured in the high frequency winding with the low frequency winding shorted together. The signals on the windings are provided to printed circuit board via leads 2704.

Figure 28C:
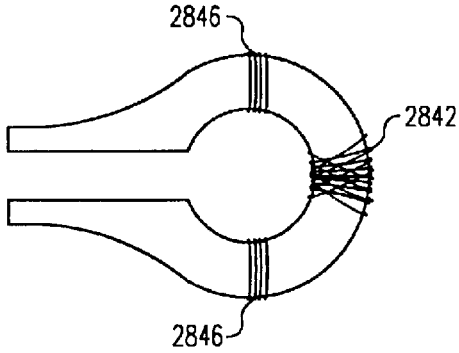
Figure 28D:
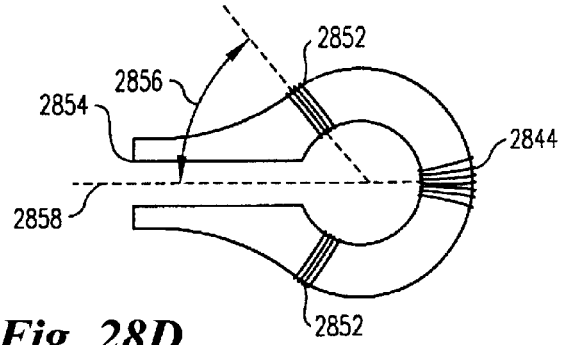
Figure 28E:
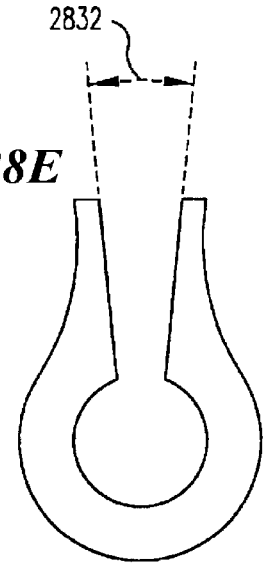
Figure 28F:
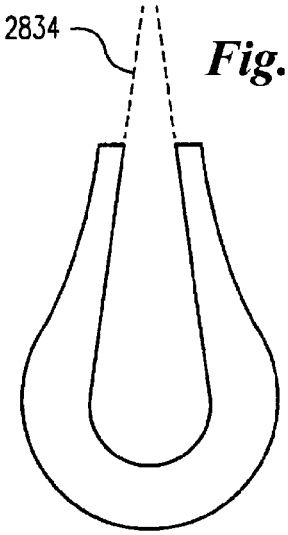
Figure 28G:
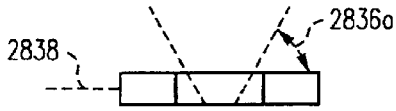
Figure 28H:
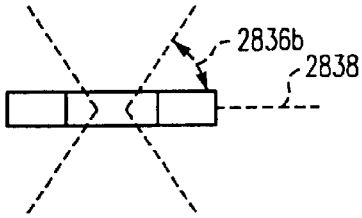
Figure 28I:
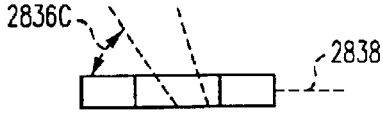

In the embodiment of FIG. 28C, the low frequency winding 2842 crosses over itself whereas in the embodiment of FIG. 28D, a single continuous winding 2844 is provided without cross-over or multiple layers, which is believed to improve the consistency and repeatability of sensor performance. Without wishing to be bound by any theory, this is believed to be due at least partially to increasing the self-resonant frequency of the low-frequency winding.

Figure 29A:
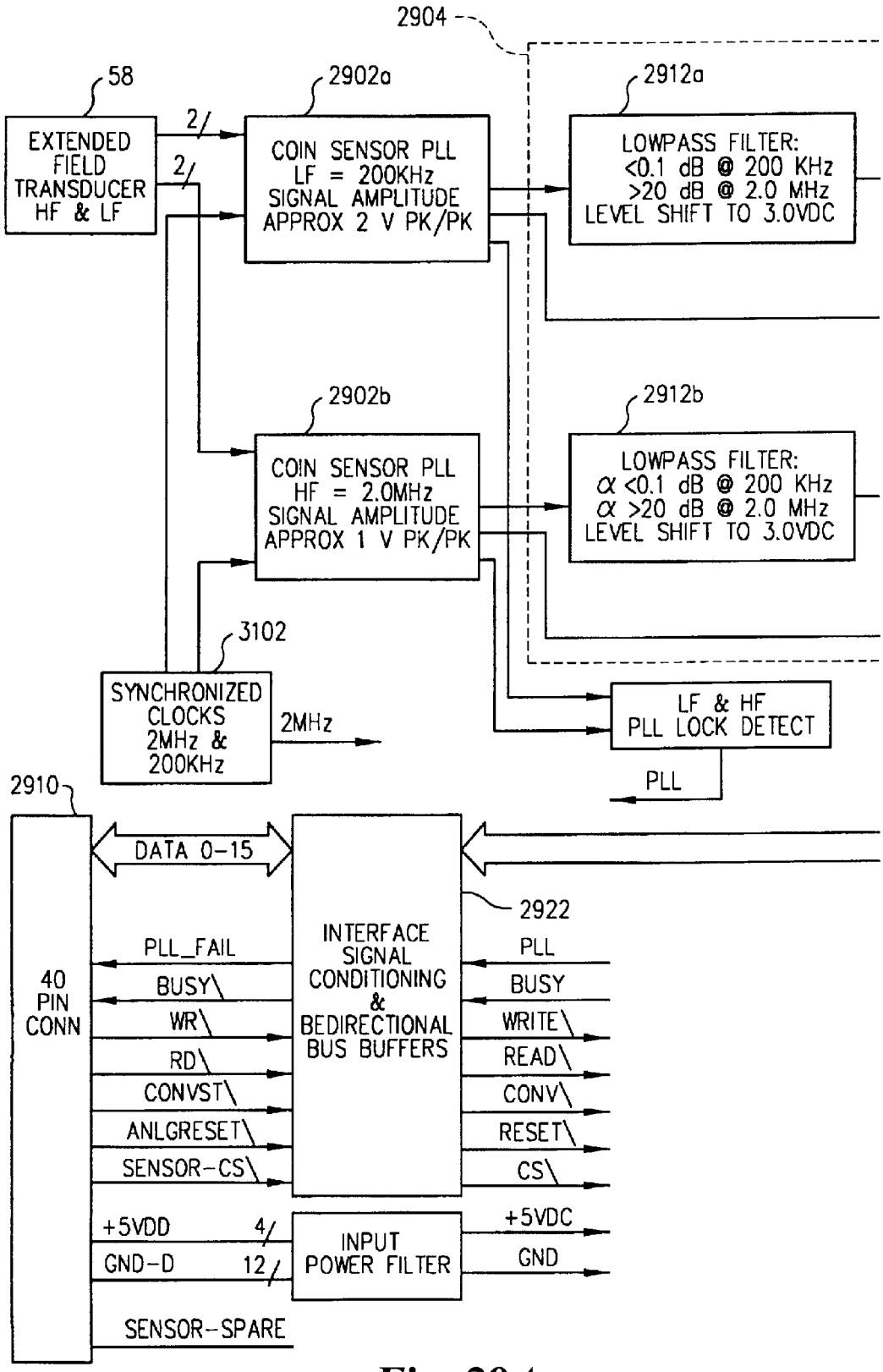
FIGS. 29A–29B are block diagrams of functional components of a sensor board, according to an embodiment of the present invention.
Figure 29B:
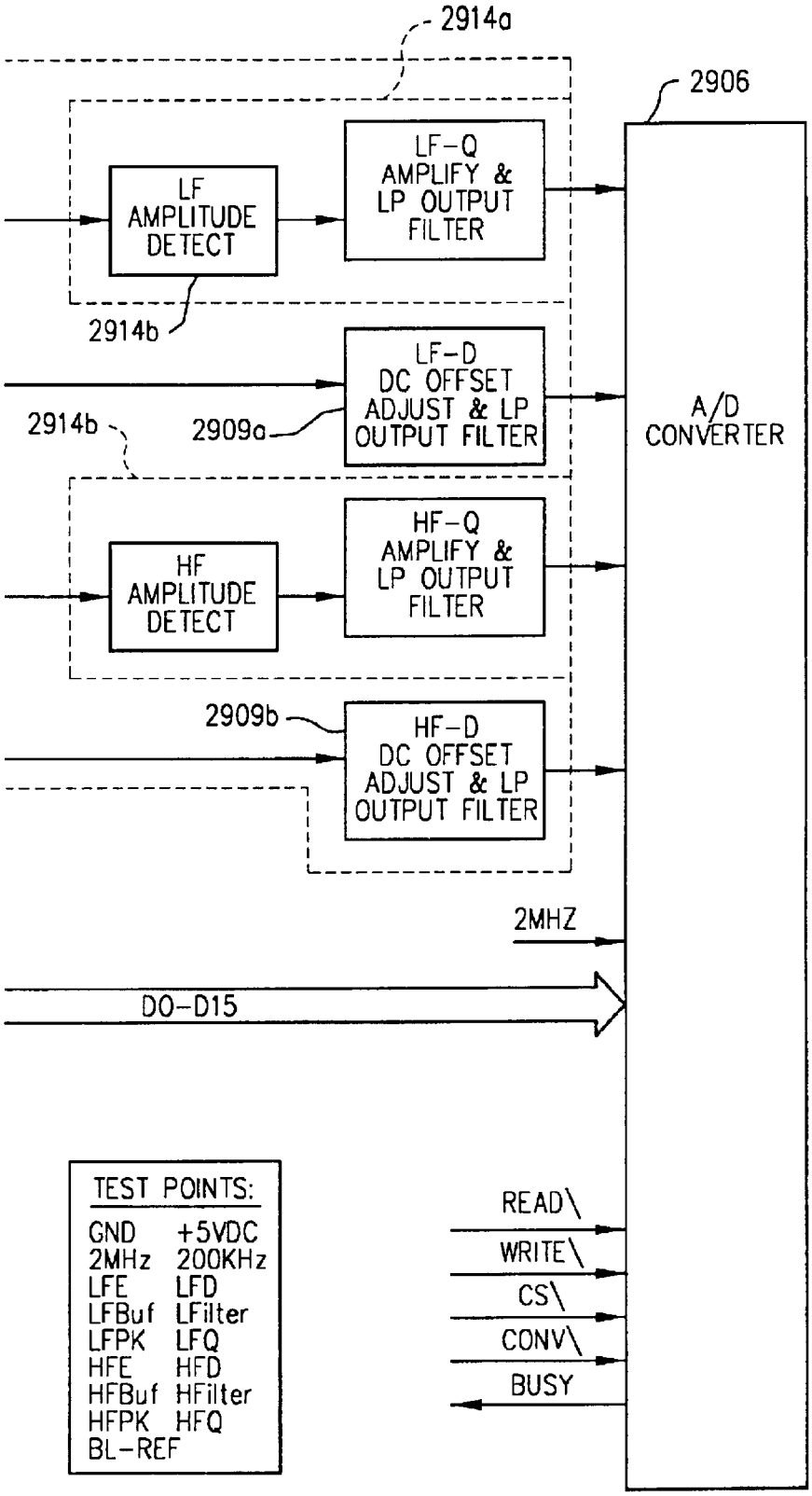
Figure 31A:
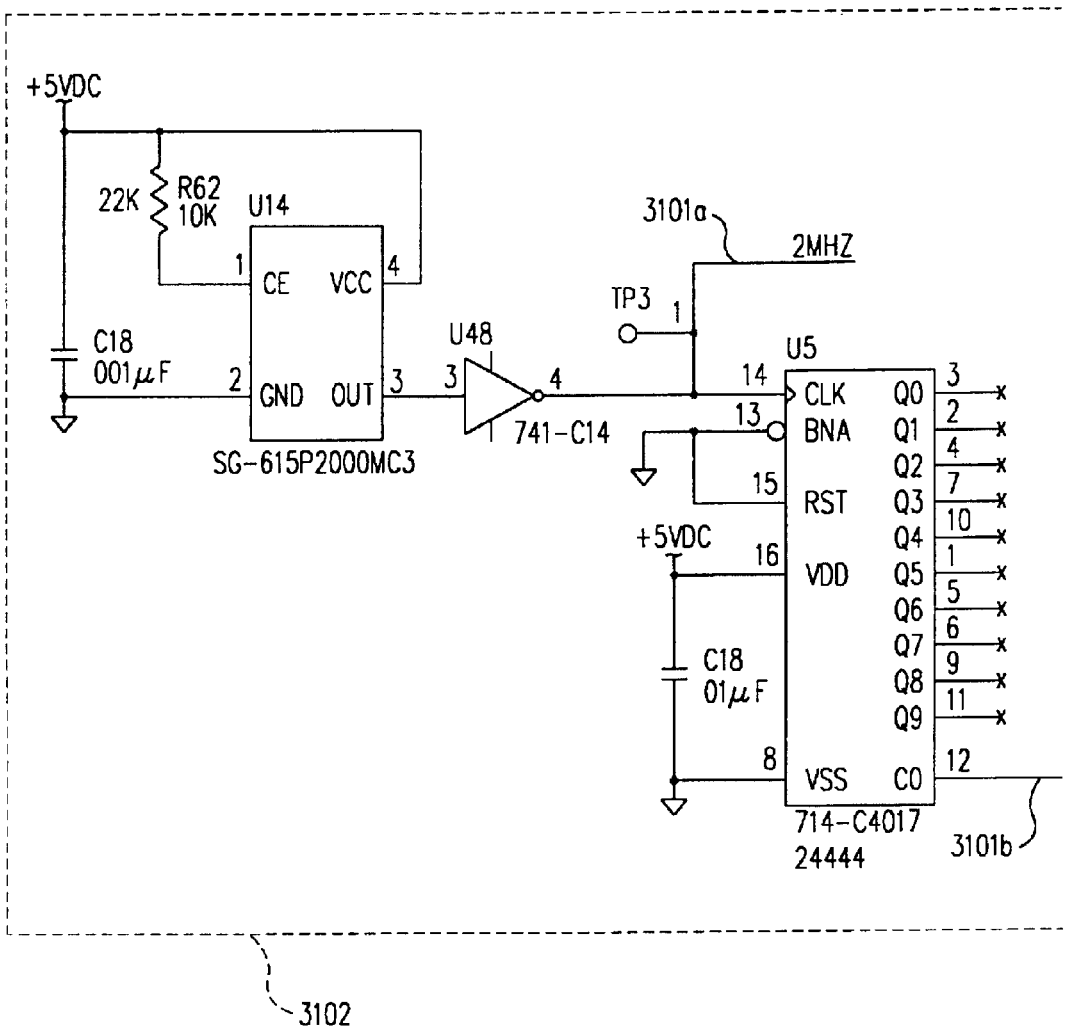
FIGS. 31A–31I are schematic diagrams of a sensor board, according to an embodiment of the present invention.
Figure 31B:
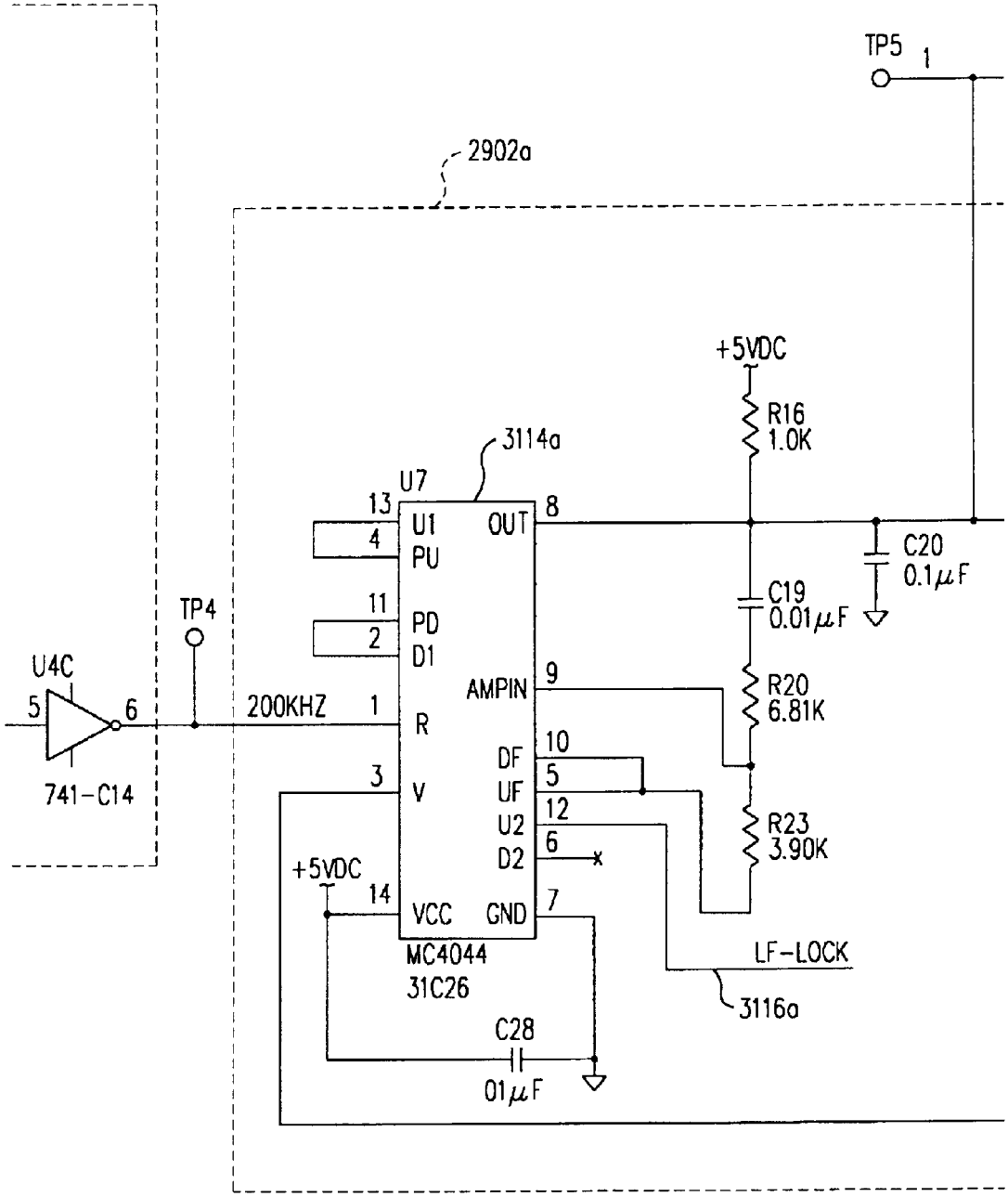
Figure 31C:
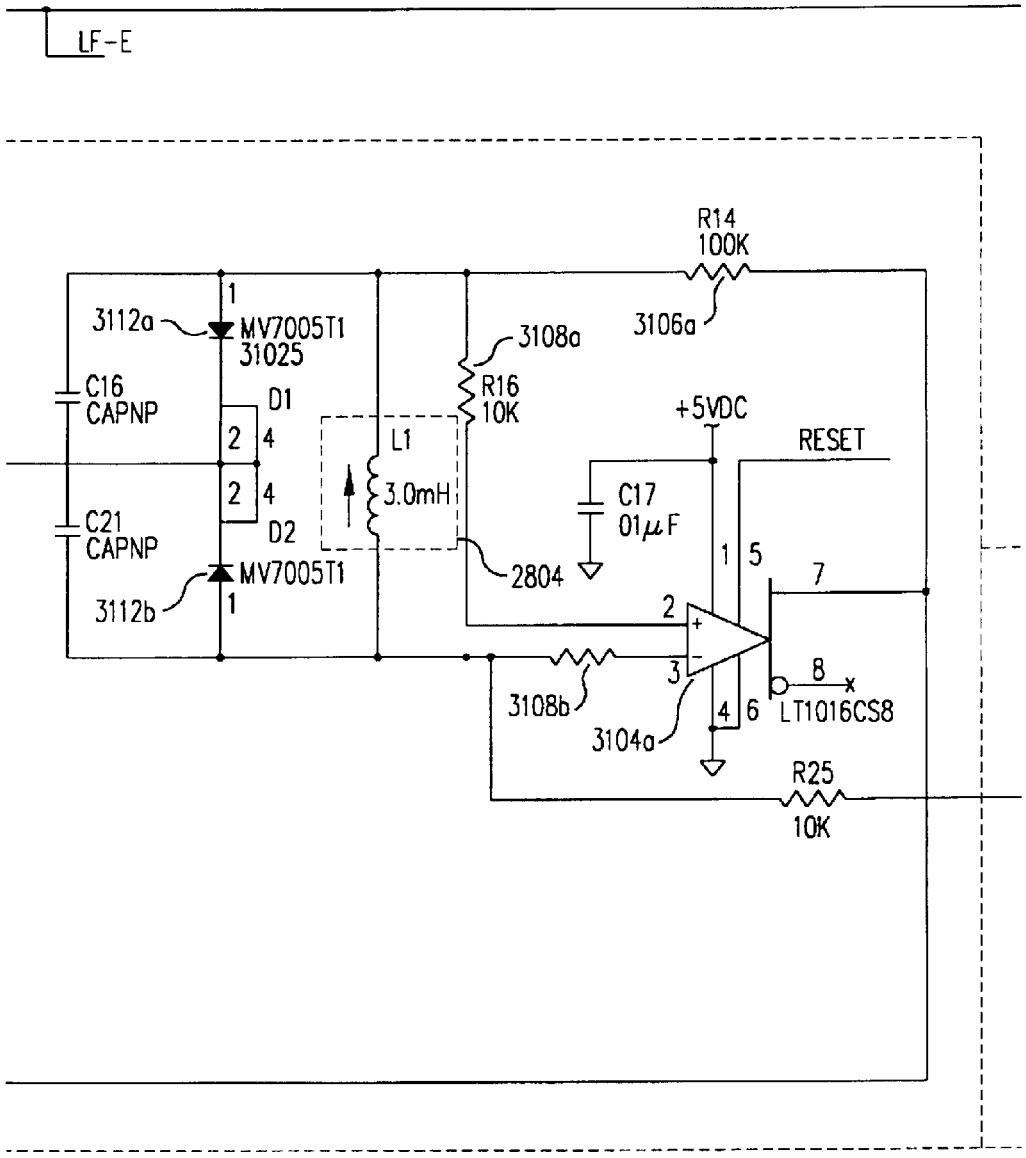
Figure 31D:
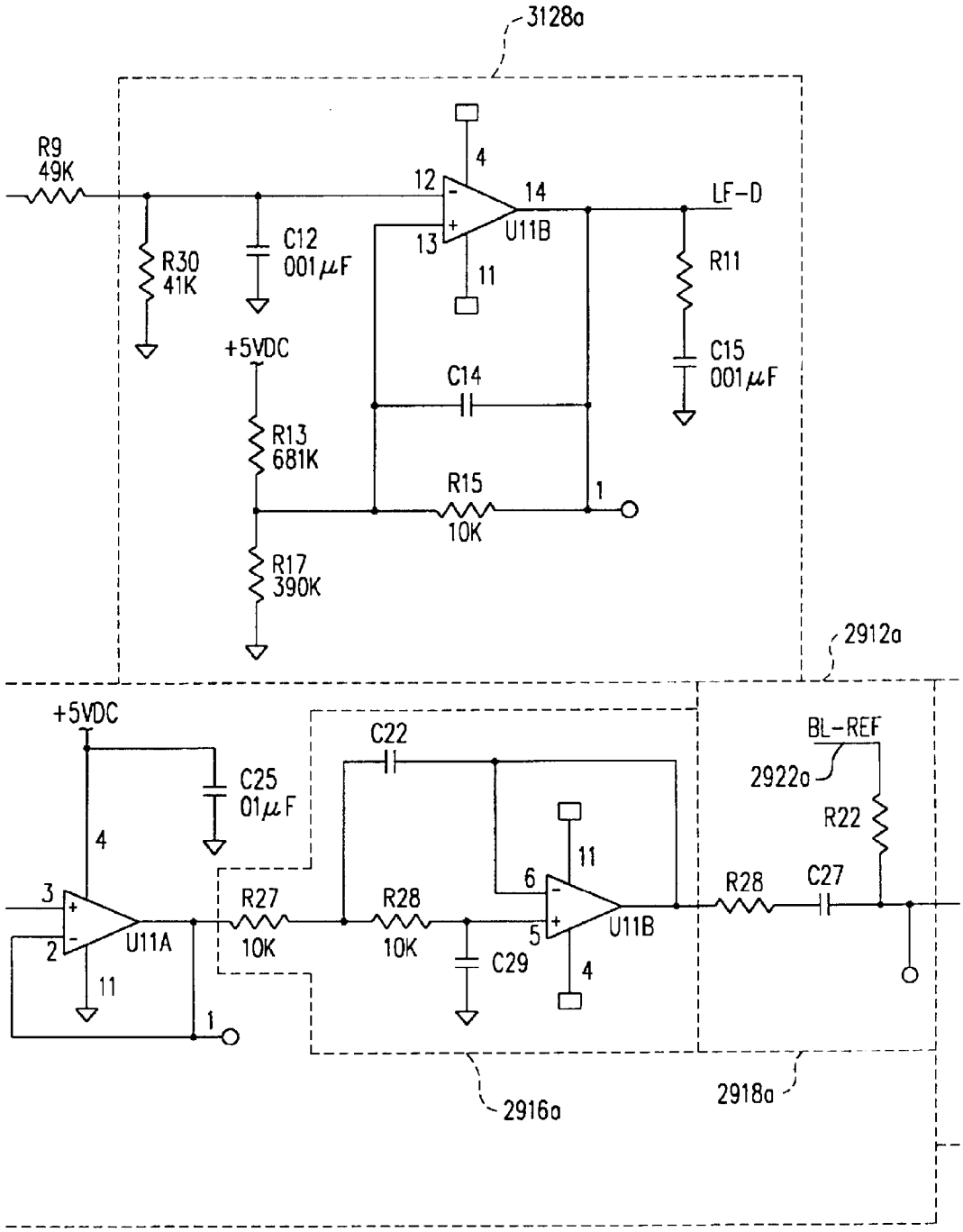
Figure 31E:
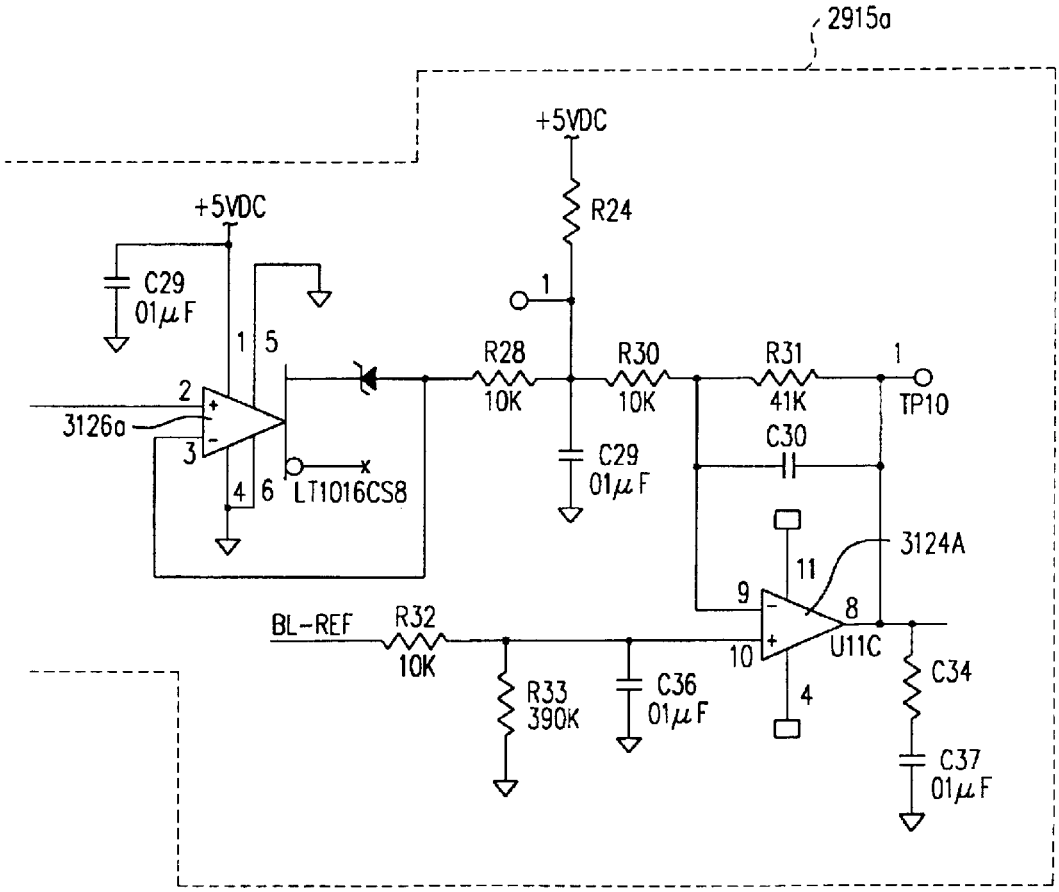
Figure 31F:
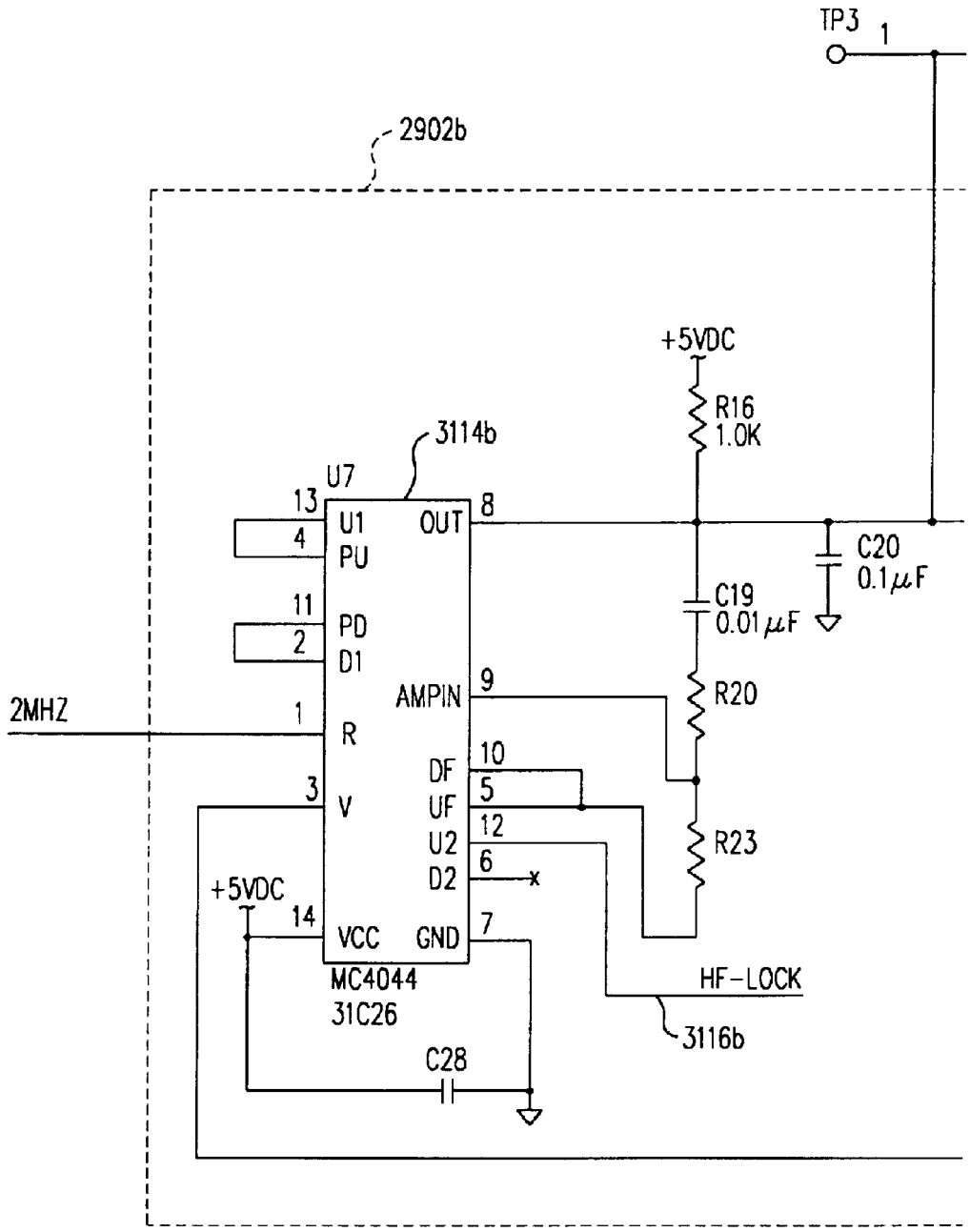
Figure 31G:
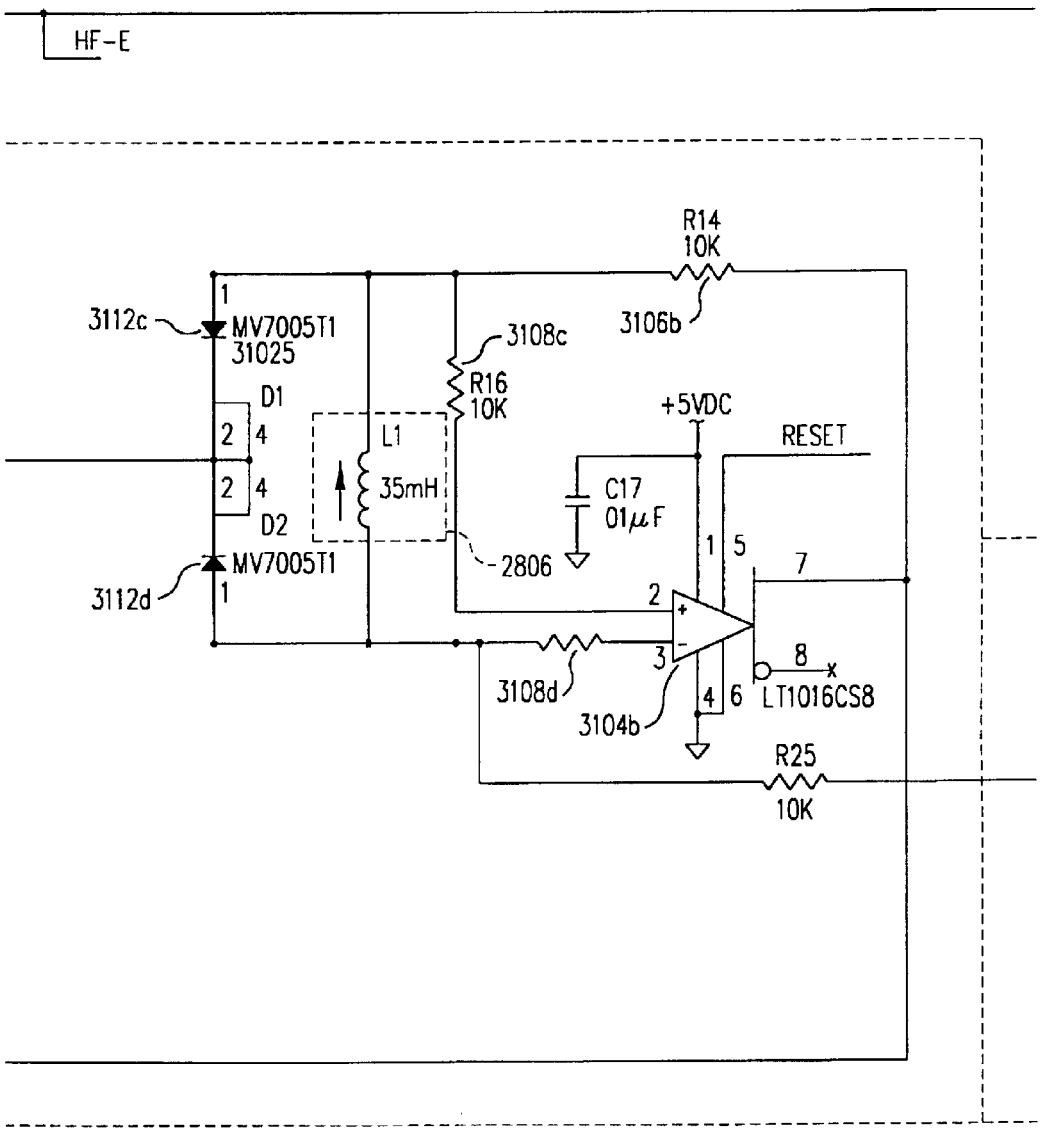
Figure 31H:
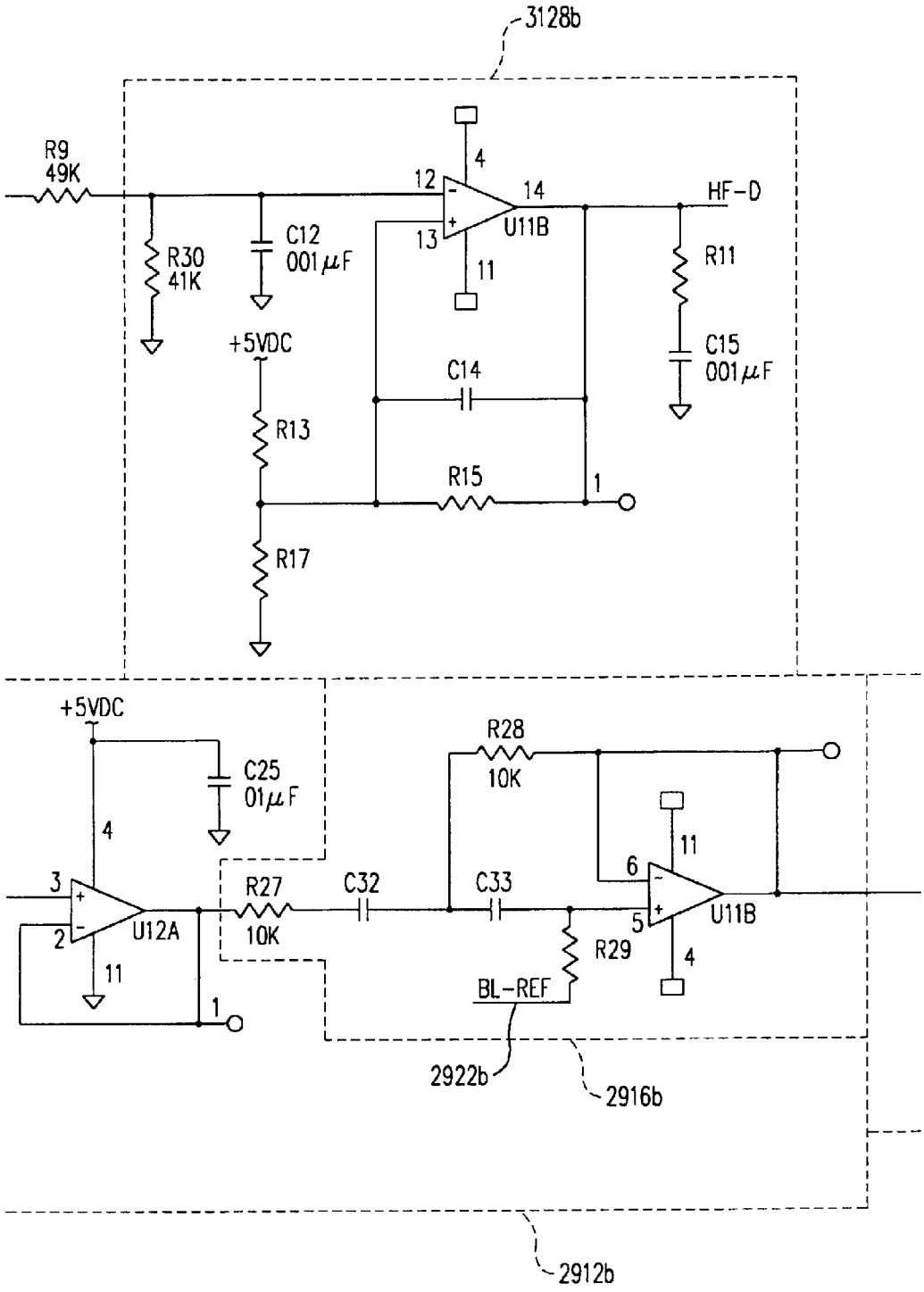
Figure 31I:
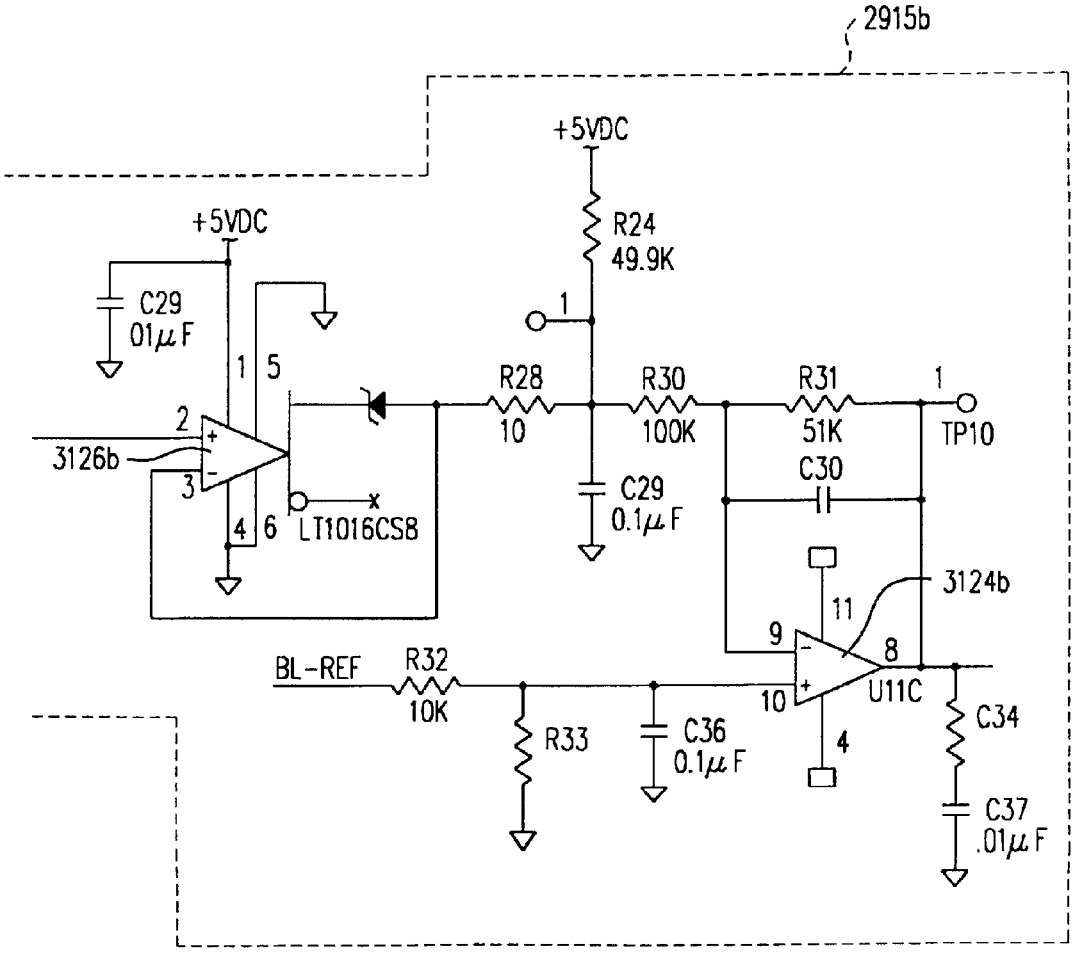

FIGS. 29A–29B depict the major functional components of the sensor PCB 2512. In general, the sensor or transducer 58 provides a portion of a phase locked loop which is maintained at a substantially constant frequency. Thus, the low frequency coil leads are provided to a low frequency PLL 2902*a* and the high frequency leads are provided to high frequency sensor PLL 2902*b*.

Figure 56A:
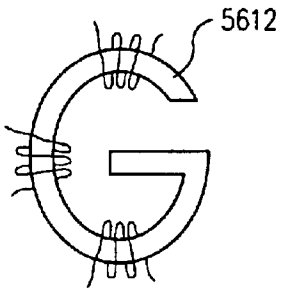
FIGS. 56A–H are side views of sensor shapes according to embodiments of the present invention.
Figure 56B:
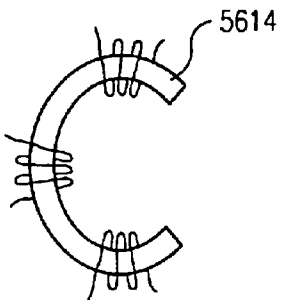
Figure 56C:
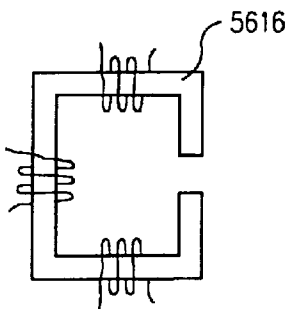
Figure 56D:
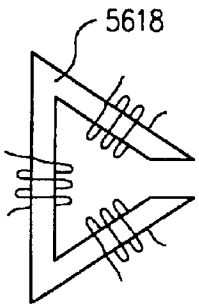
Figure 56E:
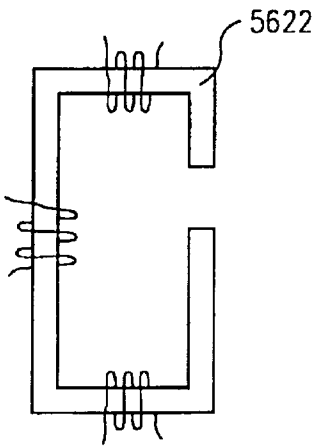
Figure 56F:
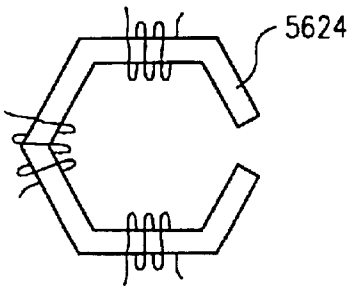
Figure 56G:
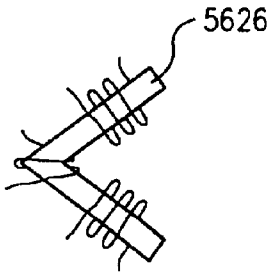
Figure 56H:
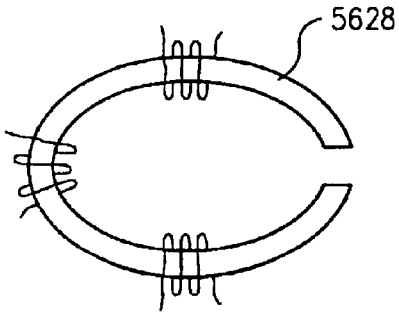

In addition to the toroid or torus-shaped sensors (FIGS. 2A, 2B), extended-leg sensors (FIGS. 28A–I) and other depicted and described sensor shapes, other shapes for the magnetic core can be provided, such as a G-shape(5612, FIG. 56A), a C-shape (5614, FIG. 56B), a triangular shape (5618, FIG. 56D), a square shape (5616, FIG. 56C), a rectangular shape(5622, FIG. 56E), a polygonal shape(5624, FIG. 56F), a circular shape (214, FIG. 2A), a V-shape (5626 FIG. 56G), and an oval or elliptical shape(5628, FIG. 56H, sections or portions thereof and the like. It is believed that alternative magnetic core shapes can be advantageously considered, despite effects such shape changes may have on sensor performance, at least partially because other shapes may be found to be more cost-effective to produce.

Although the depicted embodiments provide a sensor with a single magnetic core as a unitary piece, it is possible to configure a sensor with two spaced apart components such as providing the signal-generating magnetic means on one side of a coin and a signal-receiving magnetic means on the other side of a coin (as the coin moves past the center). It is believed, however, that such a multipart sensor will present alignment requirements and may prove to be relatively expensive or provide less uniform or reliable performance.

FIG. 29 depicts the major functional components of the sensor PCB 2512. In general, the sensor or transducer 58 provides a portion of a phase locked loop which is maintained at a substantially constant frequency. Thus, the low frequency coil leads are provided to a low frequency PLL 2902*a* and the high frequency leads are provided to high frequency sensor PLL 2902*b*.

Figure 40:
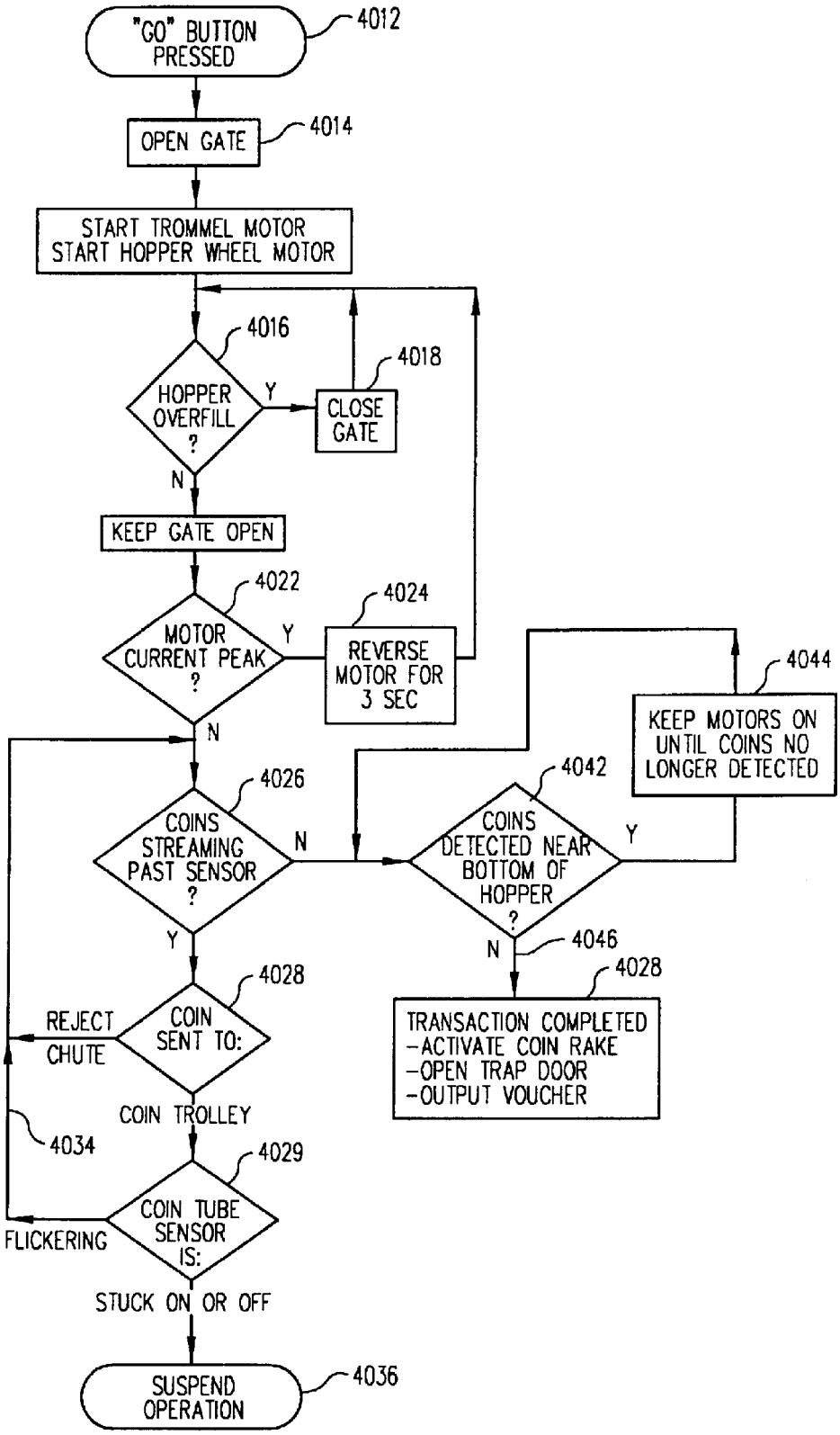
FIG. 40 is a flowchart showing a coin discrimination process, according to an embodiment of the present invention.

FIG. 40 provides an overview of a typical transaction. The transaction begins when a user presses a "go" or start button 4012. In response, the system opens the gate, and begins the trommel and coin pickup assembly disk motors 4014. As coins begin passing through the system, a sensor (not shown) is used to determine if the hopper is in an overfill condition, in which case the gate is closed 4018. The system is continuously monitored for current peaks in the motors 4022 e.g. using current sensors 21,4121 (FIG. 41) so that corrective action such as reversing either or both of the motors for dejamming purposes 4024 can be implemented.

During normal counting operations, the system will sense that coins are streaming past the sensor 4026. The system is able to determine 4028 whether coins are being sent to the reject chute or the coin trolley. In the latter case, the system proceeds normally if the sensor in the coin tube outputs an intermittent or flickering signal. However, if the coin tube sensor is stuck on or off, indicating a jam upstream or downstream (such as an overfilled bin), operations are suspended 4036.

Figure 41:
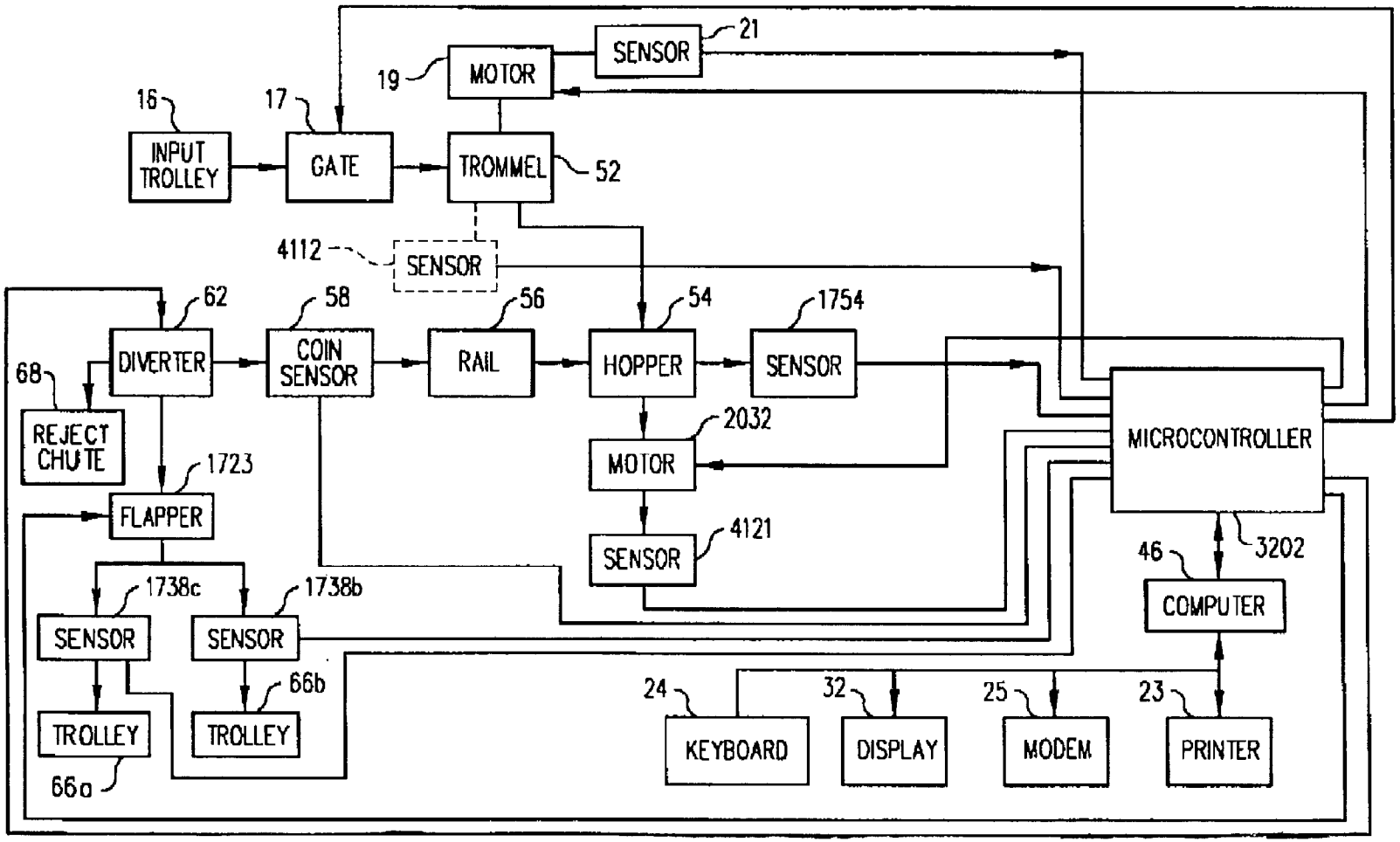
FIG. 41 is a block diagram showing components of a coin discrimination system according to an embodiment of the present invention.
Figure 42:
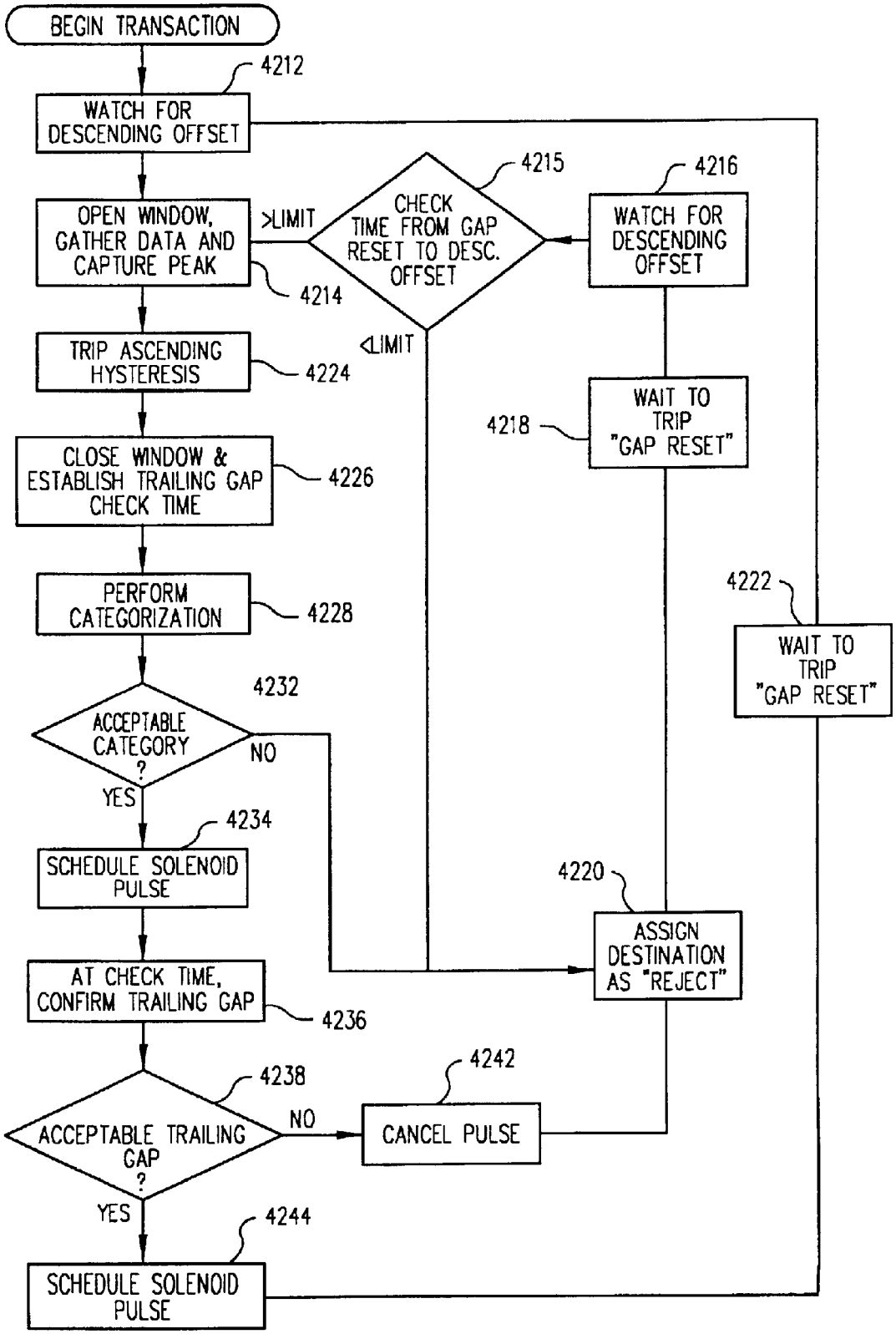
FIG. 42 is a flowchart showing a leading and trailing gap verification procedure.

In one embodiment, the flow of coins through the system is managed and/or balanced. As shown in FIG. 41, coin flow can be managed by, e.g., controlling any or all of the state of the gate 17, state or speed of the trommel motor 19 and/or state or speed of the coin pickup assembly motor 2032 e.g. to optimize or otherwise control the amount of coins residing in the trommel and/or coin pickup assembly. For example, if a sensor 1754 indicates that the coin pickup assembly 54 has become full, the microcontroller 3202 can turn off the trommel to stop feeding the coin pickup assembly. In one embodiment, a sensor 4112, coupled to or adjacent the trommel 52, senses the amount (and/or type) of debris falling out of the trommel during a particular transaction or time period and, in response, the microcontroller 3202 causes the coin pickup assembly motor 2032 to run in a different speed and/or movement pattern (e.g. to accommodate a particularly dirty batch of coins), possibly at the expense of a reduction in throughput.

When the coin sensor 58 (and associated circuitry and software) are used to measure or calculate coin speed, this information may be used not only to control the deflector door 62 as described herein, but to output an indication of a need for maintenance. For example as coin speeds decrease, a message (or series of messages) to that effect may be sent to the host computer 46 so that it can request preventive maintenance, potentially thereby avoiding a jam that might halt a transaction.

Once the system senses that coins are no longer streaming past the sensor, if desired a sensor may be used to determine whether coins are present e.g. near the bottom of the hopper 4042. If coins are still present, the motors continue operating 4044 until coins are no longer detected near the bottom of the hopper. Once no more coins are detected near the bottom of the hopper 4046, the system determines that the transaction is complete. The system will then activate the coin rake, and, if coins are sensed to move past the coin sensor 58 or into the hopper, the counting cycle is preferably repeated. Otherwise, the transaction will be considered finished 4028, and the system will cycle the trap door and output e.g. a voucher of a type which may be exchanged for goods, services or cash.

The coin sensor phase locked loop (PLL), which includes the sensor or transducer 58, maintains a constant frequency and responds to the presence of a coin in the gap 2824 by a change in the oscillator signal amplitude and a change in the PLL error voltage. The phase locked loop shown in the depicted embodiment requires no adjustments and typically settles in about 200 microseconds. The system is self-starting and begins oscillating and locks phase automatically. It is also possible to provide frequencies or signals for application to a sensor without using a phase lock. The winding signals (2 each for high frequency and low frequency channels) are conditioned 2904 as described below and sent to an analog-to-digital (A/D) converter 2906. The A/D converter samples and digitizes the analog signals and passes the information to the microcontroller 3202 (FIG. 32) on the Control Printed Circuit Board Assembly (PCBA) (described below) for further manipulation to identify coins.

Figure 55A:
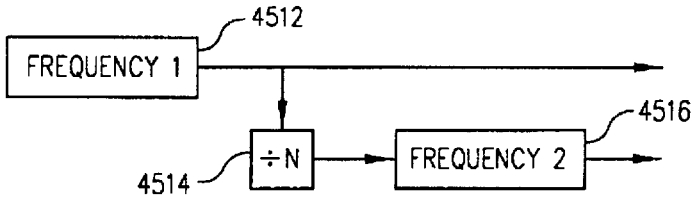
FIGS. 55A–C are block diagrams depicting signal generation and use according to embodiments of the present invention.
Figure 55B:
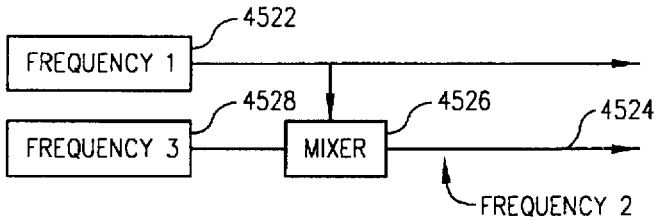
Figure 55C:
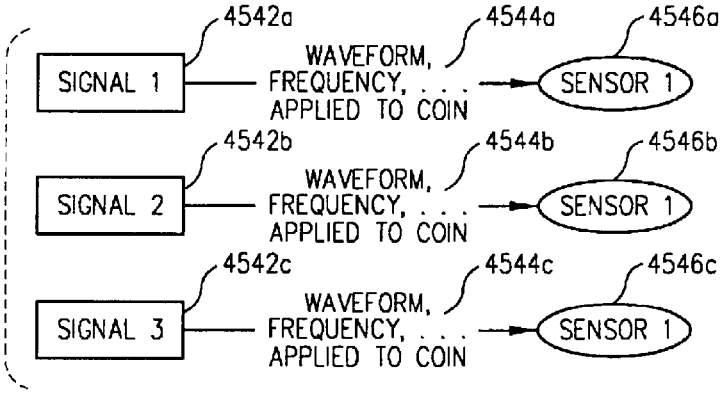
Figure 55D:
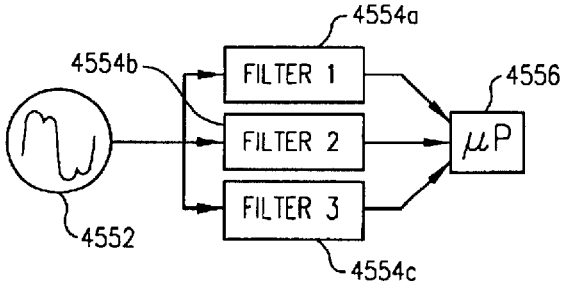
FIG. 55D is a block diagram depicting use of a sensor current response to a square wave voltage.

Although in one embodiment the signal or signals provided to the sensor are substantially sinusoidal, it is also possible to use configurations in which non-sinusoidal signals are provided to the sensor, such as (filtered or unfiltered) substantially square wave, pulse, triangle, or similar periodic signals. Such non-sinusoidal signals, in addition to offering system cost savings, for some configurations, also typically include various harmonics. A harmonic-rich signal, such as a square wave signal is believed to be affected differently for different coins, e.g., due to the interrelationships of the various harmonics' phases and amplitudes. For example, in one embodiment, as depicted in FIG. 55D, application of a square wave voltage to a sensor winding may result in a harmonic-rich current flowing through the sensor winding 4552. The sensor current can be analyzed as depicted 4552 or various components or bandwidths of the sensor current can be separated, e.g., using filters 4554*a,b,c,* for analysis by, e.g., a microprocessor 4556 as described herein. In this way, it is possible to use one signal applied to a sensor coil in connection with two or more signal detecting means for distinguishing one coin from another. If desired, each signal detecting means can be used to provide information on one aspect of a coin's electrical properties. Alternatively, it is possible to obtain information on different aspects of a coin's electrical properties by providing different signals 4542*a,b,c,* applying different wave forms, frequencies, and the like 4544*a,b,c* to a coin, for detection by sensors 4546*a,b,c* as depicted in FIG. 55C.

Although a phase locked loop (PLL) approach to providing one or more constant frequencies is depicted in FIG. 29, other approaches can be used for achieving a relationship between a first and a second frequency. For example, as depicted in FIG. 55A, if a first frequency is provided 4512, a frequency divider 4514 can be used to provide a second frequency 4516 in a known and stable relationship to the first frequency. In the embodiment of FIG. 55B, if a first frequency is provided 4522, a second frequency, 4524 may be obtained by using a mixer 4526 to combine the first frequency 4522 with a third frequency 4528, as will be clear to those who have skill in the art after understanding the present disclosure.

One approach provides a plurality of signals for distinguishing coin types (e.g., a different signal "tuned" for each anticipated or acceptable coin type. It is believed this approach may provide relatively high accuracy but may involve additional cost compared to providing a reduced number of signals.

Figure 30:
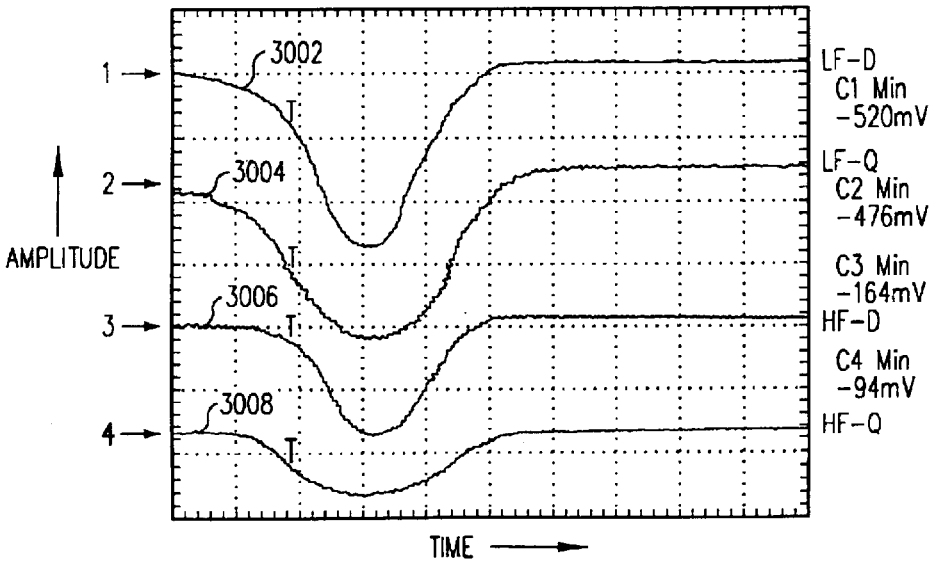
FIG. 30 is a graph of an example of sensor signals according to an embodiment of the present invention.

Returning to the configuration of FIGS. 29A–29B, as a coin passes through the transducer 58, the amplitude of the PLL error voltage 2909*a,b* (sometimes referred to herein as a "D" signal) and the amplitude of the PLL sinusoidal oscillator signal (sometimes referred to as a "Q" signal) decrease. The PLL error voltage is filtered and conditioned for conversion to digital data. The oscillator signal is filtered, demodulated, then conditioned for conversion to digital data. Since these signals are generated by two PLL circuits (high and low frequency), four signals result as the "signature" for identifying coins. Two of the signals (LF-D, LF-Q) are indicative of low-frequency, coin characteristics, and the remaining two signals (HF-D, HF-Q) are indicative of high-frequency coin characteristics. FIG. 30 shows a four channel oscilloscope plot of the change in the four signals (LF-D 3002, LF-Q 3004, HF-D 3006, and HF-Q 3008) as a coin passes the sensor. Information about the coin is represented in the shape, timing and amplitude of the signal changes in the four signals. The Control PCBA, which receives a digitized data representation of these signals, performs a discrimination algorithm to categorize a coin and determine its speed through the transducer, as described below.

The coin sensor phase locked loop, according to one embodiment, consists of a voltage controlled oscillator, a phase comparator, amplifier/filter for the phase comparator output, and a reference clock. The two PLL's operate at 200 KHz and 2.0 MHZ, with their reference clocks synchronized. The phase relationship between the two clock signals 3101*a, b* is maintained by using a divided-down clock rather than two independent clock sources 3102. The 2 MHZ clock output 3101*a* is also used as the master clock for the A/D converter 2906.

As a coin passes through the transducer's slot, there is a change in the magnetic circuit's reluctance. This is seen by circuitry as a decrease in the inductance value and results in a corresponding decrease in the amplitude of the PLL error voltage, providing a first coin-identifying factor. The passing coin also causes a decrease in the amplitude of the sinusoidal oscillator waveform, depending on its composition, e.g. due to an eddy current loss, and this is measured to provide a second coin-identifying factor.

The topology of the oscillators 2902*a, b* relies on a 180 degree phase shift for feedback to its drive circuitry and is classified as a Colpitts oscillator. The Colpitts oscillator is a symmetric topology and allows the oscillator to be isolated from ground. Drive for the oscillator is provided by a high speed comparator 3104*a, b*. The comparator has a fast propagation to minimize distortion due to phase delay, low input current to minimize loss, and remains stable while operating in its linear region. In the depicted embodiment, the plus and minus terminals of the inductors go directly to a high-speed comparator which autobiases the comparator so that signals convert quickly and are less susceptible to oscillation and so that there is no need to bias the comparator to a central voltage level. By tying the plus and minus terminals of the inductor to the plus and minus terminals of the comparator, the crossing of the terminals' voltage at any arbitrary point in the voltage spectrum will cause a switch in the comparator output voltage so that it is autobiasing. This achieves a more nearly even (50%) duty cycle.

The output of the comparator drives the oscillator through resistors 3106*a, b*. The amplitude of the oscillating signal varies and is correlated to the change in "Q" of the tuned circuit. Without wishing to be bound by any theory, this change is believed to be due to change in eddy current when a coin passes through the transducer gap. Resistors 3108*a, b, c, d* work with the input capacitance of the comparator 3104*a, b* to provide filtering of unwanted high frequency signal components.

Voltage control of the oscillator frequency is provided by way of the varactors 3112*a, b, c, d,* which act as voltage controlled capacitors (or tuning diodes). These varactors change the capacitive components of the oscillator. Use of two varactors maintains balanced capacitance on each leg of windings 2804, 2806. It is also possible to provide for tuning without using varactors such as by using variable inductance. As the reverse diode voltage increases, capacitance decreases. Thus by changing the Voltage Controlled Oscillator (VCO) input voltage in accordance with the change in inductance due to the presence of a coin, the frequency of oscillation can be maintained. This VCO input voltage is the signal used to indicate change of inductance in this circuit.

The phase/frequency detector 3114*a, b* performs certain control functions in this circuit. It compares the output frequency of the comparator 3104*a, b* to a synchronized reference clock signal and has an output that varies as the two signals diverge. The output stage of the device amplifies and filters this phase comparator output signal. This amplified and filtered output provides the VCO control signal used to indicate change of inductance in this circuit.

In addition, the depicted device has an output 3116*a, b* which, when appropriately conditioned, can be used to determine whether the PLL is "in lock". In one embodiment, a lock-fail signal is sent to the microprocessor on the Control PCBA as an error indication, and an LED is provided to indicate when both high and low frequency PLL are in a locked state.

Because the sensor 58 receives excitation at two frequencies through two coils wrapped on the same ferrite core, there is a potential for the coupling of signals which may result in undesired amplitude modulation on the individual signals that are being monitored. Filters 2912*a, b* remove the undesired spectral component while maintaining the desired signal, prior to amplitude measurement. In this way, the measured amplitude of each signal is not influenced by an independent change in the amplitude of the other oscillator circuit signals.

The filtered output signals are level-shifted to center them at 3.0 VDC in order to control the measurement of the signal amplitude by downstream circuitry.

In the depicted embodiment, the active highpass and lowpass filters are implemented as Sallen-Key Butterworth two-pole filter circuits 2916*a, b*. DC offset adjustment of the output signals is accomplished by using a buffered voltage divider as a reference. Input buffers 2914*a, b* are provided to minimize losses of the oscillator circuit by maintaining a high input impedance to the filter stage.

The lowpass filter 2916*a* is designed to provide more than 30 dB of attenuation at 2 MHZ while maintaining integrity of the 200 KHz signal, with less that 0.5 dB of loss at that frequency. The cutoff frequency is 355 KHz. Highpass filtering of the output from the lowpass filter is provided 2918*a* with a cutoff frequency of 20 KHz. Tying to a DC reference 2922*a* provides an adjusted output that centers the 200 KHz signal at 3.0 VDC, This output offset adjustment is desired for subsequent amplitude measurement.

The highpass filter 2916*b* is designed to provide more than 30 dB of attenuation at 200 KHz while maintaining integrity of the 2.0 MHZ signal, with less that 0.5 dB of loss at that frequency. The cutoff frequency is 1.125 MHz.

Amplitude measurement of the sinusoidal oscillator waveform is accomplished by demodulating the signal with a negative peak detecting circuit, and measuring the difference between this value and the DC reference voltage at which the sinusoidal signal is centered. This comparison measurement is then scaled to utilize a significant portion of the A/D converter's input range. The input to the circuit is a filtered sinusoidal signal centered at a known DC reference voltage output of the highpass or lowpass active filter.

The input signal is demodulated by a closed-loop diode peak detector circuit. The time constant of the network, e.g. 20 msec, is long compared to the period of the sinusoidal input, but short when compared to the time elapsed as a coin passes through the sensor. This relationship allows the peak detector to react quickly to a change in amplitude caused by a coin event. The circuit is implemented as a negative peak detector rather than a positive peak detector because the comparator is more predictable in its ability to drive the signal to ground than to drive it high. Comparators 3126*a, b,* such as model LT1016CS8, available from Linear Technology, provide a high slew rate and maintain stability while in the linear region. The analog closed-loop peak detector avoids the potential phase error problems that filter-stage phase lag and dynamic PLL phase shifts might create for a sample-and-hold implementation, and eliminates the need for a sampling clock.

The negative peak detector output is compared to the DC reference voltage, then scaled and filtered, by using an op amp 3124*a, b* implemented as a difference amplifier. The difference amp is configured to subtract the negative peak from the DC reference and multiply the difference by a scaling factor. In one embodiment, for the low frequency channel, the scaling factor is 4.02, and the high frequency channel scales the output by 5.11. The output of the difference amplifier has a lowpass filter on the feedback with a corner frequency at approximately 160 Hz. In the depicted embodiment, there is a snubber at the output to filer high frequency transients caused by switching in the A/D converter.

The error voltage measurement, scaling, and filtering circuit 3128*a, b* is designed to subtract 3.0 VDC from the PLL error voltage and amplify the resulting difference by a factor of 1.4. The PLL error voltage input signal will be in the 3.0–6.0 VDC range, and in order to maximize the use of the A/D converter's input range, the offset voltage is subtracted and the signal is amplified.

The input signal is pre-filtered with a lowpass corner frequency of 174 Hz, and the output is filtered in the feedback loop, with a cut-off frequency 340 Hz. A filter at the output filters high frequency transients caused by switching in the A/D converter.

In an interface circuit, 2922 data and control signals are pulled up and pass through series termination resistors. In addition, the data signals DATA–DATA15 are buffered by bi-directional registers. These bidirectional buffers isolate the A/D converter from direct connection to the data bus and associated interconnect cabling.

The A/D converter 2906 is a single supply, 8-channel, 12-bit sampling converter (such as model AD7859AP available from Analog Devices). The A/D transactions are directly controlled by the microprocessor on the Control PCBA.

Figure 32:
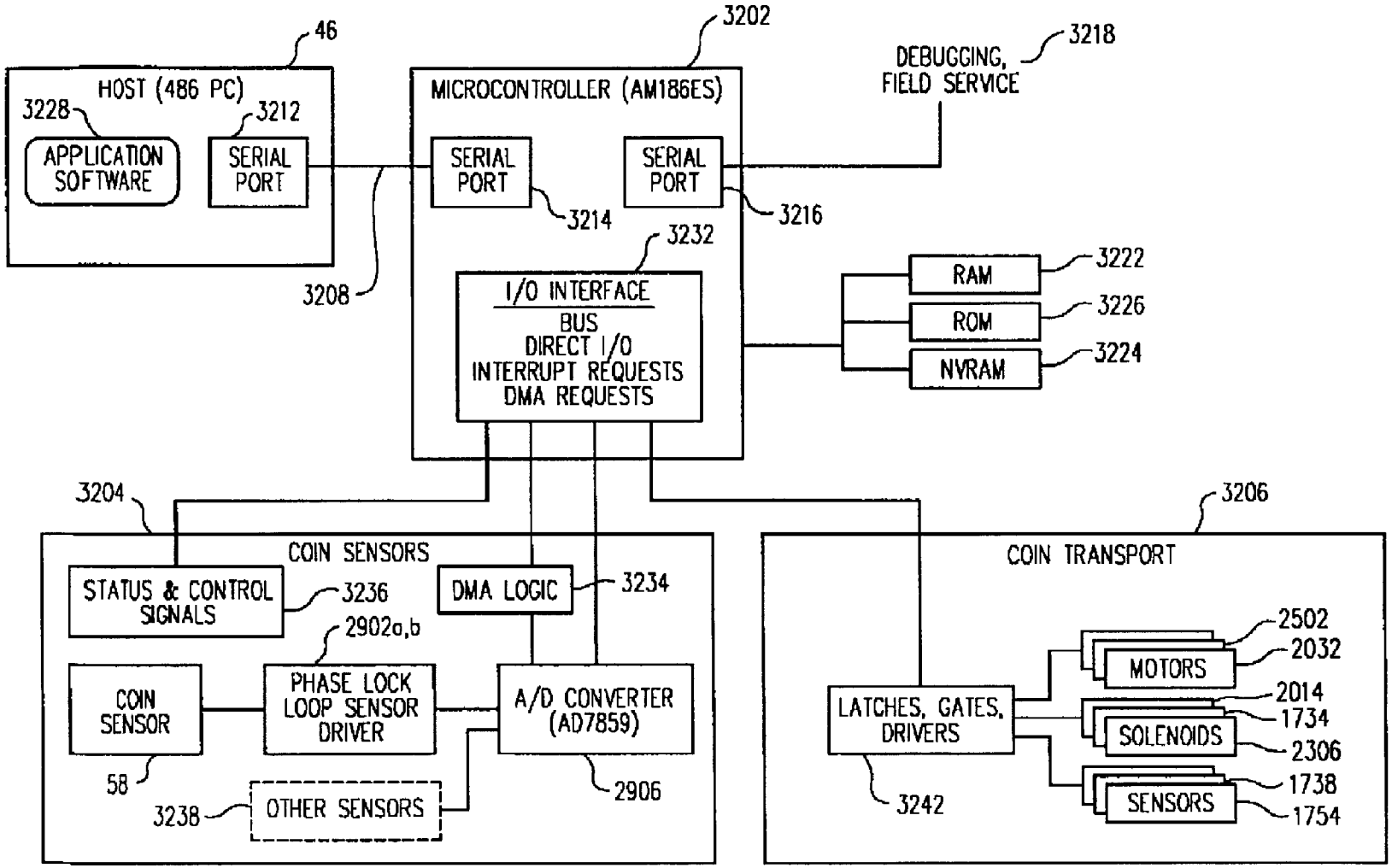
FIG. 32 is a block diagram of hardware for a coin discrimination device, according to an embodiment of the present invention.

An overview of control provided for various hardware components is depicted in FIG. 32. In FIG. 32, the control hardware is generally divided into the coin sensor hardware 3204 and the coin transport hardware 3206. A number of aspects of hardware 3204, 3206 are controlled via a microcontroller 3202 which may be any of a number of microcontrollers. In one embodiment, Model AM186ES, available from Advanced Micro Devices, is provided.

The microcontroller 3202 communicates with and is, to some degree, controlled by, the host computer 46. The host computer 46 can be any of a number of computers. In one embodiment, computer 46 is a computer employing an Intel 486 or Pentium® processor or equivalent. The host computer 46 and microcontroller 3202 communicate over serial line 3208 via respective serial ports 3212, 3214. The microcontroller 3202, in the depicted embodiment, has a second serial port 3216 which may be used for purposes such as debugging, field service 3218 and the like.

During normal operation, programming and data for the microcontroller are stored in memory which may include normal random access memory (RAM) 3222, non-volatile random access memory such as flash memory, static memory and the like 3224, and read-only memory 3226 which may include programmable and/or electronically erasable programmable read-only memory (EEPROM). In one embodiment, microprocessor firmware can be downloaded from a remote location via the host computer.

Applications software 3228 for controlling operation of the host computer 46 may be stored in, e.g., hard disk memory, nonvolatile RAM memory and the like.

Although a number of items are described as being implemented in software, in general it is also possible to provide a hardware implementation such as by using hard wired control logic and/or an application specific integrated circuit (ASIC).

An input/output (I/O) interface on the microcontroller 3232 facilitates communication such as bus communication, direct I/O, interrupt requests and/or direct memory access (DMA) requests. Since, as described more thoroughly below, DMA is used for much of the sensor communications, the coin sensor circuitry includes DMA logic circuitry 3234 as well as circuitry for status and control signals 3236. Although, in the described embodiment, only a single sensor is provided for coin sensing, it is possible to configure an operable device having additional sensors 3238.

In addition to the motors 2502, 2032, solenoids 2014, 1734, 2306 and sensors 1738, 1754 described above in connection with coin transport, controlling latches, gates and drivers of a type that will be understood by those of skill in the art, after understanding the present invention, are provided 3242.

Figure 33:
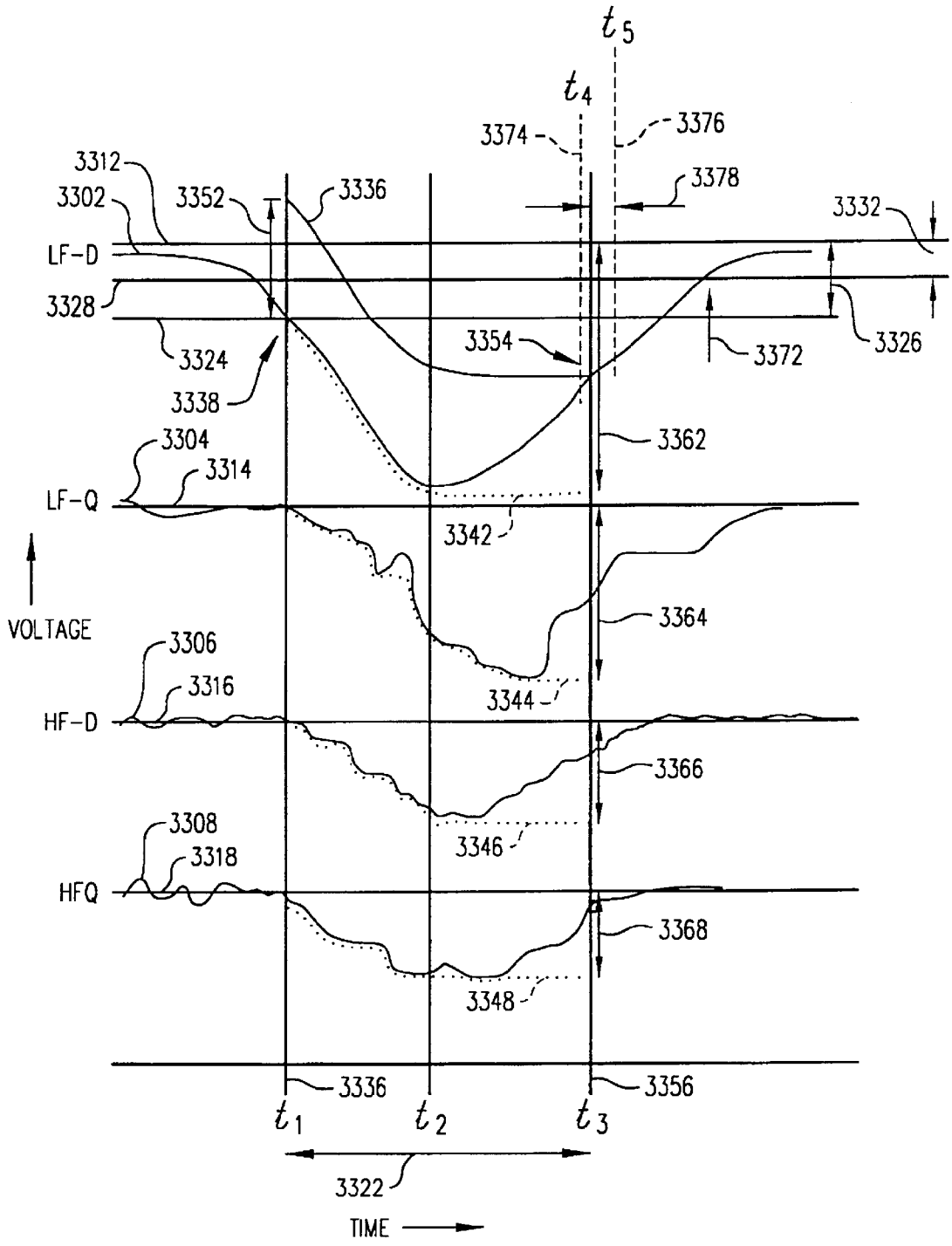
FIG. 33 is a graph of a hypothetical example of sensor signals, according to an embodiment of the present invention.

A method for deriving, from the four sensor signals (FIG. 30) a set of values or a "signature" indicative of a coin which has passed the sensor, is described in connection with the graphs of FIG. 33 which show a hypothetical example of the four signals LFD 3302, LFQ 3304, HFD 3306 and HFQ 3308 during a period of time in which a coin passes through the arms of the sensor. Units of FIG. 33 are arbitrary since FIG. 33 is used to illustrate the principles behind this embodiment. A baseline value 3312, 3314, 3316, 3318 is associated with each of the sensor signals, representing a value equal to the average or mean value for that signal when no coins are adjacent the sensor. Although, in the depicted embodiment, the LFD signal is used to define a window of time 3322 during which the minimum values for each of the four signals 3302, 3304, 3306, 3308 will be determined and other threshold-crossing events, (at least in part because this signal typically has the sharpest peak), it would be possible to use other signals to define any or all of the various crossing events, or it may be possible to define the window separately for each signal.

In the depicted embodiment, the base line value 3312 associated with the LFD signal 3302 is used to define a descent threshold 3324 (equal to the LFD baseline 3312 minus a predefined descent offset 3326, and a predefined gap threshold 3328 equal to the LFD baseline 3312 minus a gap offset 3332).

In one embodiment, the system will remain in an idle loop 3402 (FIG. 34) until the system is placed in a ready status (as described below) 3404. Once the system is in ready status, it is ready to respond to passage of a coin past the sensor.

In the depicted embodiment, the beginning of a coin passage past the sensor is signaled by the LFD signal 3302 becoming less 4212 than the descent threshold 3324 (3406) which, in the embodiment of FIG. 33, occurs at time $t_1$ 3336. When this event occurs 3338, a number of values are initialized or stored 3408. The status is set to a value indicating that the window 3322 is open 4214. Both the "peak" time value and the "lead" time value are set equal to the clock value, i.e., equal to $t_1$ 3336. Four variables LFDMIN 3342, LFQMIN 3344, HFDMIN 3346 and HFQMIN 3348, are used to hold a value indicating the minimum signal values, for each of the signals 3302, 3304, 3306, 3308, thus-far achieved during the window 3322 and thus are initialized at the $T_1$ values for each of the variables 3302, 3304, 3306, 3308. In the illustration of FIG. 33, the running minimum values 3342, 3344, 3346, 3348 are depicted as dotted lines, slightly offset vertically downward for clarity.

During the time that the window is open 3322, the minimum-holding variables LFDMIN, LFQMIN, HFDMIN and HFQMIN will be updated, as needed, to reflect the minimum value thus-far achieved. In the depicted embodiment, the four values are updated serially and cyclically, once every clock signal. Updating of values can be distributed in a different fashion if it is desired, for example, to provide greater time resolution for some variables than for others. It is believed that, by over sampling specific channels, recognition and accuracy can be improved. As the LFD value is being tested and, if necessary, updated, a value for an ascent threshold 3336 (which will be used to define the end of the window 3322, as described below) is calculated or updated 3414. The value for the ascent threshold 3336 is calculated or updated as a value equal to the current value for LFDMIN 3342 plus a predefined ascent hysteresis 3352.

Whenever the LFDMIN value 3342 must be updated (i.e., when the value of LFD descends below the previously-stored minimum value 3412), the "peak" time value is also updated by being made equal to the current clock value. In this way, at the end 4226 of the window 3322, the "peak" variable will hold a value indicating the time at which LFD 3302 reached its minimum value within the window 3322.

As a coin passes through the arms of a sensor, the four signal values 3302, 3304, 3306, 3308 will, in general, reach a minimum value and then begin once more to ascend toward the baseline value 3312, 3314, 3316, 3318. In the depicted embodiment, the window 3322 is declared "closed" when the LFD value 3302 raises to a point that it equals the current value for the ascent value threshold 3336. In the illustration of FIG. 33, this event 3354 occurs at time T3 3356. Upon detection 3418 of this event, the current value for the clock (i.e., the value indicating time T3) is stored in the "trail" variable. Thus, at this point, three times have been stored in three variables: "lead" holds a value indicating time $T_1$, i.e., the time at which the window was opened; "peak" holds a value indicating time T2, i.e., the minimum value for variable LFD 3302; and variable "trail" holds a value indicating time T3, i.e., the time when the window 3322 was closed.

The other portion of the signature for the coin which was just detected (in addition to the three time variables) are values indicating the minimum achieved, within the window 3332, for each of the variables 3302, 3304, 3306, 3308. These values are calculated 3422 by subtracting the minimum values at time T3 3342, 3344 3346, 3348 from the respective baseline values 3312, 3314, 3316, 3318 to yield four difference or delta values, ΔLFD 3362, ΔLFQ 3364, ΔHFD 3366 and ΔHFQ 3368. Providing output which is relative to the baseline value for each signal is useful in avoiding sensitivity to temperature changes.

Although, at time $t_3$ 3356, all the values required for the coin signature have been obtained, in the depicted embodiment, the system is not yet placed in a "ready" state. This is because it is desired to assure that there is at least a minimum gap between the coin which was just detected and any following coin. It is also desirable to maintain at least a minimum distance or gap from any preceding coin. In general, it is believed useful to provide at least some spacing between coins for accurate sensor reading, since coins which are touching can result in eddy current passing between coins. Maintaining a minimum gap as coins move toward the door 62 is useful in making sure that door 62 will strike the coin at the desired time and location. Striking too soon or too late may result in deflecting an accepted coin other than into the acceptance bin, degrading system accuracy.

Information gathered by the sensor 58 may also be used in connection with assuring the existence of a preferred minimum gap between coins. In this way, if coins are too closely spaced, one or more coins which might otherwise be an accepted coin, will not be deflected (and will not be "counted" as an accepted coin). Similarly, in one embodiment, a coin having an acceleration less than a threshold (such as less than half a maximum acceleration) will not be accepted.

Accordingly, in order to assure an adequate leading gap, the system is not placed in a "ready" state until the LFD signal 3302 has reached a value equal to the gap threshold 3328. After the system verifies 3424 that this event 3372 has occurred, the status is set equal to "ready" 3326 and the system returns to an idle state 3401 to await passage of the next coin.

To provide for a minimum preferred trailing gap, in one embodiment, the software monitors the LFD signal 3302 for a short time after the ascending hysteresis criterion has been satisfied 4236. If the signal has moved sufficiently back towards the baseline 3312 (measured either with respect to the baseline or with respect to the peak) after a predetermined time period, then an adequate trailing gap exists and the door, if the coin is an accepted coin, will be actuated 4244. If the trailing gap is not achieved, the actuation pulse is canceled 4244, and normally the coin will be returned to the user. In all cases, software thresholds are preferably calibrated using the smallest coins (e.g., a U.S. dime in the case of a U.S. coin mix).

Because the occurrence of events such as the crossing of thresholds 3338, 3354, 3372 are only tested at discrete time intervals 3411*a,* 3411*b,* 3411*c,* 3411*d,* in most cases the event will not be detected until some time after it has occurred. For example, it may happen that, with regard to the ascent-crossing event 3354, the previous event-test at time T4 3374 occurs before the crossing event 3354 and the next event-test occurs at time T5, a period of time 3378 after the crossing event 3354. Accordingly, in one embodiment, once a test determines that a crossing event has occurred, interpolation such as linear interpolation, spline-fit interpolation or the like, is used to provide a more accurate estimate of the actual time of the event 3354.

As noted above, by time $t_3$ 3356, all the values required for the coin signature have been obtained. Also, by time $t_3$, the information which can be used for calculating the time at which the door 62 should be activated (assuming the coin is identified as an accepted coin) is available. Because the distance from the sensor to the door is constant and known, the amount of time required for a coin to travel to the preferred position with respect to the door can be calculated exactly if the acceleration of the coin along the rail is known(and constant) and a velocity, such as the velocity at the sensor is known. According to one method, acceleration is calculated by comparing the velocity of the coin as it moves past the sensor 58 with the velocity of the coin as it passes over the "knee" in the transition region 2121C. In one embodiment, the initial "knee" velocity is assumed to be a single value for all coins, in one case, 0.5 meters/second. Knowing the velocity at two locations (the knee 2121C and the sensor location 58) and knowing the distance from the knee 2121C to the sensor location 58, the acceleration experienced by the coin can be calculated. Based on this calculated acceleration, it is then possible to calculate how long it will be, continuing at that acceleration, before the coin is positioned at the preferred location over the actuator. This system essentially operates on a principle of assuming an initial velocity and using measurements of the sensor to ultimately calculate how friction (or other factors such as surface tension) affects the acceleration being experienced by each coin. Another approach might be used in which an effective friction was assumed as a constant value and the data gathered at the sensor was used to calculate the initial ("knee") velocity.

In any case, the calculation of the time when the coin will reach the preferred position can be expected to have some amount of error (i.e., difference between calculated position and actual position at the door activation time). The error can arise from a number of factors including departures from the assumption regarding the knee velocity, non-constant values for friction along the rail, and the like. In one embodiment it has been found that, using the described procedure, and for the depicted and described design, the worst-case error occurs with the smallest coin (e.g., amount 17.5 mm in diameter) and amounts to approximately 6 mm in either direction. It is believed that, in at least some environments, an error window of 6 mm is tolerable (i.e., results in a relatively low rate of misdirecting coins or other objects).

In order to implement this procedure, data obtained at the sensor 58 is used to calculate a velocity. According to one scheme, time $t_1$ 3336 is taken as the time when the coin first enters the sensor and time $t_2$ (the "peak" time) is taken as the time when the coin is centered on the sensor, and thus has traveled a distance approximately equal to a coin radius. Because, once the coin has been recognized (e.g as described below in connection with FIGS. 36 and 37), the radius of the coin is known (e.g. using a look-up table), it is possible to calculate velocity as radius divided by the difference $(t_2-t_1)$.

Figure 34:
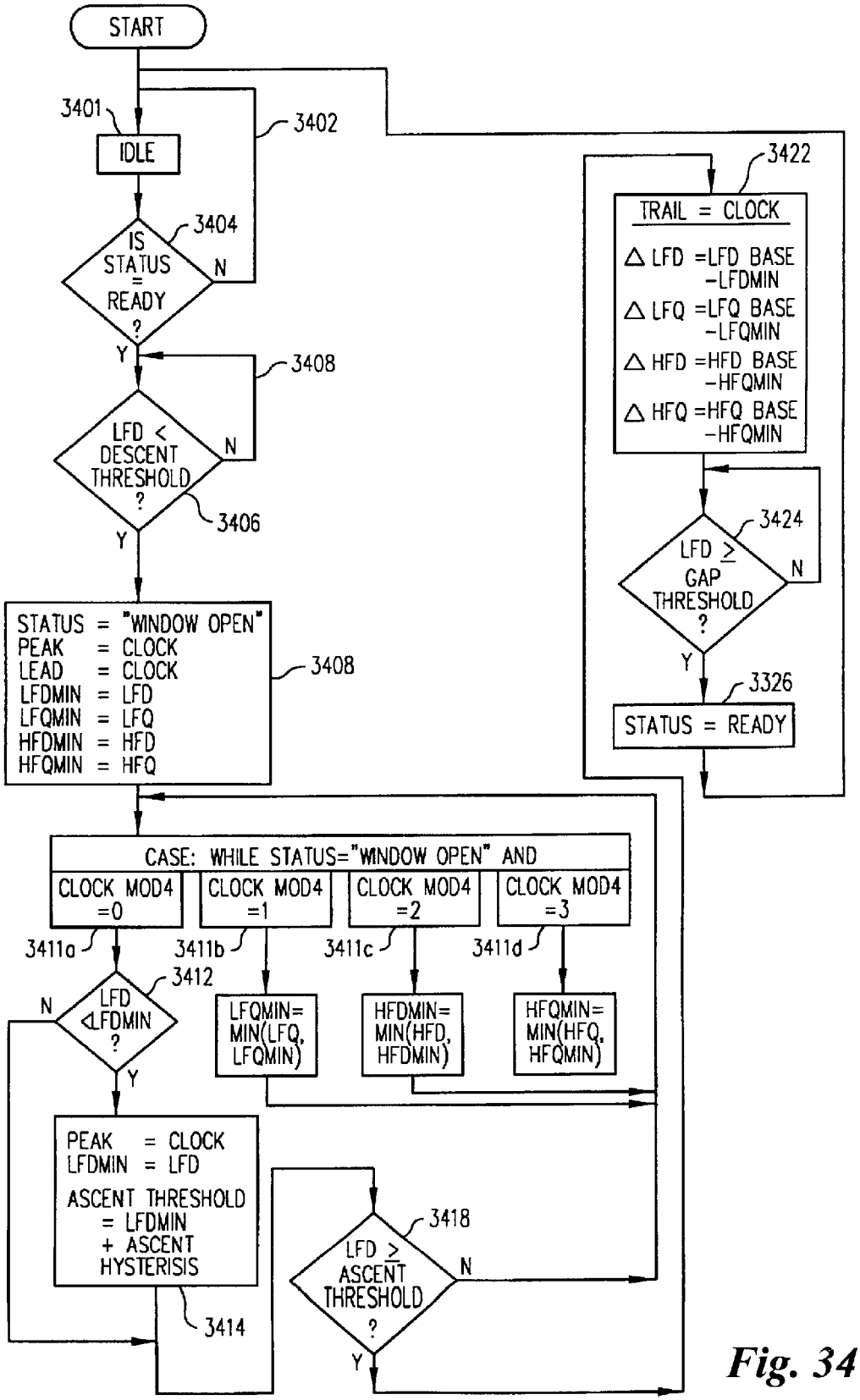
FIG. 34 is a flow chart of a coin signature calculation process, according to an embodiment of the present invention.
Figure 35A:
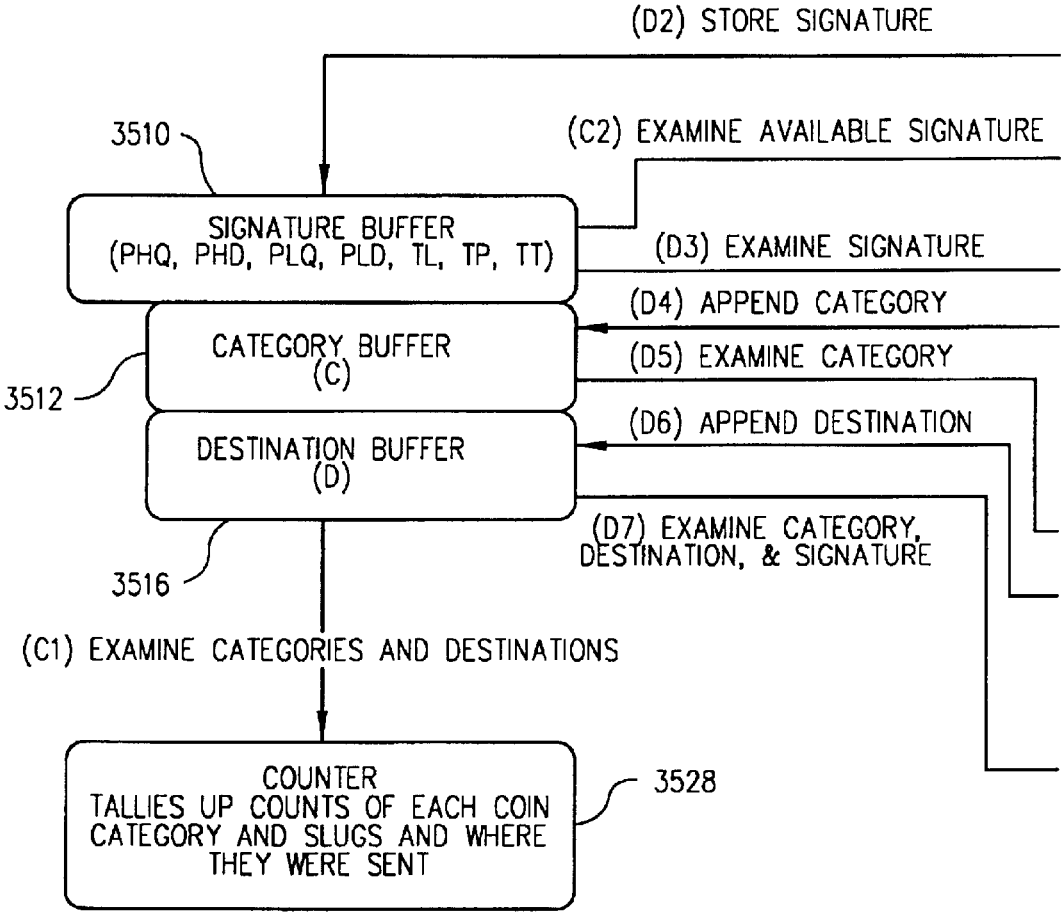
FIGS. 35A–35B are state diagrams for a coin discrimination process according to an embodiment of the present invention.
Figure 35B:
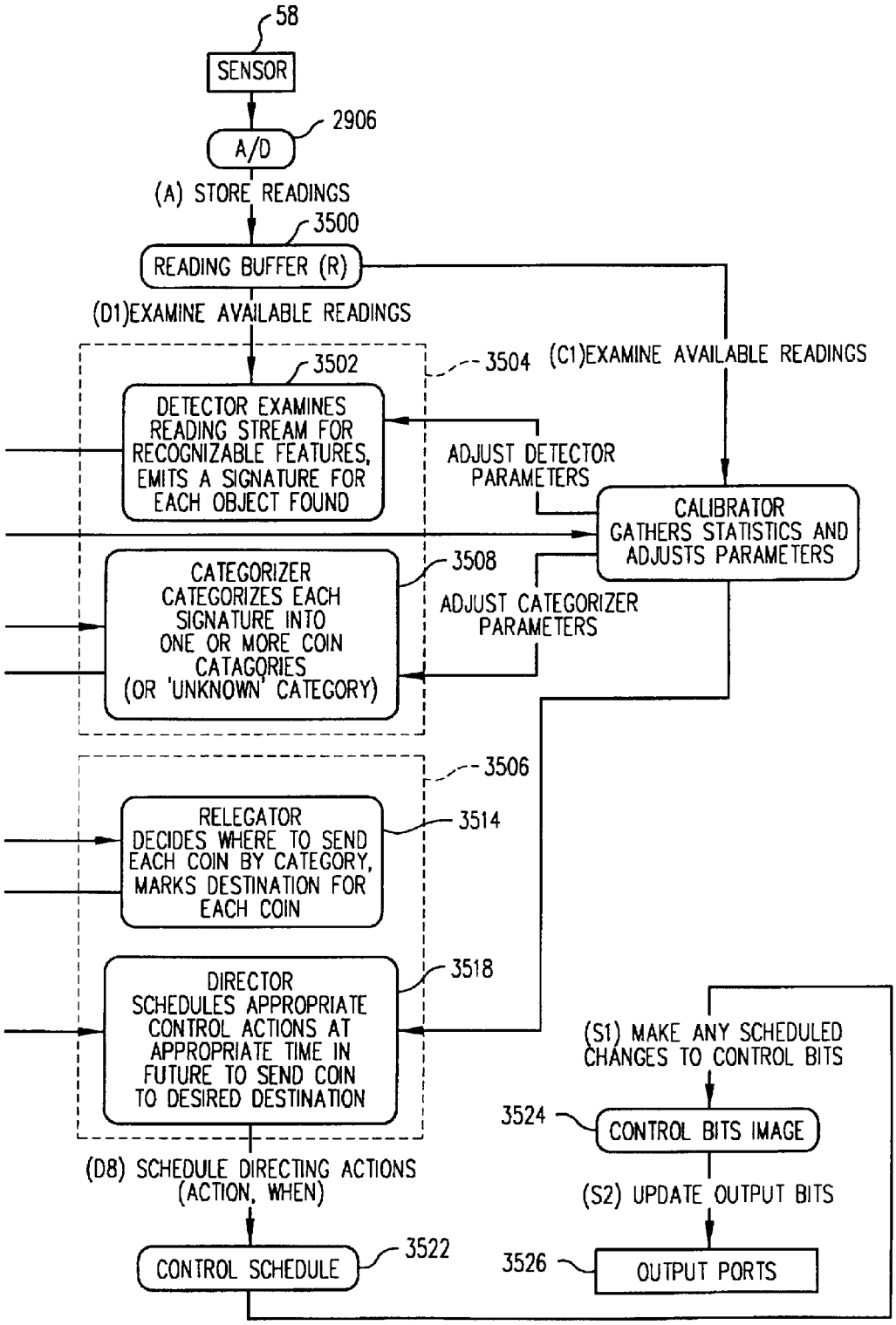

The procedure illustrated in FIGS. 33 and 34 is an example of one embodiment of a detection process 3502. As seen in FIG. 35, a number of processes, in addition to detection, should be performed between the time data is obtained by the sensor 58 and the time a coin reaches the door 62. In general, processes can be considered as being either recognition processes 3504 relating to identifying and locating objects which pass the sensor, and disposition processes 3506, relating to sending coins to desired destinations. Once the detection process has examined the stream of sensor readings and has generated signatures corresponding to the coin (or other object) passing the sensor, the signatures are passed 4228 to a categorization process 3508. This process examines the signatures received from the detection process 3502 and determines, if possible, what coin or object has passed the sensor. Referring to FIG. 32, the recognition and disposition processes 3504, 3506 are preferably performed by the microcontroller 3202.

Figure 36:
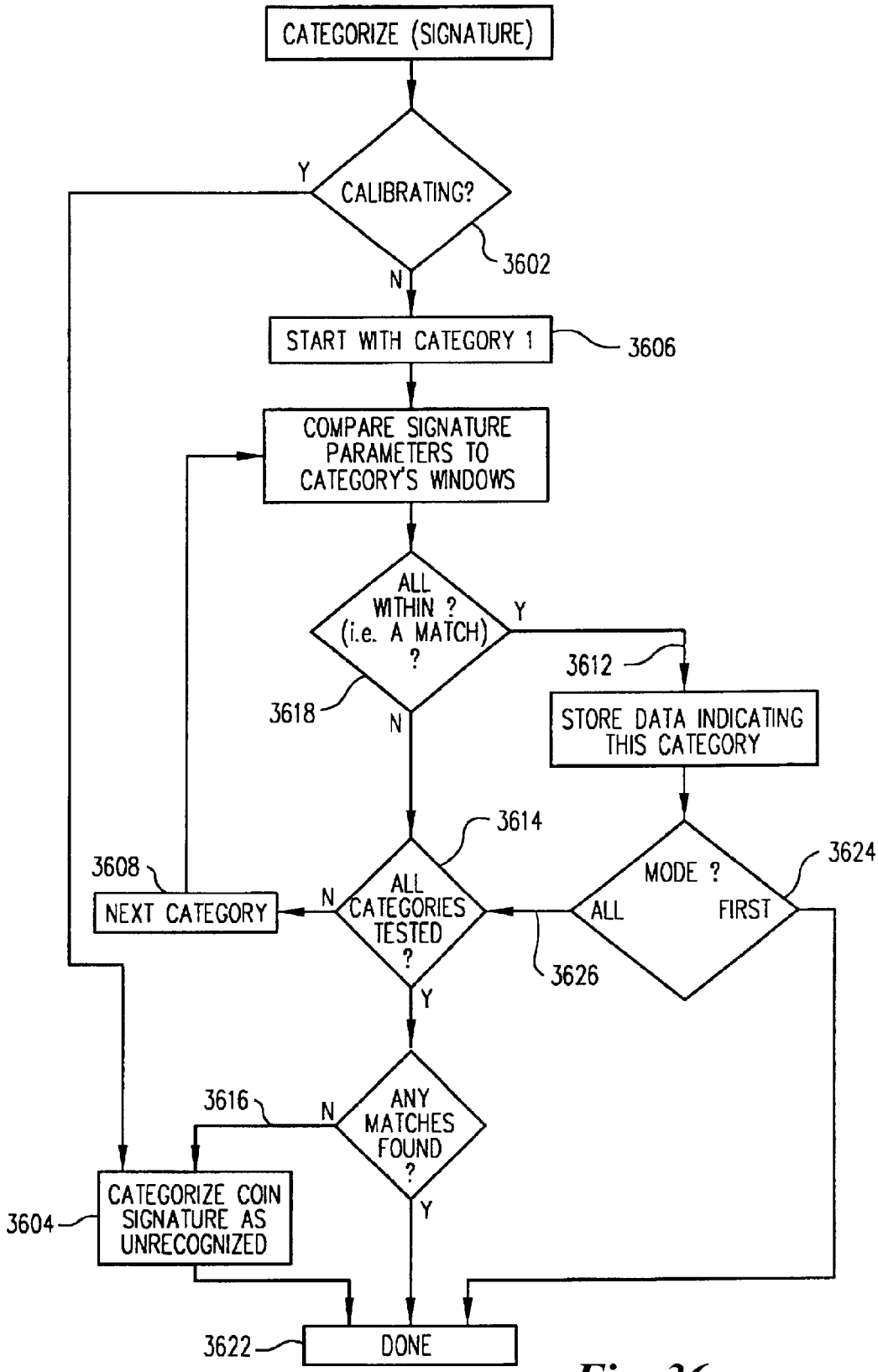
FIG. 36 is a state diagram for a categorization process according to an embodiment of the present invention.

FIG. 36 provides an illustration of one embodiment of a categorization process. As shown in FIG. 36, in one embodiment a calibration mode may be provided in which a plurality of known types of coins are placed in the machine and these coins are used to define maximum and minimum LFD, LFQ, HFD and HFQ values for that particular category or denomination of coin. In one embodiment, timing parameters are also established and stored during the calibration process. According to the embodiment of FIG. 36, if the system is undergoing calibration 3602, the system does not attempt to recognize or categorize the coins and, by convention, the coins used for calibration are categorized as "unrecognized" 3604.

Figure 37:
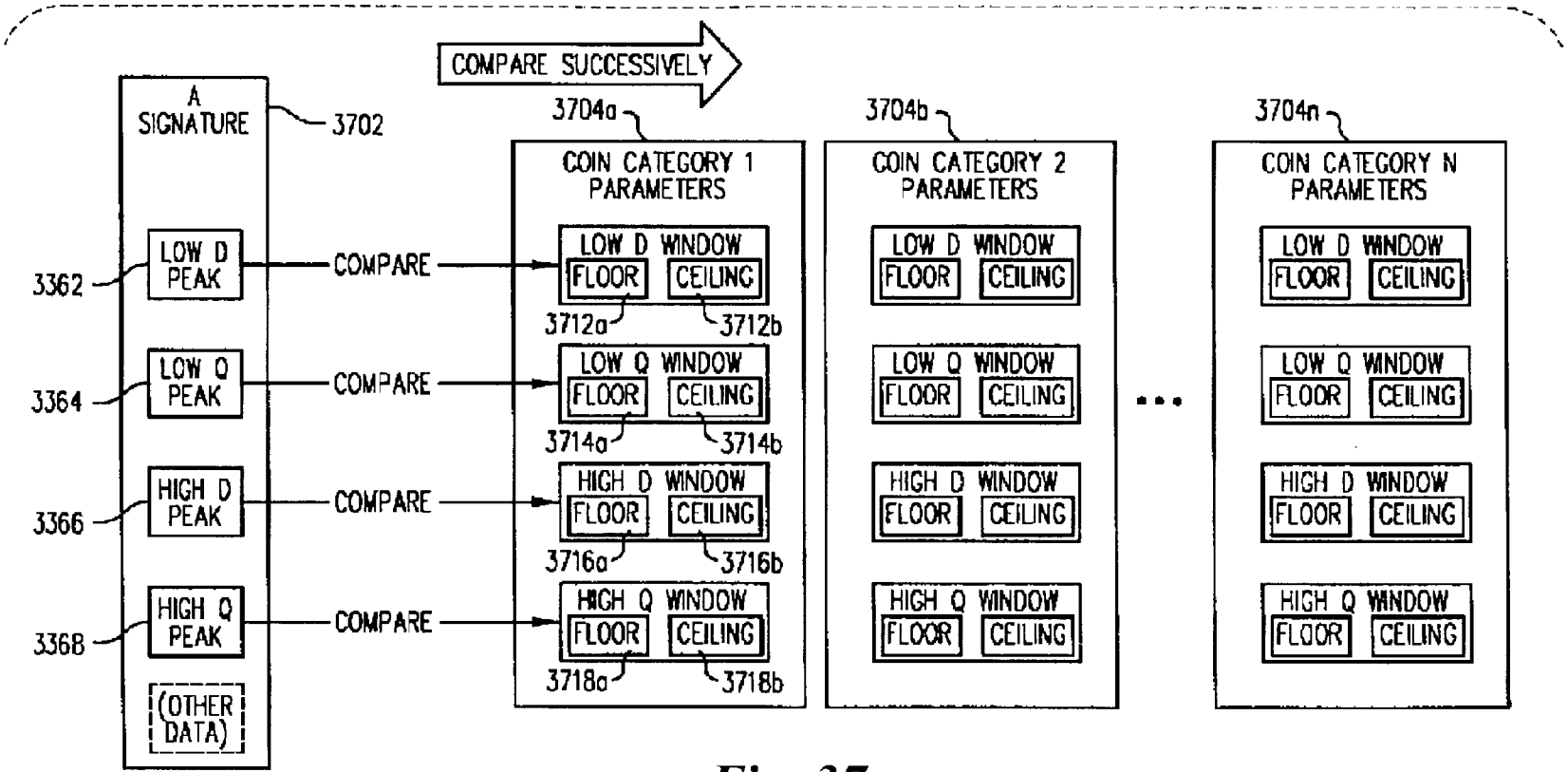
FIG. 37 is a block diagram for a categorization process according to an embodiment of the present invention.

As illustrated in FIG. 37, in one embodiment, a coin signature 3702 is used to categorize an object by performing a comparison for each of a number of different potential categories, starting with the first category 3606 and stepping to each next category 3608 until a match is found 3612 or all categories are exhausted 3614 without finding a match 3616, in which case the coin is categorized 4220 as unrecognized 3604. During each test for a match 3618, each of the four signal peaks 3362, 3364, 3366, 3368 is compared, (successively for each category 3704*a,* 3704*b,* 3704*n*) with minimum and maximum ("floor" and "ceiling") values defining a "window" for each signature component 3712*a,* 3712*b,* 3714*a, b,* 3716*a, b,* 3718*a, b.* A match is declared 3612 for a given category only if all four components of the signature 3362, 3364, 3366, and 3368 fall within the corresponding window for a particular category 3704*a, b, c, n.*

In the embodiment of FIG. 36, the system may be configured to end the categorization process 3622 whenever the first category 3624 resulting in a match has been found, or to continue 3626 until all n categories have been tested. In normal operation, the first mode 3624 will typically be used. It is believed the latter mode will be useful principally for research and development purposes.

The results of the categorization 3508 are stored in a category buffer 3512 and are provided to the relegator process 3514. The difference between categorization and relegation relates, in part, to the difference between a coin category and a coin denomination. Not all coins of a given denomination will have similar structure, and thus two coins of the same denomination may have substantially different signatures. For example, pennies minted before 1982 have a structure (copper core) substantially different from that of pennies minted after that date (zinc core). Some previous devices have attempted to define a coin discrimination based on coin denomination, which would thus require a device which recognizes two physically different types of penny as a single category.

According to one embodiment, coins or other objects are discriminated not necessarily on the basis of denomination but on the basis of coin categories (in which a single denomination may have two or more categories). Thus, according to one embodiment, pennies minted before 1982 and pennies minted after 1982 belong to two different coin categories 3704. This use of categories, based on physical characteristics of coins (or other objects), rather than attempting to define on the basis of denominations, is advantageous since it is believed that this approach leads to better discrimination accuracy. In particular, by defining separate categories e.g. for pre-1982 and post-1982 pennies, it becomes easier to discriminate all pennies from other objects, whereas if an attempt was made to define a single category embracing both types of pennies, it is believed that the recognition windows or thresholds would have to be so broadly defined that there would be a substantial risk of mis-discrimination. By providing a system in which coin categories rather than coin denominations are recognized, coin destinations may be easily configured and changed.

Furthermore, in addition to improving discrimination accuracy, the present invention provides an opportunity to count coins and sort coins or other objects on a basis other than denomination. For example, if desired, the device could be configured to place "real silver" coins in a separate coin bin so that the machine operator can benefit from their potentially greater value.

Once a relegator process 3514 receives information from a category buffer regarding the category of a coin (or other object), the relegator outputs a destination indicator, corresponding to that coin, to a destination buffer 3516. The data from the destination buffer is provided to a director process 3518 whose function is to provide appropriate control signals at the appropriate time in order to send the coin to a desired destination, e.g. to provide signals causing the deflector door to activate at the proper time if the coin is destined for an acceptance bin. In the embodiment of FIG. 25, the director procedure outputs information regarding the action to be taken and the time when it is to be taken to a control schedule process 3522 which generates a control bit image 3524 provided to microprocessor output ports 3526 for transmission to the coin transport hardware 3206.

In one embodiment, the solenoid is controlled in such a manner as to not only control the time at which the door is activated 4234, 4244 but also the amount of force to be used (such as the strength and/or duration of the solenoid activation Volts). In one embodiment, the amount of force is varied depending on the mass of the coin, which can be determined, e.g., from a look-up table, based on recognition of the coin category.

Preferably, information from the destination buffer 3516 is also provided to a counter 3528 which retains a tally of at least the number of coins of each denomination sent to the coin bins. If desired, a number of counters can be provided so that the system can keep track not only of each coin denomination, but of each coin category and/or, which coin bin the coin was destined for.

In general, the flow of data depicted in FIG. 35 represents a narrowing bandwidth in which a relatively large amount of data is provided from the A/D converter which is used by the detector 3502 to output a smaller amount of data (as the coin signature), ultimately resulting in a single counter increment 3528. According to one embodiment of the present invention, the system is configured to use the most rapid and efficient means of information transfer for those information or signal paths which have the greatest volume or bandwidth requirements. Accordingly, in one embodiment, a direct memory access (DMA) procedure is used in connection with transferring sensor data from the converter 2906 to the microcontroller reading buffer 3500.

Figure 38:
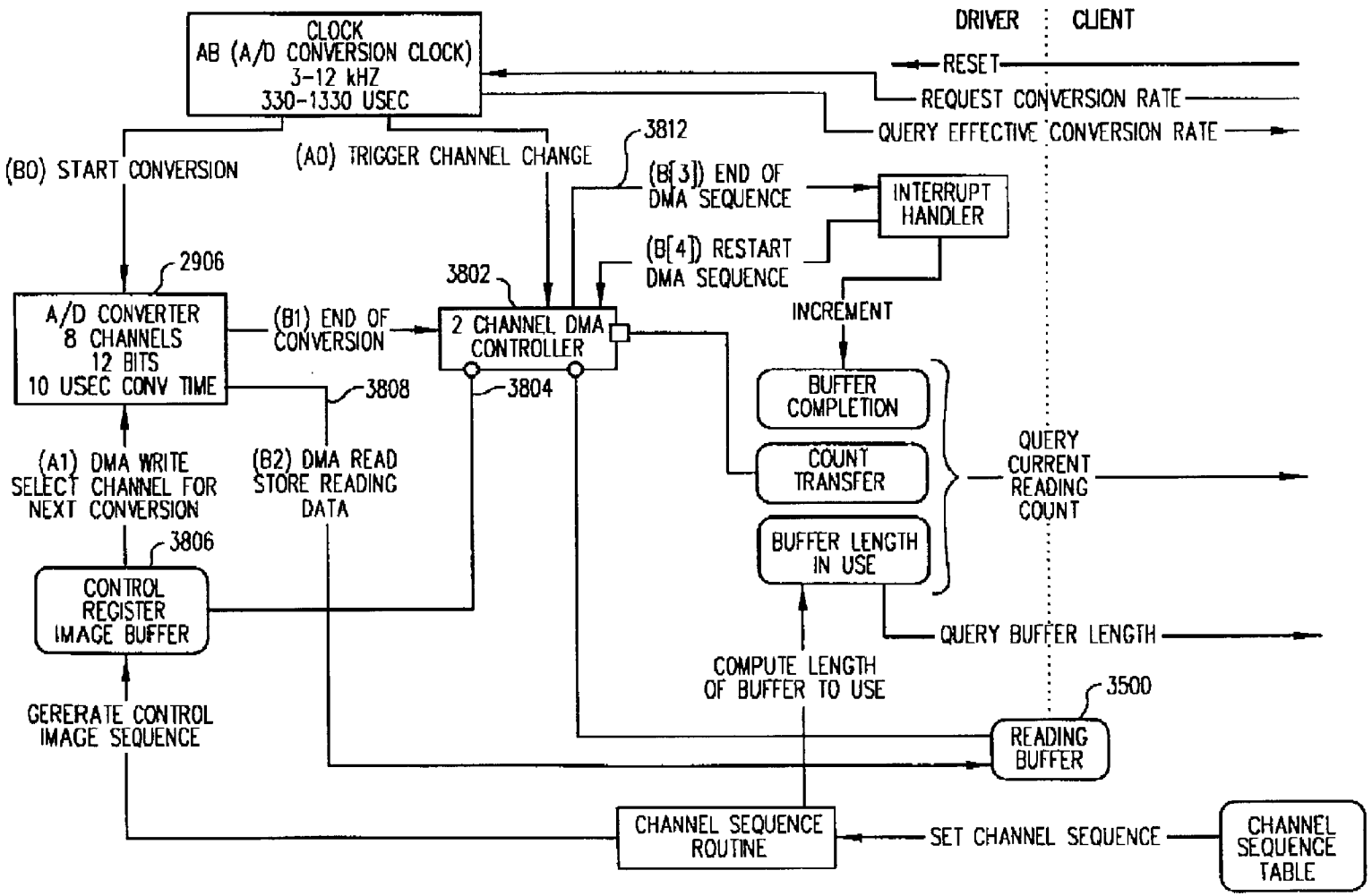
FIG. 38 is a state diagram of a Direct Memory Access process according to an embodiment of the present invention.

As depicted in FIG. 38, a two-channel DMA controller (providing channels DMA0 and DMA1) is used 3802. In the depicted embodiment, one of the DMA channels is used for uploading the program from one of the serial ports to memory. After this operation is completed, both DMA channels are used in implementing the DMA transfer. DMA0 is used to write controller data 3804 to the A-to-D converter 2906, via a control register image buffer 3806. This operation selects the analog channel for the next read, starts the conversion and sets up the next read for the A-to-D converter output data register. DMA1 then reads the output data register 3808. DMA0 will then write to the controller register 3806 and DMA1 will read the next analog channel and so forth.

In the preferred embodiment, the DMA interface does not limit the ability of the software to independently read or write to the A-to-D converter. It is possible, however, that writing to the control register of the A-to-D converter in the middle of a DMA transfer may cause the wrong channel to be read.

Preferably the DMA process takes advantage of the DMA channels to configure a multiple word table in memory with the desired A-to-D controller register data. Preferably the table length (number of words in the table) is configurable, permitting a balance to be struck between reducing microcontroller overhead (by using a longer table), and reducing memory requirements (by using a shorter table). The DMA process sets up DMA0 for writing these words to a fixed I/O address. Next, DMA1 is set up for reading the same number of words from the same I/O address to a data buffer in memory. DMA1 is preferably set up to interrupt the processor when all words have been read 3812. Preferably hardware DMA decoder logic controls the timing between DMA0 and DMA1.

Figure 39:
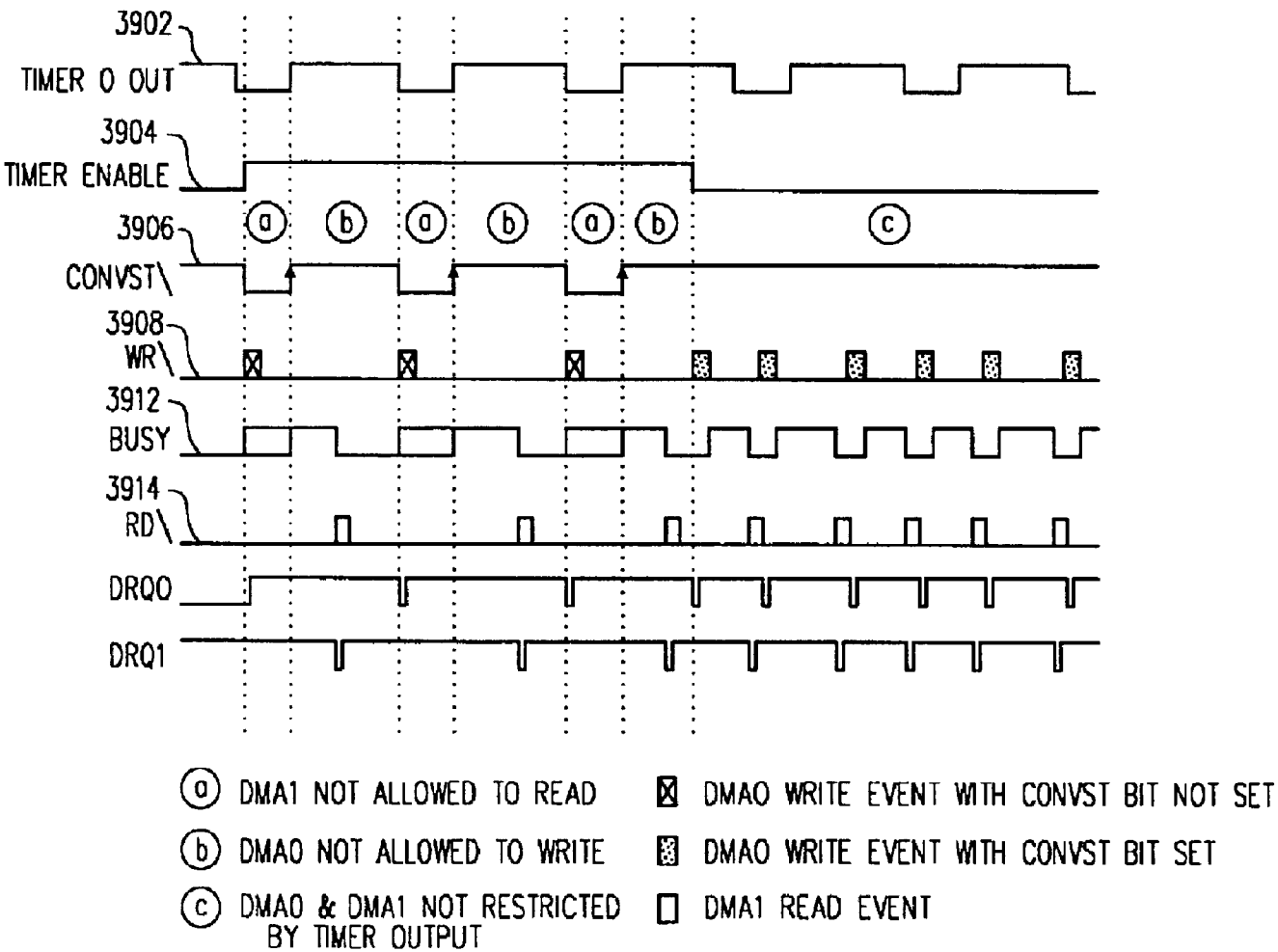
FIG. 39 is a timing diagram of a Direct Memory Access process according to an embodiment of the present invention.

FIG. 39 depicts timing for DMA transfer according to an embodiment of the present invention. In this embodiment, a PIO pin will be used to enable or disable the timer output 3902. If the timer enable signal 3904 is low, the hardware will block the timer output 3902 and conversions can only be started by setting the start conversion bit in the control register of the A-to-D converter 3906. If the timer enable signal 3904 is high, the A/D conversions start at the rising edge of the timer output 3902, and write cycles will be allowed only after the following edge of the timer output 3902 with read cycles only being allowed after the busy signal 3912 goes low while the timer output signal 3902 is high. The described design provides great flexibility with relatively small overhead. There is a single interrupt (DMA interrupt) event once the buffer is filled with data from the A-to-D converter are read and put into memory. Preferably, software can be configured to change the DMA configuration to read any or all analog channels, do multiple reads in some channels, read the channels in any order and the like. Preferably, the A-to-D converter is directly linked to the microprocessor by a 16-bit data bus. The microprocessor is able to read or write to the A-to-D converter bus interface port as a single input or output instruction to a fixed I/O address. Data flow between the A-to-D converter and the microprocessor is controlled by the busy 3912, chip select, read 3914 and write 3908 signals. A conversion clock 3902 and clock enable 3904 signals provide control and flexibility over the A-to-D conversion rate.

Figure 2A:
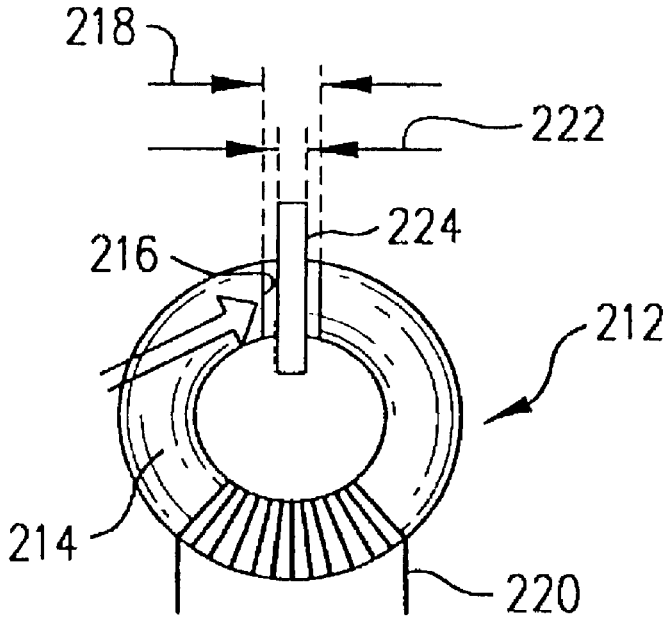
FIG. 2A is a front elevational view of a sensor and adjacent coin, according to an embodiment of the present invention.

Another embodiment of a gapped torroid sensor, and its use, is depicted in FIGS. 2A through 16B. As depicted in FIG. 2A, a sensor, 212 includes a core 214 having a generally curved shape and defining a gap 216, having a first width 218. In the depicted embodiment, the curved core is a torroidal section. Although "torroidal" includes a locus defined by rotating a circle about a non-intersecting coplanar line, as used herein, the term "torroidal" generally means a shape which is curved or otherwise non-linear. Examples include a ring shape, a U shape, a V shape or a polygon. In the depicted embodiment both the major cross section (of the shape as a whole) and the minor cross section (of the generating form) have a circular shape. However, other major and minor cross-sectional shapes can be used, including elliptical or oval shapes, partial ellipses, ovals or circles (such as a semi-circular shape), polygonal shapes (such as a regular or irregular hexagon/octagon, etc.), and the like.

The core 214 may be made from a number of materials provided that the material is capable of providing a substantial magnetic field in the gap 216. In one embodiment, the core 214 consists of, or includes, a ferrite material, such as formed by fusing ferric oxide with another material such as a carbonate hydroxide or alkaline metal chloride, a ceramic ferrite, and the like. If the core is driven by an alternating current, the material chosen for the core of the inductor, should be normal-loss or low-loss at the frequency of oscillation such that the "no-coin" Q of the LC circuit is substantially higher than the Q of the LC circuit with a coin adjacent the sensor. This ratio determines, in part, the signal-to-noise ratio for the coin's conductivity measurement. The lower the losses in the core and the winding, the greater the change in eddy current losses, when the coin is placed in or passes by the gap, and thus the greater the sensitivity of the device. In the depicted embodiment, a conductive wire 220 is wound about a portion of the core 214 so as to form an inductive device. Although FIG. 2A depicts a single coil, in some embodiments, two or more coils may be used, e.g. as described below. In the depicted embodiment, the coin or other object to be discriminated is positioned in the vicinity of the gap (in the depicted embodiment, within the gap 216). Thus, in the depicted embodiment the gap width 218 is somewhat larger than the thickness 222 of the thickest coin to be sensed by the sensor 212, to allow for mis-alignment, movement, deformity, or dirtiness of the coin. Preferably, the gap 216 is as small as possible, consistent with practical passage of the coin. In one embodiment, the gap is about 4 mm.

Figure 2B:
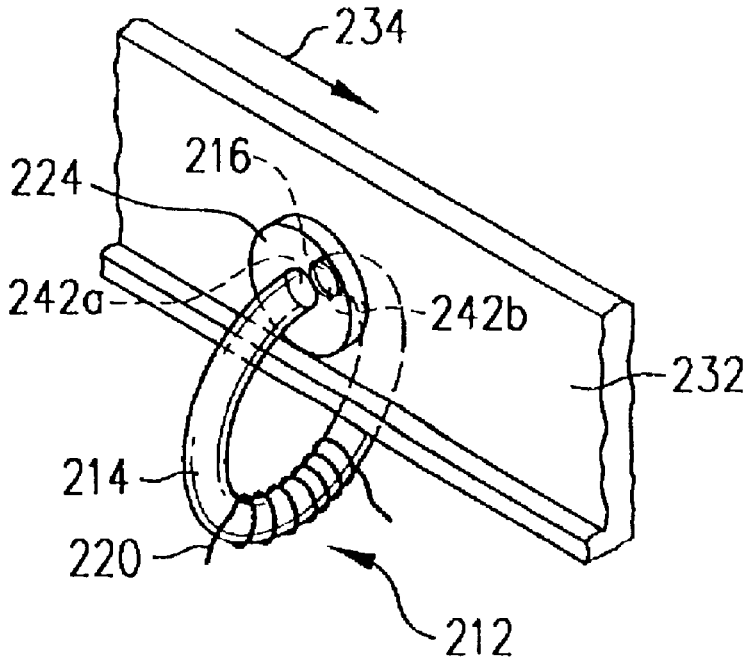
FIGS. 2B and 2C are perspective views of sensors and coin-transport rail according to embodiments of the present invention.

FIG. 2B depicts a sensor 212, positioned with respect to a coin conveying rail 232, such that, as the coin 224 moves down the rail 232, the rail guides the coin 224 through the gap 216 of the sensor 212. Although FIG. 2B depicts the coin 224 traveling in a vertical (on-edge) orientation, the device could be configured so that the coin 224 travels in other orientations, such as in a lateral (horizontal) configuration or angles therebetween. One of the advantages of the present invention is the ability to increase speed of coin movement (and thus throughput) since coin discrimination can be performed rapidly. This feature is particularly important in the present invention since coins which move very rapidly down a coin rail have a tendency to "fly" or move partially and/or momentarily away from the rail. The present invention can be configured such that the sensor is relatively insensitive to such departures from the expected or nominal coin position. Thus, the present invention contributes to the ability to achieve rapid coin movement not only by providing rapid coin discrimination but insensitivity to coin "flying." Although FIG. 2B depicts a configuration in which the coin 224 moves down the rail 232 in response to gravity, coin movement can be achieved by other unpowered or powered means such as a conveyor belt. Although passage of the coin through the gap 216 is depicted, in another embodiment the coin passes across, but not through the gap (e.g. as depicted with regard to the embodiment of FIG. 4).

FIG. 3 depicts a second configuration of a sensor, in which the gap 316, rather than being formed by opposed faces 242*a,* 242*b,* of the core 214 is, instead, formed between opposed edges of spaced-apart plates (or "pole pieces") 344*a,* 344*b,* which are coupled to the core 314. In this configuration, the core 314 is a half-torus. The plates 344*a,* 344*b,* may be coupled to a torroid in a number of fashions, such as by using an adhesive, cement or glue, a pressfit, spot welding, or brazing, riveting, screwing, and the like. Although the embodiment depicted in FIG. 3 shows the plates 344*a,* 344*b* attached to the torroid 314, it is also possible for the plates and torroid to be formed integrally. As seen in FIG. 4, the plates 344*a,* 344*b,* may have half-oval shapes, but a number of other shapes are possible, including semi-circular, square, rectangular, polygonal, and the like. In the embodiment of FIGS. 3 and 4, the field-concentrating effect of ferrite can be used to produce a very localized field for interaction with a coin, thus reducing or eliminating the effect of a touching neighbor coin. The embodiment of FIGS. 3 and 4 can also be configured to be relatively insensitive to the effects of coin "flying" and thus contribute to the ability to provide rapid coin movement and increase coin throughput. Although the percentage of the magnetic field which is affected by the presence of a coin will typically be less in the configuration of FIGS. 3 and 4, than in the configuration of FIG. 2, satisfactory results can be obtained if the field changes are sufficiently large to yield a consistently high signal-to-noise indication of coin parameters. Preferably the gap 316 is sufficiently small to produce the desired magnetic field intensity in or adjacent to the coin, in order to expose the coin to an intense field as it passes by and/or through the gap 316. In the embodiment of FIG. 4, the length of the gap 402 is large enough so that coins with different diameters cover different proportions of the gap.

The embodiment of FIGS. 3 and 4 is believed to be particularly useful in situations in which it is difficult or impossible to provide access to both faces of a coin at the same time. For example, if the coin is being conveyed on one of its faces rather than on an edge (e.g., being conveyed on a conveyor belt or a vacuum belt). Furthermore in the embodiment of FIGS. 3 and 4, the gap 316 does not need to be wide enough to accommodate the thickness of the coin and can be made quite narrow such that the magnetic field to which the coin is exposed is also relatively narrow. This configuration can be useful in avoiding an adjacent or "touching" coin situation since, even if coins are touching, the magnetic field to which the coins are exposed will be too narrow to substantially influence more than one coin at a time (during most of a coin's passage past the sensor).

When an electrical potential or voltage is applied to the coil 220, a magnetic field is created in the vicinity of the gap 216, 316 (i.e. created in and near the gap 216, 316). The interaction of the coin or other object with such a magnetic field (or lack thereof) yields data which provides information about parameters of the coin or object which can be used for discrimination, e.g. as described more thoroughly below.

In one embodiment, current in the form of a variable or alternating current (AC) is supplied to the coil 220. Although the form of the current may be substantially sinusoidal as used herein "AC" is meant to include any variable (non-constant) wave form, including ramp, sawtooth, square waves, and complex waves such as wave forms which are the sum or two or more sinusoidal waves. Because of the configuration of the sensor, and the positional relationship of the coin or object to the gap, the coin can be exposed to a significant magnetic field, which can be significantly affected by the presence of the coin. The sensor can be used to detect these changes in the electromagnetic field, as the coin passes over or through the gap, preferably in such as way as to provide data indicative of at least two different parameters of the coin or object. In one embodiment, a parameter such as the size or diameter of the coin or object is indicated by a change in inductance, due to the passage of the coin, and the conductivity of the coin or object is (inversely) related to the energy loss (which may be indicated by the quality factor or "Q.")

Figure 15A:
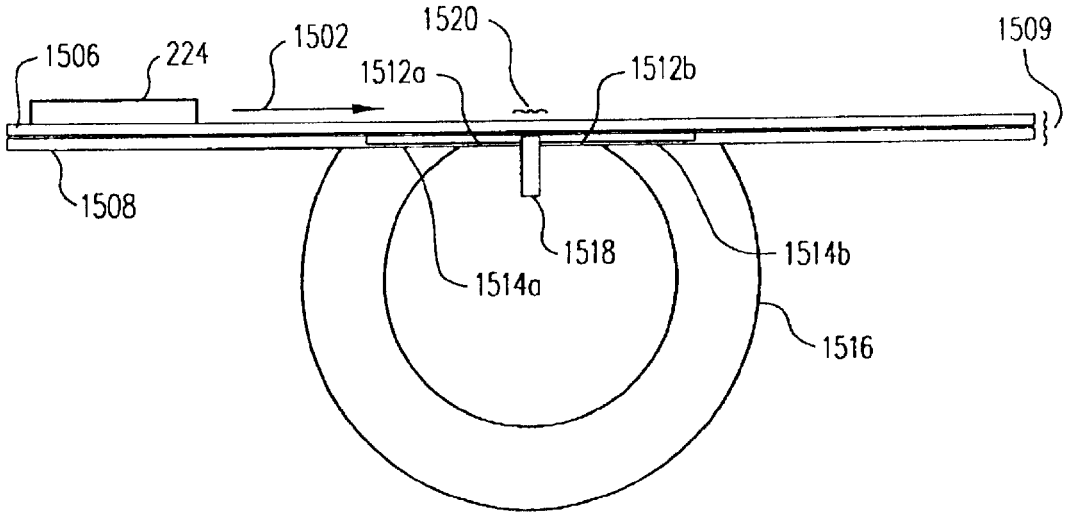
FIGS. 15A and 15B are front elevational and top plan views of a sensor, coin path and coin, according to an embodiment of the present invention.
Figure 15B:
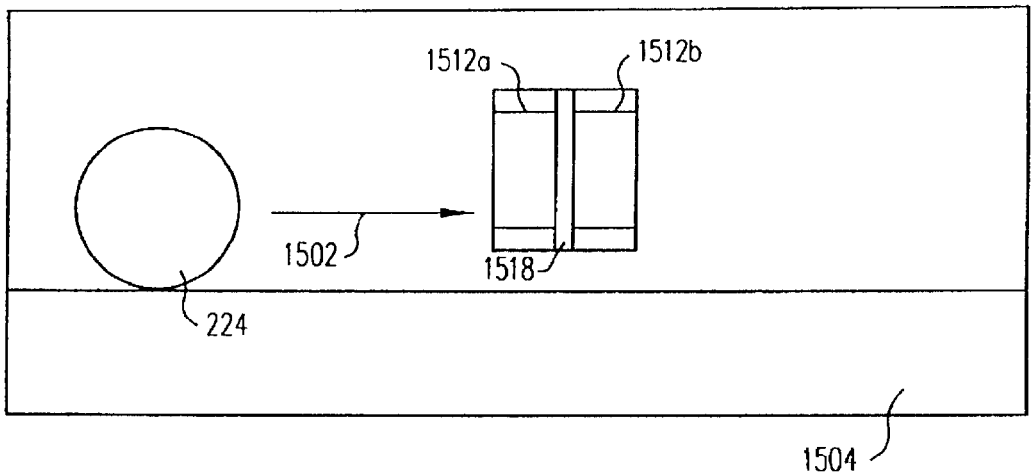
Figure 16A:
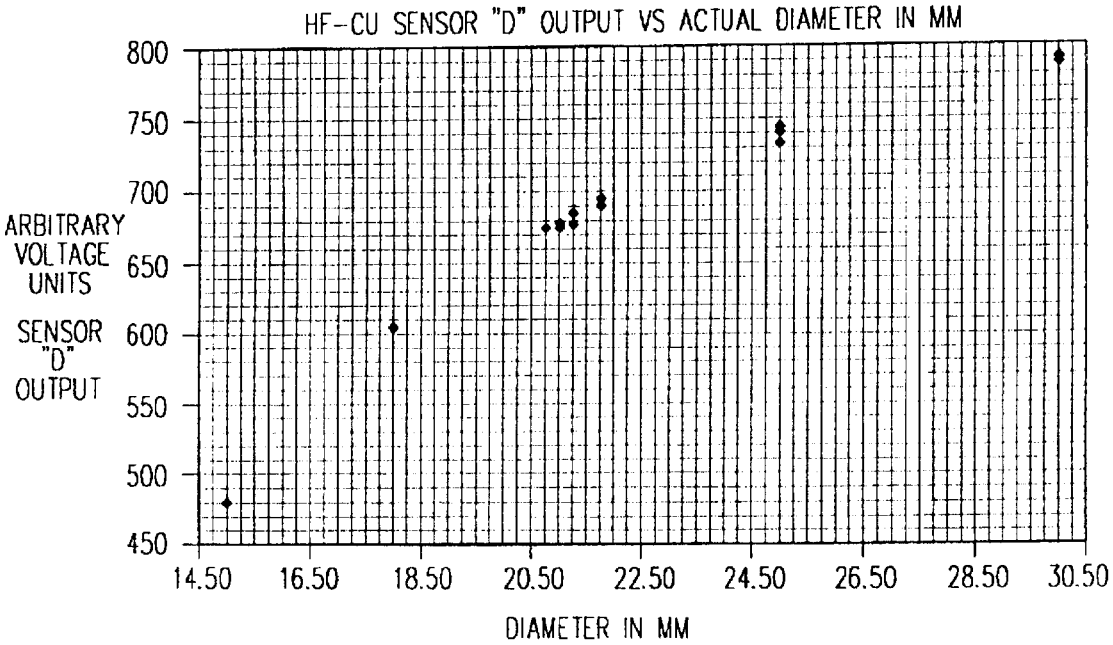
FIGS. 16A and 16B are graphs showing D output from high and low frequency sensors, respectively, for eight copper and aluminum disks of various diameters, according to an embodiment of the present invention.
Figure 16B:
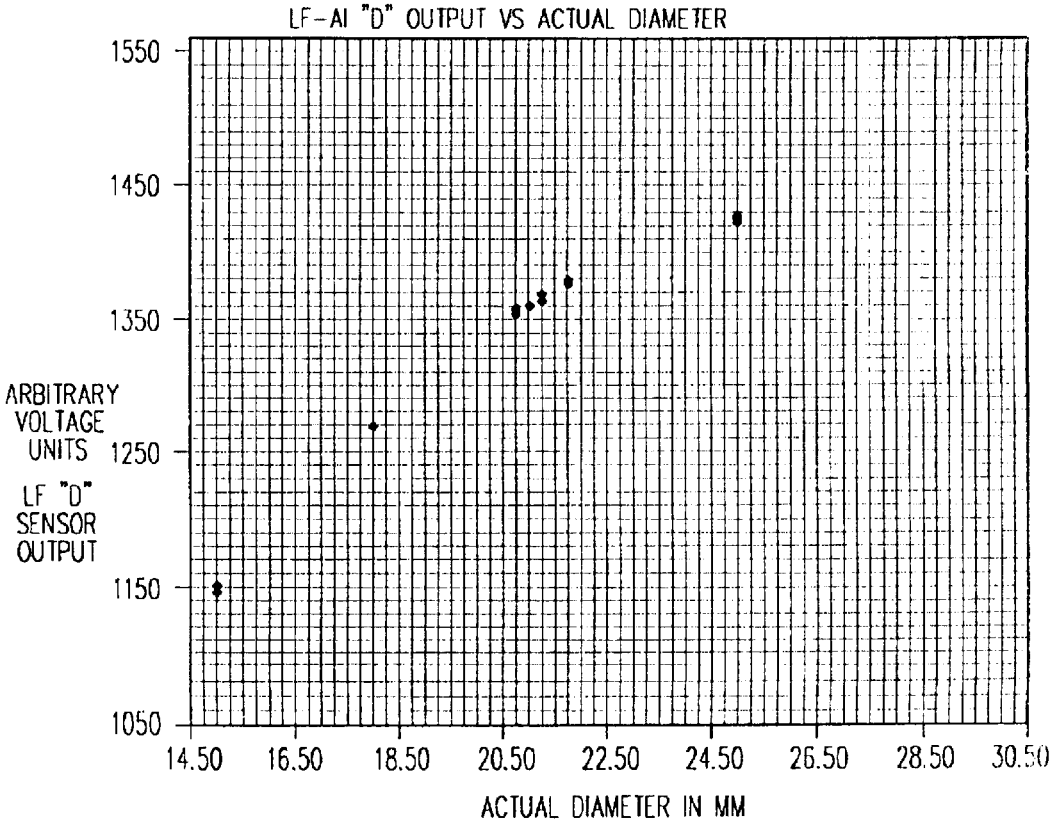

FIGS. 15A and 15B depict an embodiment which provides a capability for capacitive sensing, e.g. for detecting or compensating for coin relief and/or flying. In the embodiment of FIGS. 15A and 15B, a coin 224 is constrained to move along a substantially linear coin path 1502 defined by a rail device such as a polystyrene rail 1504. At least a portion of the coin path is adjacent a two-layer structure having an upper layer which is substantially non-electrically conducting 1506 such as fiberglass and a second layer 1508 which is substantially conductive such as copper. The two-layer structure 1506, 1508 can be conveniently provided by ordinary circuit board material 1509 such as 1/23 inch thick circuit board material with the fiberglass side contacting the coin as depicted. In the depicted embodiment, a rectangular window is formed in the copper cladding or layer 1508 to accommodate rectangular ferrite plates 1512*a*, 1512*b* which are coupled to faces 1514*a*, 1514*b* of the ferrite torroid core 1516. A conductive structure such as a copper plate or shield 1518 is positioned within the gap 1520 formed between the ferrite plates 1512*a*, 1512*b*. The shield is useful for increasing the flux interacting with the coin. Without wishing to be bound by any theory, it is believed that such a shield 1518 has the effect of forcing the flux to go around the shield and therefore to bulge out more into the coin path in the vicinity of the gap 1520 which is believed to provide more flux interacting with the coin than without the shield (for a better signal-to-noise ratio). The shield 1518 can also be used as one side of a capacitive sensor, with the other side being the copper backing/ground plane 1508 of the circuit board structure 1509. Capacitive changes sensed between the shield 1518 and the ground plane 1508 are believed to be related to the relief of the coin adjacent the gap 1520 and the distance to the coin.

Figure 5:
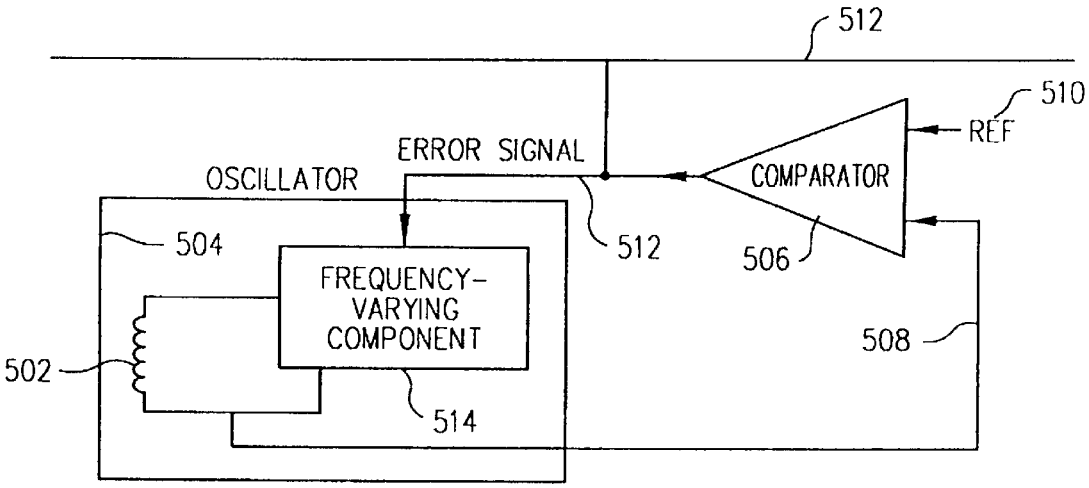
FIG. 5 is a block diagram of a discrimination device according to an embodiment of the present invention.
Figure 6:
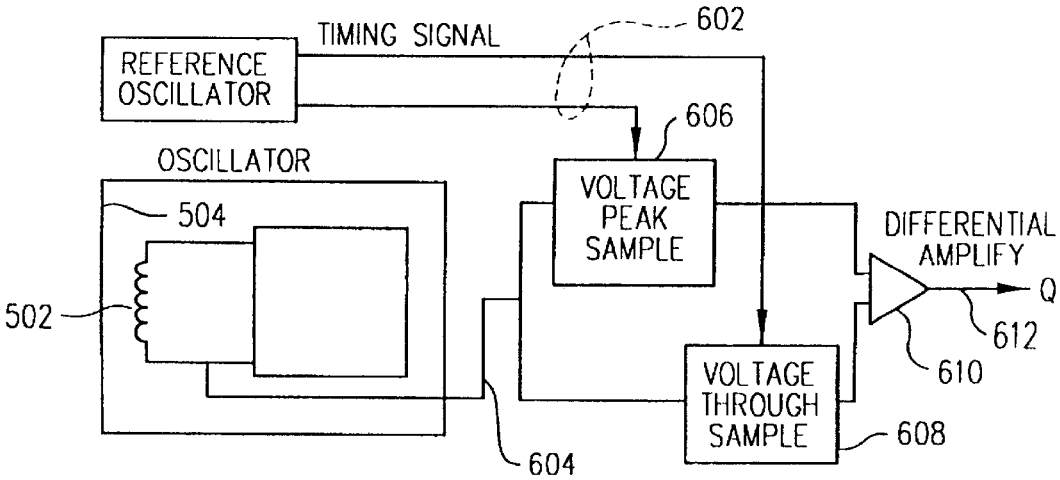
FIG. 6 is a block diagram of a discrimination device according to an embodiment of the present invention.

In the embodiment of FIG. 5, the output of signal 512 is related to change in inductance, and thus to coin diameter which is termed "D." The configuration of FIG. 6 results in the output of a signal 612 which is related to Q and thus to conductivity, termed, in FIG. 6, "Q." Although the D signal is not purely proportional to diameter (being at least somewhat influenced by the value of Q) and Q is not strictly and linearly proportional to conductance (being somewhat influenced by coin diameter) there is a sufficient relationship between signal D 512 and coin diameter and between signal Q 612 and conductance that these signals, when properly analyzed, can serve as a basis for coin discrimination. Without wishing to be bound by any theory, it is believed that the interaction between Q and D is substantially predictable and is substantially linear over the range of interest for a coin-counting device.

Figure 9:
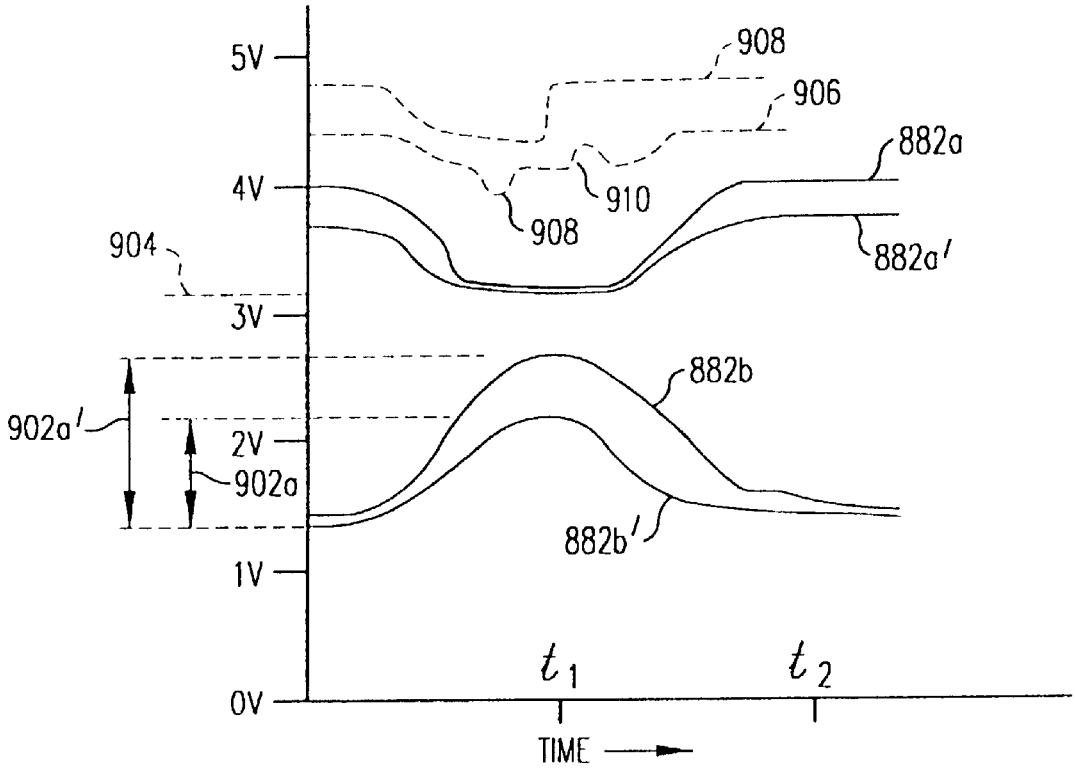
FIG. 9 depicts an example of output signals of a type output by the circuit of FIGS. 8A–D as a coin passes the sensor.

Many methods and/or devices can be used for analyzing the signals 512, 612, including visual inspection of an oscilloscope trace or graph (e.g. as shown in FIG. 9), automatic analysis using a digital or analog circuit and/or a computing device such as a microprocessor-based computer and/or using a digital signal processor (DSP). When it is desired to use a computer, it is useful to provide signals 512 and 612 (or modify those signals) so as to have a voltage range and/or other parameters compatible with input to a computer. In one embodiment, signals 512 and 612 will be voltage signals normally lying within the range 0 to +5 volts.

In some cases, it is desired to separately obtain information about coin parameters for the interior or core portion of the coin and the exterior or skin portion, particularly in cases where some or all of the coins to be discriminated may be cladded, plated or coated coins. For example, in some cases it may be that the most efficient and reliable way to discriminate between two types of coins is to determine the presence or absence of cladding or plating, or compare a skin or core parameter with a corresponding skin or core parameter of a known coin. In one embodiment, different frequencies are used to probe different depths in the thickness of the coin. This method is effective because, in terms of the interaction between a coin and a magnetic field, the frequency of a variable magnetic field defines a "skin depth," which is the effective depth of the portion of the coin or other object which interacts with the variable magnetic field. Thus, in this embodiment, a first frequency is provided which is relatively low to provide for a larger skin depth, and thus interaction with the core of the coin or other object, and a second, higher frequency is provided, high enough to result in a skin depth substantially less than the thickness of the coin. In this way, rather than a single sensor providing two parameters, the sensor is able to provide four parameters: core conductivity; cladding or coating conductivity; core diameter; and cladding or coating diameter (although it is anticipated that, in many instances, the core and cladding diameters will be similar). Preferably, the low-frequency skin depth is greater than the thickness of the plating or lamination, and the high frequency skin depth is less than, or about equal to, the plating or lamination thickness (or the range of lamination depths, for the anticipated coin population). Thus the frequency which is chosen depends on the characteristics of the coins or other objects expected to be input. In one embodiment, the low frequency is between about 50 KHz and about 500 KHz, preferably about 200 KHz and the high frequency is between about 0.5 MHZ and about 10 MHZ, preferably about 2 MHZ.

In some situations, it may be necessary to provide a first driving signal frequency component in order to achieve a second, different frequency sensor signal component. In particular, it is found that if the sensor 212 (FIG. 2) is first driven at the high frequency using high frequency coil 242 and then the low frequency signal is added, adding the low frequency signal will affect the frequency of the high frequency signal. Thus, the high frequency driving signal may need to be adjusted to drive at a nominal frequency which is different from the desired high frequency of the sensor such that when the low frequency is added, the high frequency is perturbed into the desired value by the addition of the low frequency.

Figure 2C:
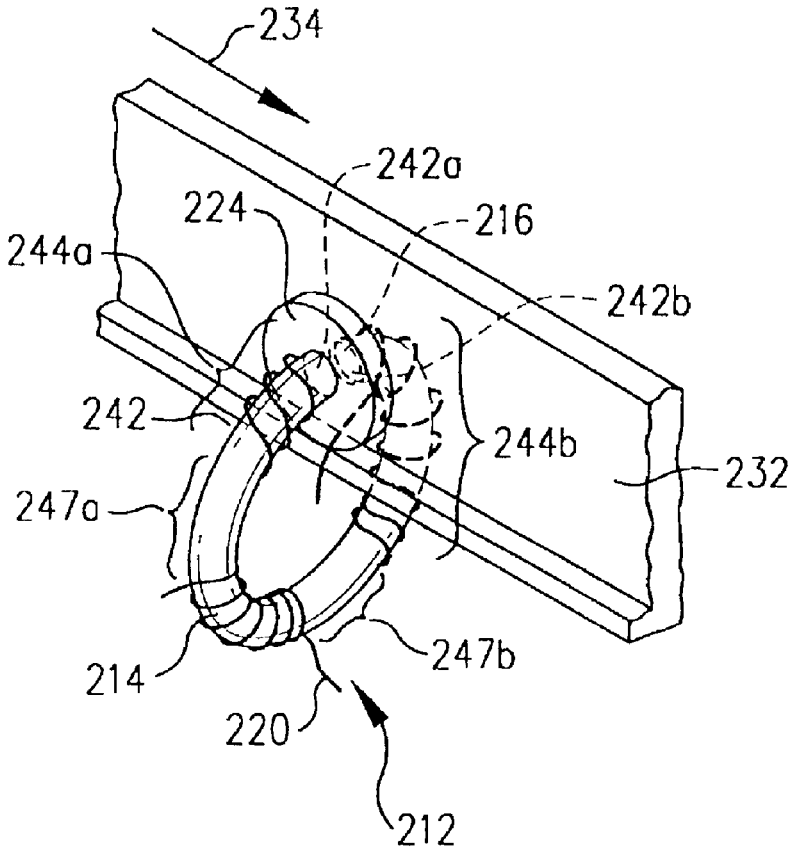

Multiple frequencies can be provided in a number of ways. In one embodiment, a single continuous wave form 702 (FIG. 7), which is the sum of two (or more) sinusoidal or periodic waveforms having different frequencies 704, 706, is provided to the sensor. As depicted in FIG. 2C, a sensor 214 is preferably configured with two different coils to be driven at two different frequencies. It is believed that, generally, the presence of a second coil can undesirably affect the inductance of the first coil, at the frequency of operation of the first coil. Generally, the number of turns of the first coil may be correspondingly adjusted so that the first coil has the desired inductance. In the embodiment of FIG. 2C, the sensor core 214 is wound in a lower portion with a first coil 220 for driving with a low frequency signal 706 and is wound in a second region by a second coil 242 for driving at a higher frequency 704. In the depicted embodiment, the high frequency coil 242 has a smaller number of turns and uses a larger gauge wire than the first coil 220. In the depicted embodiment, the high frequency coil 242 is spaced 242*a,* 242*b* from the first coil 220 and is positioned closer to the gap 216. Providing some separation 242*a,* 242*b* is believed to help reduce the effect one coil has on the inductance of the other and may somewhat reduce direct coupling between the low frequency and high frequency signals.

Figure 7:
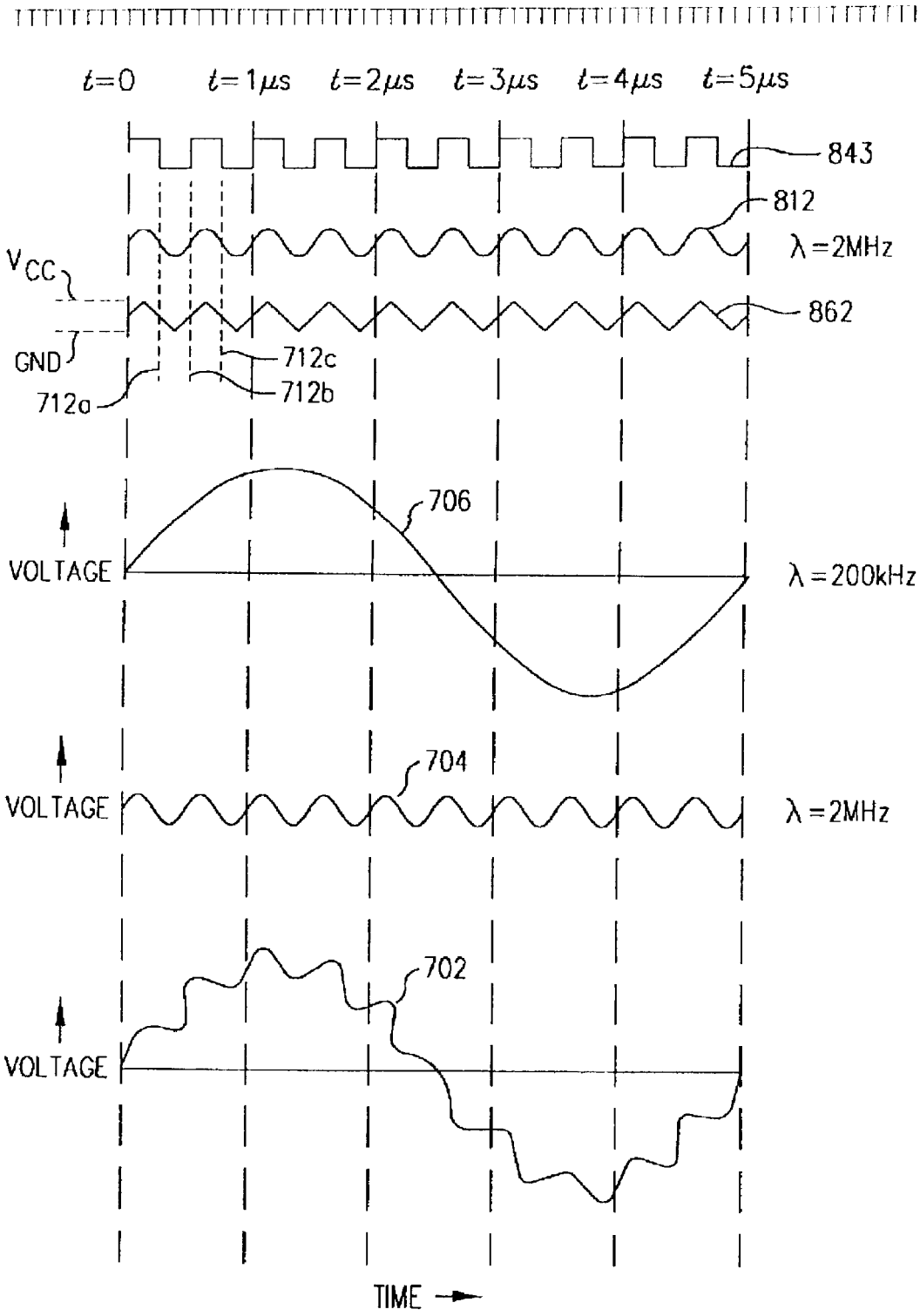
FIG. 7 depicts various signals that occur in the circuit of FIGS. 8A–C.

As can be seen from FIG. 7, the phase relationship of the high frequency signal 704 and low frequency signal 706 will affect the particular shape of the composite wave form 702. Signals 702 and 704 represent voltage at the terminals of the low and high frequency coils, 220, 242. If the phase relationship is not controlled, or at least known, output signals indicating, for example, amplitude and/or Q in the oscillator circuit as the coin passes the sensor may be such that it is difficult to determine how much of the change in amplitude or Q of the signal results from the passage of the coin and how much is attributable to the phase relationship of the two signals 704 and 706 in the particular cycle being analyzed. Accordingly, in one embodiment, the phases of the high and low signals 704, 706 are controlled such that sampling points along the composite signal 702 (described below) are taken at the same phase for both the high and low signals 704, 706. A number of ways of assuring the desired phase relationship can be used including generating both signals 704, 706 from a common reference source (such as a crystal oscillator) and/or using a phase locked loop (PLL) to control the phase relationship of the signals 704, 706. By using a phase locked loop, the wave shape of the composite signal 702 will be the same during any cycle (i.e., during any low frequency cycle), or at least will change only very slowly and thus it is possible to determine the sampling points (described below) based on, e.g., a pre-defined position or phase within the (low frequency) cycle rather than based on detecting characteristics of the wave form 702.

Figure 8A:
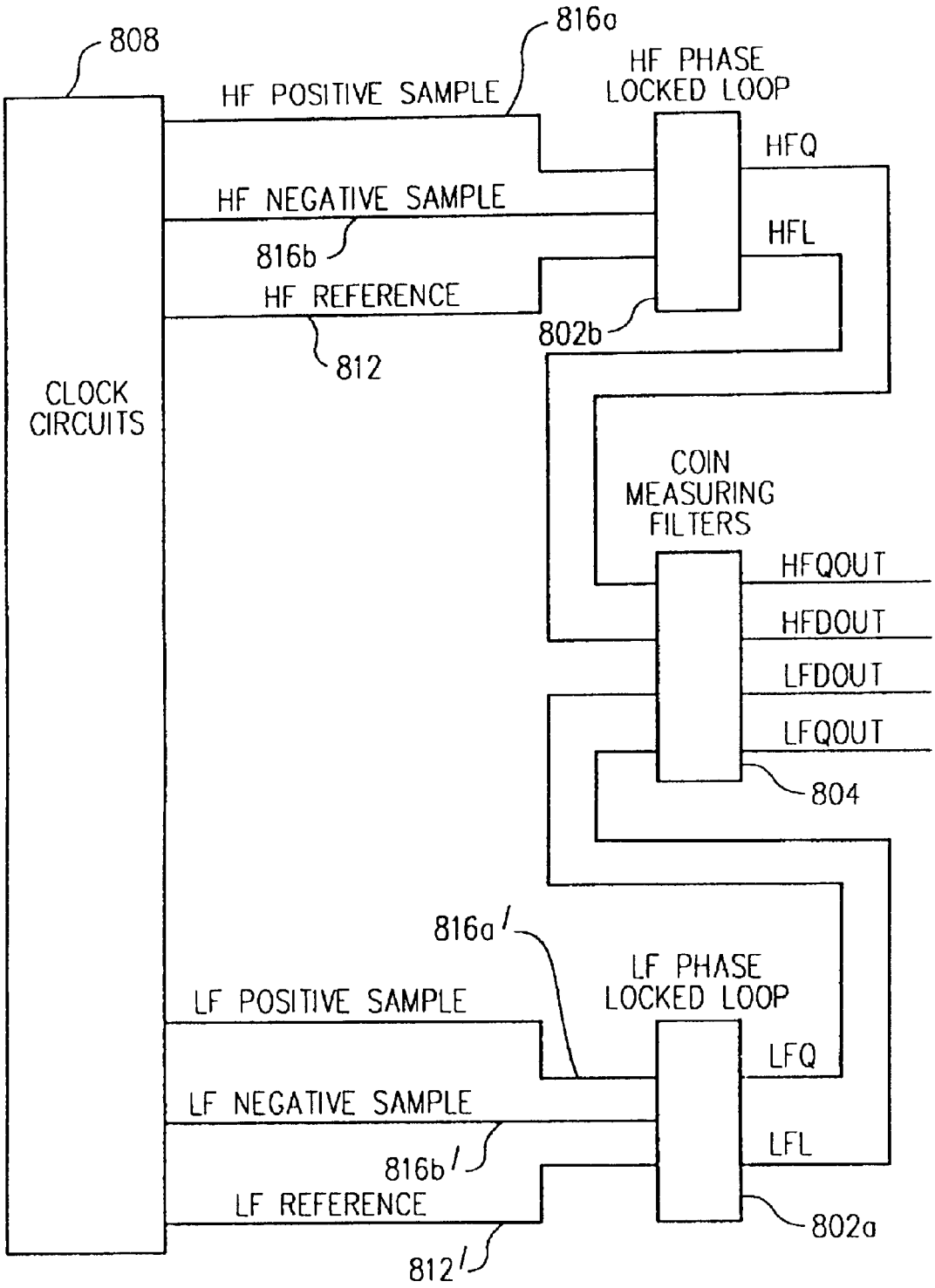
FIGS. 8A–8D are block and schematic diagrams of a circuit which may be used in connection with an embodiment of the present invention.
Figures 1, 8B:
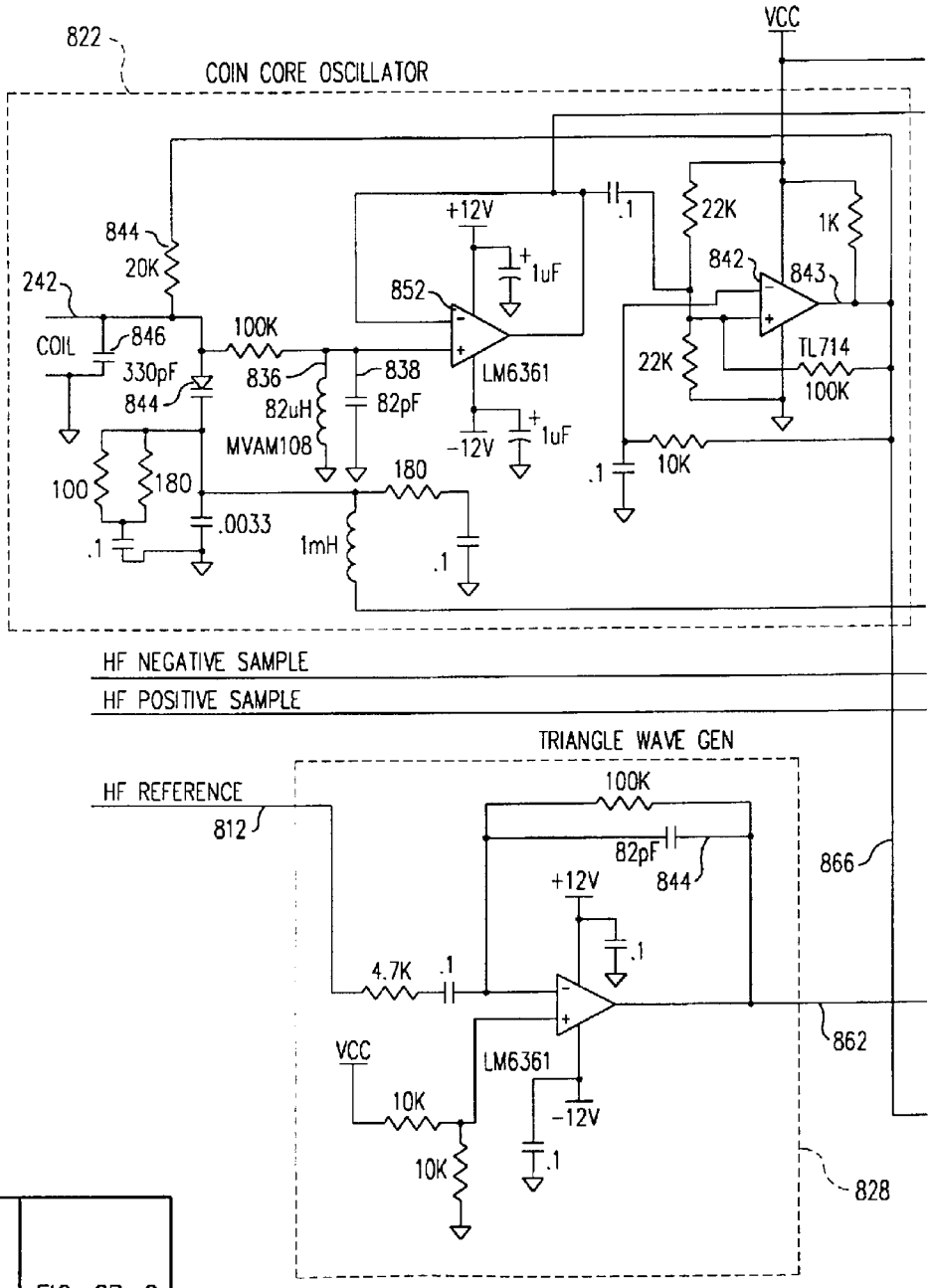
Figures 2, 8B:
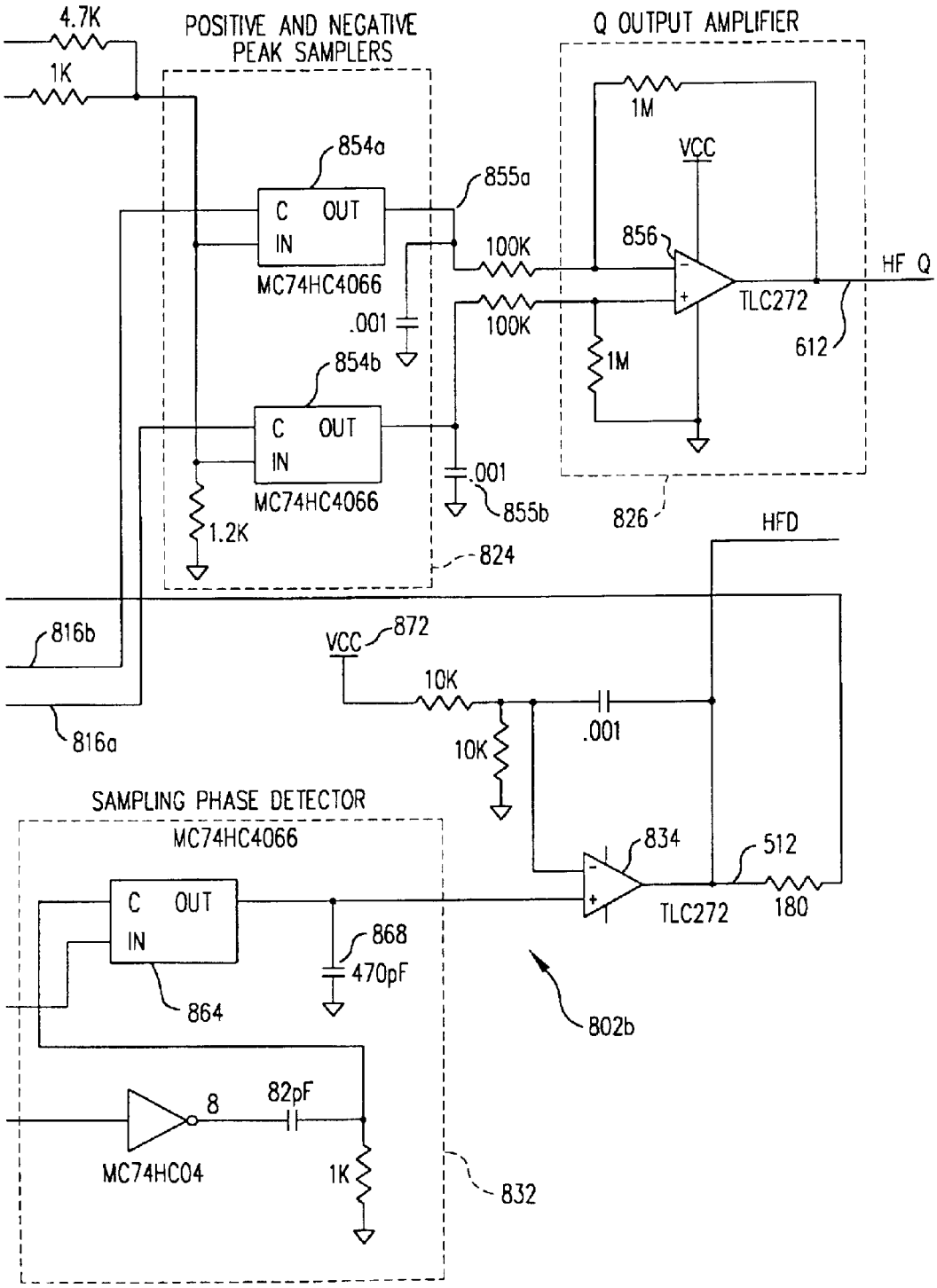
Figure 8C:
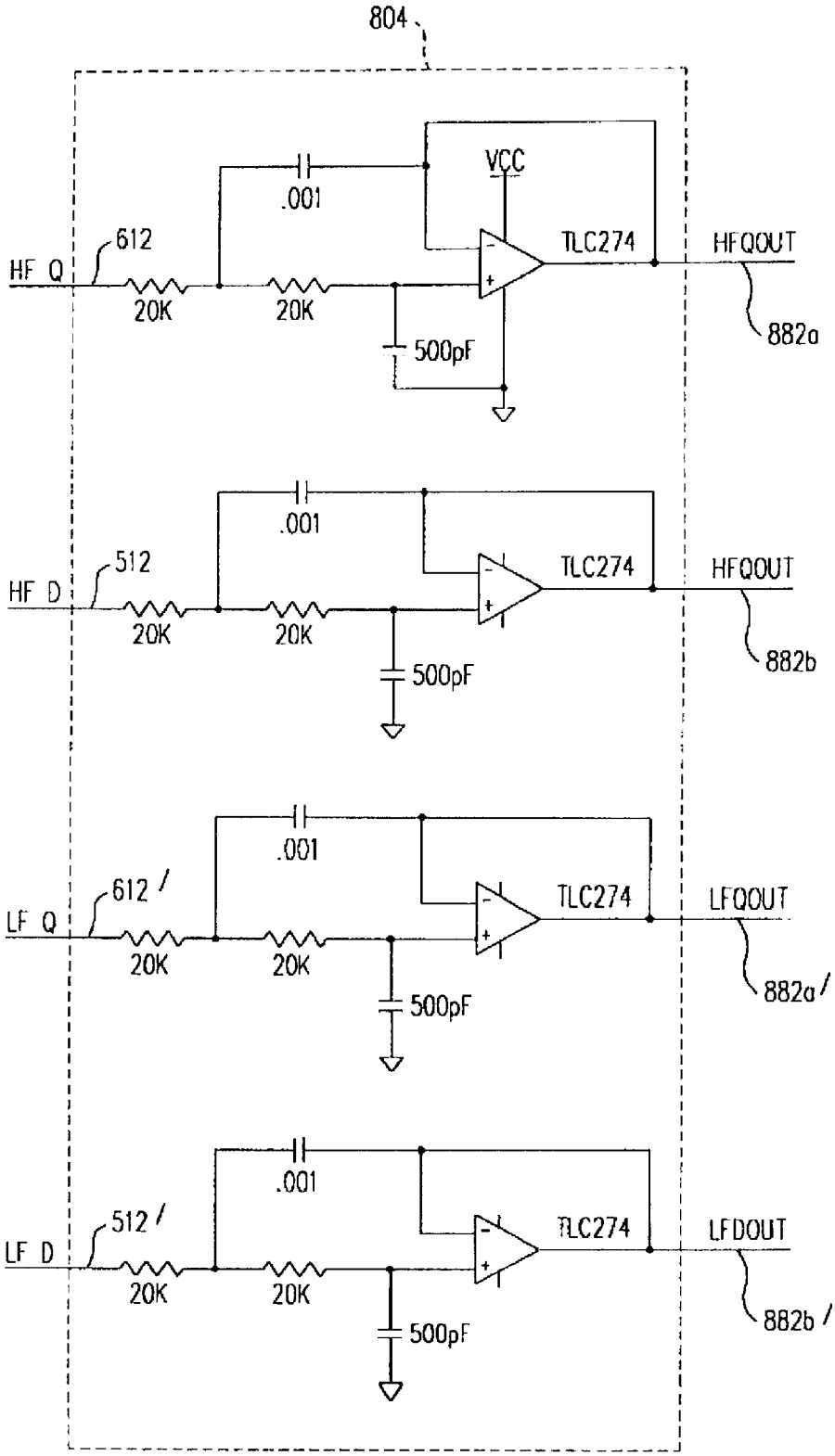
Figure 8D:
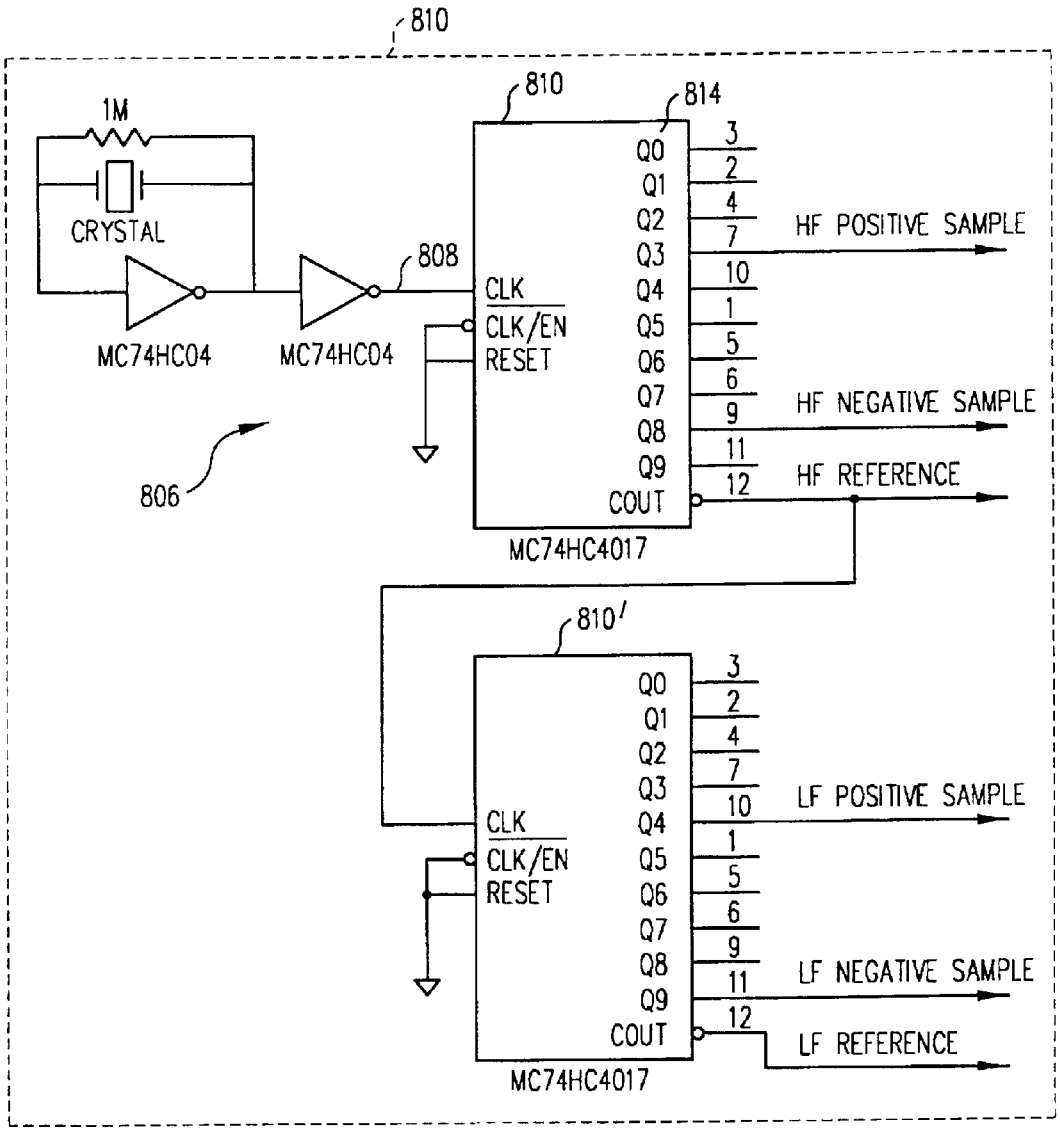

FIGS. 8A–8D depict circuitry which can be used for driving the sensor of FIG. 2C and obtaining signals useful in coin discrimination. The low frequency and high frequency coils 220, 242, form portions of a low frequency and high frequency phase locked loop, respectively 802*a,* 802*b.* Details of the clock circuits 808 are shown in FIG. 8D. The details of the high frequency phase locked loop are depicted in FIG. 8B and, the low frequency phase locked loop 802*a* may be identical to that shown in FIG. 8B except that some components may be provided with different values, e.g., as discussed below. The output from the phase locked loop is provided to filters, 804, shown in greater detail in FIG. 8C. The remainder of the components of FIG. 8A are generally directed to providing reference and/or sampling pulse or signals for purposes described more fully below.

The crystal oscillator circuit 806 (FIG. 8D) provides a reference frequency 808 input to the clock pin of a counter 810 such as a Johnson "divide by 10" counter. The counter outputs a high frequency reference signal 812 and various outputs Q0–Q9 define 10 different phase positions with respect to the reference signal 812. In the depicted embodiment, two of these phase position pulses 816*a,* 816*b* are provided to the high frequency phase locked loop 802*b* for purposes described below. A second counter 810' receives its clock input from the reference signal 812 and outputs a low frequency reference signal 812' and first and second low frequency sample pulses 816*a*' 816*b*' which are used in a fashion analogous to the use of the high frequency pulses 816*a* and 816*b* described below.

The high frequency phase locked loop circuit 802*b,* depicted in FIG. 8B, contains five main sections. The core oscillator 822 provides a driving signal for the high frequency coil 242. The positive and negative peak samplers 824 sample peak and trough voltages of the coil 242 which are provided to an output circuit 826 for outputting the high frequency Q output signal 612. The high frequency reference signal 812 is converted to a triangle wave by a triangle wave generator 828. The triangle wave is used, in a fashion discussed below, by a sampling phase detector 832 for providing an input to a difference amplifier 834 which outputs an error signal 512, which is provided to the oscillator 822 (to maintain the frequency and phase of the oscillator substantially constant) and provides the high frequency D output signal 512.

Low frequency phase locked loop circuit 802*a* is similar to that depicted in FIG. 8B except for the value of certain components which are different in order to provide appropriate low frequency response. In the high frequency circuit of FIG. 8B, an inductor 836 and capacitor 838 are provided to filter out low frequency, e.g. to avoid duty frequency cycling the comparator 842 (which has a low frequency component). This is useful to avoid driving low frequency and high frequency in the same oscillator 822. As seen in FIG. 8B, the inductor and capacitor have values, respectively, of 82 microhenrys and 82 picofarads. The corresponding components in the low frequency circuit 802A have values, respectively, of one microhenry and 0.1 microfarads, respectively (if such a filter is provided at all). In high frequency triangle wave generator, capacitor 844 is shown with a value of 82 picofarads while the corresponding component in the low frequency circuit 802*a* has a value of 0.001 microfarads.

Considering the circuit of FIG. 8B in somewhat greater detail, it is desired to provide the oscillator 822 in such a fashion that the frequency remains substantially constant, despite changes in inductance of the coil 242 (such as may arise from passage of a coin past the sensor). In order to achieve this goal, the oscillator 822 is provided with a voltage controllable capacitor (or varactor diode) 844 such that, as the inductance of the coil 242 changes, the capacitance of the varactor diode 844 is adjusted, using the error signal 512 to compensate, so as to maintain the LC resonant frequency substantially constant. In the configuration of FIG. 8B, the capacitance determining the resonant frequency is a function of both the varactor diode capacitance and the capacitance of fixed capacitor 846. Preferably, capacitor 846 and varactor diode 844 are selected so that the control voltage 512 can use the greater part of the dynamic range of the varactor diode and yet the control voltage 512 remains in a preferred range such as 0–5 volts (useful for outputting directly to a computer). Op amp 852 is a zero gain buffer amplifier (impedance isolator) whose output provides one input to comparator 842 which acts as a hard limiter and has relatively high gain. The hard-limited (square wave) output of comparator 842 is provided, across a high value resistor 844 to drive the coil 242. The high value of the resistance 844 is selected such that nearly all the voltage of the square wave is dropped across this resistor and thus the resulting voltage on the coil 242 is a function of its Q. In summary, a sine wave oscillation in the LC circuit is converted to a constant amplitude square wave signal driving the LC circuit so that the amplitude of the oscillations in the LC circuit are directly a measure of the Q of the circuit.

In order to obtain a measure of the amplitude of the voltage, it is necessary to sample the voltage at a peak and a trough of the signal. In the embodiment of FIG. 8B, first and second switches 854*a,* 854*b* provide samples of the voltage value at times determined by the high frequency pulses 816*a,* 816*b*. In one embodiment, the timing is determined empirically by selecting different outputs 814 from the counter 810. As seen in FIG. 8A, the (empirically selected) outputs used for the high frequency circuit may be different from those used for the low frequency circuit, e.g., because of differing delays in the two circuits and the like. Switches 854 and capacitors 855 form a sample and hold circuit for sampling peak and trough voltages and these voltages are provided to differential amplifier 856 whose output 612 is thus proportional to the amplitude of the signal in the LC circuit and, accordingly is inversely proportional to Q (and thus related to conductance of the coin). Because the phase locked loops for the low and high frequency signals are locked to a common reference, the phase relationship between the two frequency components is fixed, and any interference between the two frequencies will be common mode (or nearly so), since the wave form will stay nearly the same from cycle to cycle, and the common mode component will be subtracted out by the differential amplifier 856.

In addition to providing an output 612 which is related to coin conductance, the same circuit 802*b* also provides an output 512 related to coin diameter. In the embodiment of FIG. 8B, the high frequency diameter signal HFD 512 is a signal which indicates the magnitude of the correction that must be applied to varactor diode 844 to correct for changes in inductance of the coil 242 as the coin passes the sensor. FIG. 7 illustrates signals which play a role in determining whether correction to the varactor diode 844 is needed. If there has been no change in the coil inductance 242, the resonant frequency of the oscillator 822 will remain substantially constant and will have a substantially constant phase relationship with respect to the high frequency reference signal 812. Thus, in the absence of the passage of a coin past the sensor (or any other disturbance of the inductance of the coil 242) the square wave output signal 843 will have a phase which corresponds to the phase of the reference signal 812 such that at the time of each edge 712*a,* 712*b,* 712*c* of the oscillator square wave signal 843, the reference signal 812 will be in a phase midway between the wave peak and wave trough. Any departure from this condition indicates there has been a change in the resonant frequency of the oscillator 822 (and consequent phase shift) which needs to be corrected. In the embodiment of FIG. 8B, in order to detect and correct such departures, the reference signal 812 is converted, via triangle wave generator 828, to a triangle wave 862 having the same phase as the reference signal 812. This triangle wave 862 is provided to an analog switch 864 which samples the triangle wave 862 at times determined by pulses generated in response to edges of the oscillator square wave signal 843, output over line 866. The sampled signals are held by capacitor 868. As can be seen from FIG. 7, if there has been no change in the frequency or phase relationship of the oscillator signal 843, at the times of the square wave edges 712*a,* 712*b,* 712*c,* the value of the square wave signal 862 will be half way between the peak value and the trough value. In the depicted embodiment, the triangle wave 862 is configured to have an amplitude equal to the difference between VCC (typically 5 volts) and ground potential. Thus, difference amplifier 834 is configured to compare the sample values from the triangle wave 862 with one-half of VCC 872. If the sampled values from the triangle wave 862 are half way between ground potential and VCC, the output 512 from comparator 834 will be zero and thus there will be no error signal-induced change to the capacitance of varactor diode 844. However, if the sampled values from the triangle wave 862 are not halfway between ground potential and VCC, difference amplifier 834 will output a voltage on line 512 which is sufficient to adjust the capacitance of varactor diode 844 in an amount and direction needed to correct the resonant frequency of the oscillator 822 to maintain the frequency at the desired substantially constant value. Thus signal 512 is a measure of the magnitude of the changes in the effective inductance of the coil 242, e.g., arising from passage of a coin past the sensor. As shown in FIG. 8A, outputs 612, 512 from the high frequency PLL circuit as well as corresponding outputs 612' 512' from the low frequency PLL are provided to filters 804. The depicted filters 804 are low pass filters configured for noise rejection. The pass bands for the filters 804 are preferably selected to provide desirable signal to noise ratio characteristic for the output signals 882*a,* 882*b,* 882*a*', 882*b*'. For example, the bandwidth which is provided for the filters 804 may depend upon the speed at which coins pass the sensors, and similar factors.

In one embodiment, the output signals 882*a,* 882*b,* 882*a*', 882*b*' are provided to a computer for coin discrimination or other analysis. Before describing examples of such analysis, it is believed useful to describe the typical profiles of the output signals 882*a,* 882*b,* 882*a*', 882*b*'. FIG. 9 is a graph depicting the output signals, e.g., as they might appear if the output signals were displayed on a properly configured oscilloscope. In the illustration of FIG. 9, the values of the high and low frequency Q signals 882*a,* 882*a*' and the high and low frequency D signals 882*b,* 882*b*' have values (depicted on the left of the graph of FIG. 9) prior to passage of a coin past the sensor, which change as indicated in FIG. 9 as the coin moves toward the sensor, and is adjacent or centered within the gap of the sensor at time $T_1$, returning to substantially the original values as the coin moves away from the sensor at time T2.

The signals 882*a,* 882*b,* 882*a*', 882*b*' can be used in a number of fashions to characterize coins or other objects as described below. The magnitude of changes 902*a,* 902*a*' of the low frequency and high frequency D values as the coin passes the sensor and the absolute values 904, 904' of the low and high frequency Q signals 882*a*', 882*a,* respectively, at the time $t_1$ when the coin or other object is most nearly aligned with the sensor (as determined e.g., by the time of the local maximum in the D signals 882*b,* 882*b*') are useful in characterizing coins. Both the low and high frequency Q values are useful for discrimination. Laminated coins show significant differences in the Q reading for low vs. high frequency. The low and high frequency "D" values are also useful for discrimination. It has been found that some of all of the values are, at least for some coin populations, sufficiently characteristic of various coin denominations that coins can be discriminated with high accuracy.

Figure 10A:
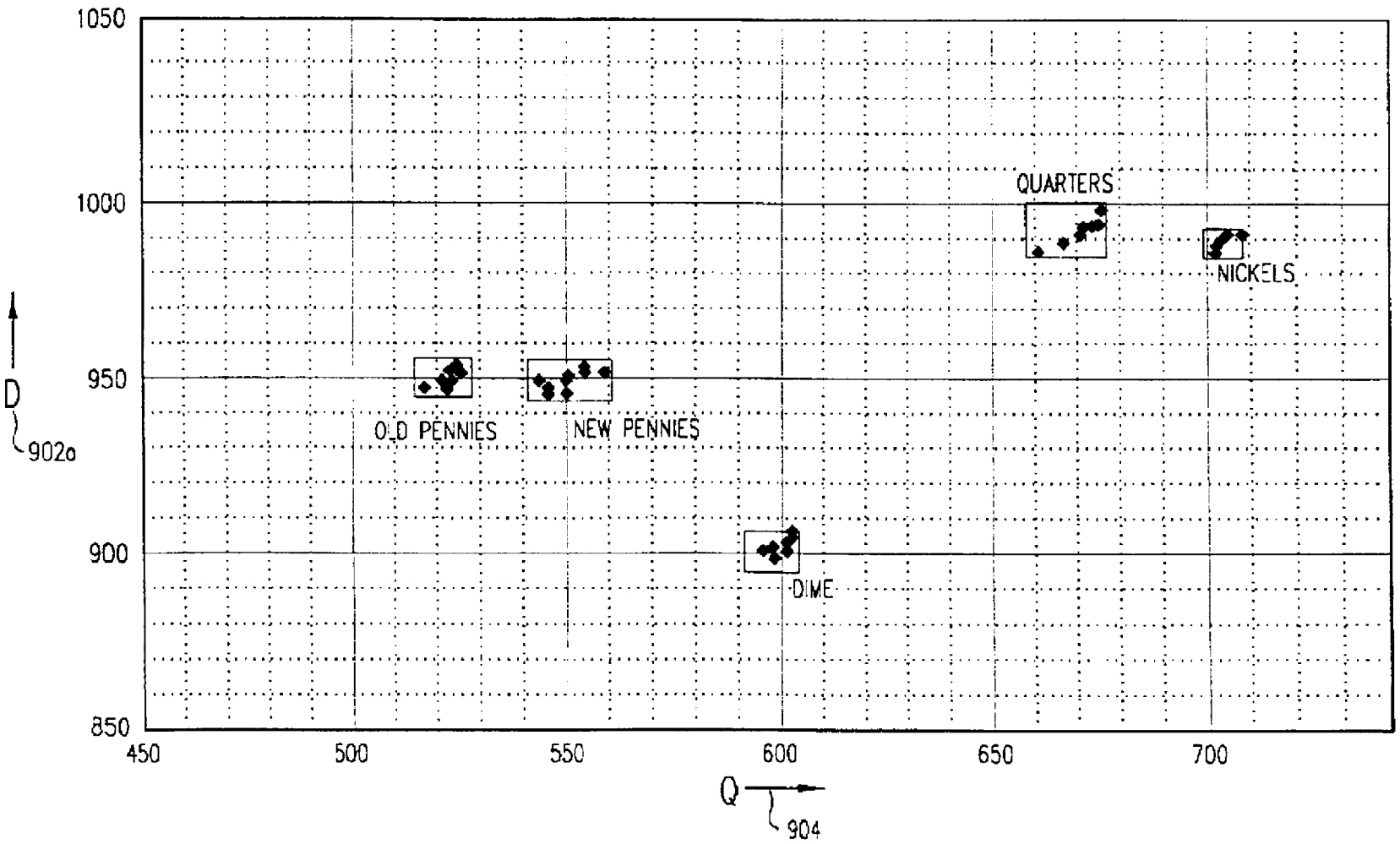
FIGS. 10A and 10B depict standard data and tolerance regions of a type that may be used for discriminating coins on the basis of data output by sensors of the present invention.
Figure 10B:
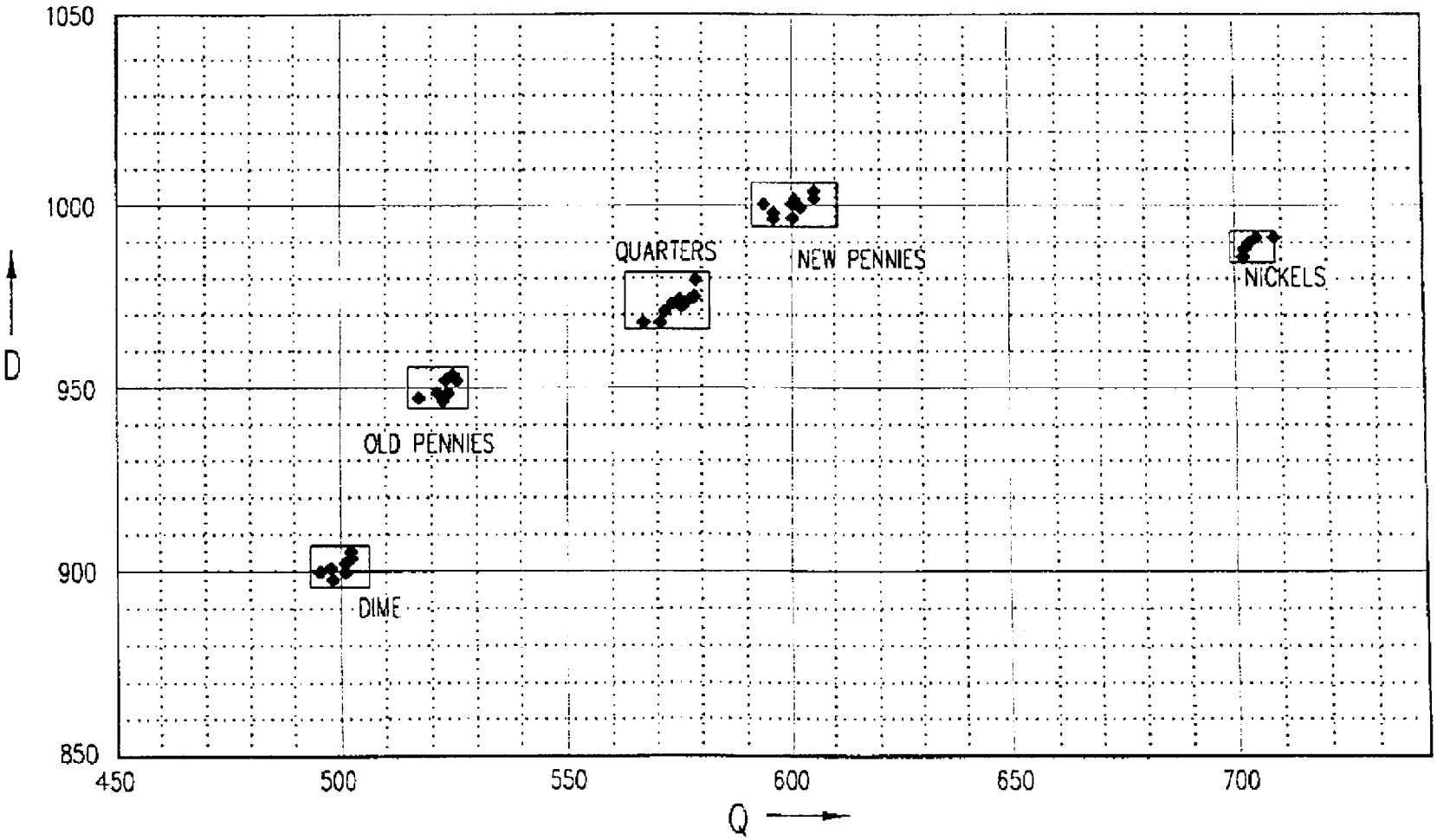
Figure 11:
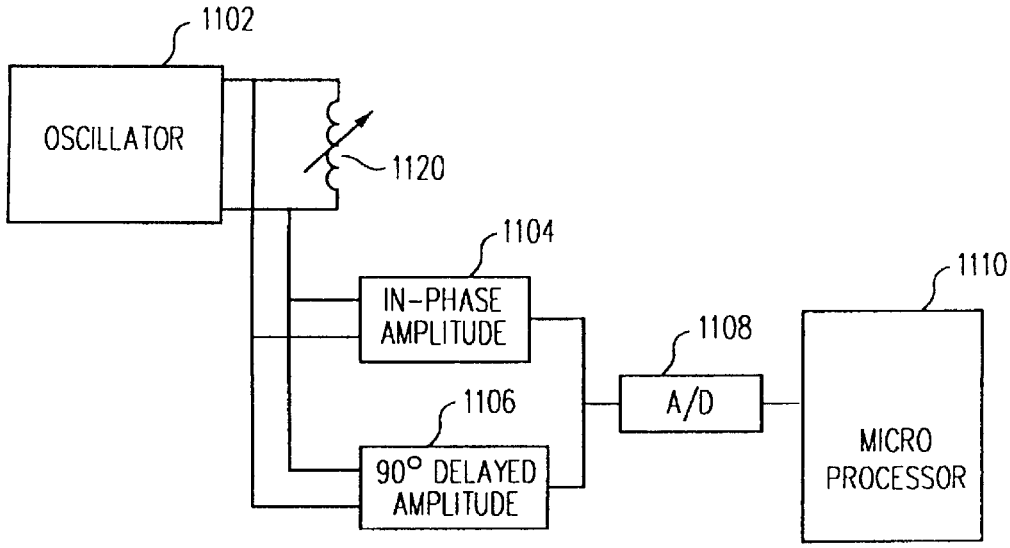
FIG. 11 is a block diagram of a discrimination device, according to an embodiment of the present invention.

In one embodiment, values 902*a,* 902*a*', 904, 904' are obtained for a large number of coins so as to define standard values characteristic of each coin denomination. FIGS. 10A and 10B depict high and low frequency Q and D data for different U.S. coins. The values for the data points in FIGS. 10A and 10B are in arbitrary units. A number of features of the data are apparent from FIGS. 10A and 10B. First, it is noted that the Q, D data points for different denominations of coins are clustered in the sense that a given Q, D data point for a coin tends to be closer to data points for the same denomination coin than for a different denomination coin. Second, it is noted that the relative position of the denominations for the low frequency data (FIG. 10B) are different from the relative positions for corresponding denominations in the high frequency graph FIG. 10A.

One method of using standard reference data of the type depicted in FIGS. 10A and 10B to determine the denomination of an unknown coin is to define Q, D regions on each of the high frequency and low frequency graphs in the vicinity of the data points. For example, in FIGS. 10A and 10B, regions 1002*a*–1002*e,* 1002*a*'–1002*e*' are depicted as rectangular areas encompassing the data points. According to one embodiment, when low frequency and high frequency Q and D data are input to the computer in response to the coin moving past the sensor, the high frequency Q, D values for the unknown coin are compared to each of the regions 1002*a*–1002*e* of the high frequency graph and the low frequency Q, D data is compared to each of the regions 1002*a*'–1002*e*' of the low frequency graph FIG. 10B. If the unknown coin lies within the predefined regions corresponding to the same denomination for each of the two graphs FIG. 10A FIG. 10B, the coin is indicated as having that denomination. If the Q, D data falls outside the regions 1002*a*–1002*e,* 1002*a*'–1002*e*' on the two graphs or if the data point of the unknown coin or object falls inside a region corresponding to a first denomination with a high frequency graph but a different denomination with low frequency graph, the coin or other object is indicated as not corresponding to any of the denominations defined in the graphs of FIGS. 10A and 10B.

As will be apparent from the above discussion, the error rate that will occur in regard to such an analysis will partially depend on the size of the regions 1002*a*–1002*e*, 1002*a*'–1002*e*' which are defined. Regions which are too large will tend to result in an unacceptably large number of false positives (i.e., identifying the coin as being a particular denomination when it is not) while defining regions which are too small will result in an unacceptably large number of false negatives (i.e., failing to identify a legitimate coin denomination). Thus, the size and shape of the various regions may be defined or adjusted, e.g. empirically, to achieve error rates which are no greater than desired error rates. In one embodiment, the windows 2002*a*–2002*e,* 2002*a*'–2002*e*' have a size and shape determined on the basis of a statistical analysis of the Q, D values for a standard or sample coin population, such as being equal to 2 or 3 standard deviations from the mean Q, D values for known coins. The size and shape of the regions 1002*a*–1002*e,* 1002*a*'–1002*e*' may be different from one another, i.e., different for different denominations and/or different for the low frequency and high frequency graphs. Furthermore, the size and shape of the regions may be adjusted depending on the anticipated coin population (e.g., in regions near national borders, regions may need to be defined so as to discriminate foreign coins, even at the cost of raising the false negative error rate whereas such adjustment of the size or shape of the regions may not be necessary at locations in the interior of a country where foreign coins may be relatively rare).

If desired, the computer can be configured to obtain statistics regarding the Q, D values of the coins which are discriminated by the device in the field. This data can be useful to detect changes, e.g., changes in the coin population over time, or changes in the average Q, D values such as may result from aging or wear of the sensors or other components. Such information may be used to adjust the software or hardware, perform maintenance on the device and the like. In one embodiment, the apparatus in which the coin discrimination device is used may be provided with a communication device such as a modem 25 (FIG. 41) and may be configured to permit the definition of the regions 1002*a*–1002*e,* 1002*a*'–1002*e*' or other data or software to be modified remotely (i.e., to be downloaded to a field site from a central site). In another embodiment, the device is configured to automatically adjust the definitions of the regions 1002*a*–1002*e,* 1002*a*'–1002*e*' in response to ongoing statistical analysis of the Q, D data for coins which are discriminated using the device, to provide a type of self calibration for the coin discriminator.

In light of the above description, a number advantages of the present invention can be seen. Embodiments of the present invention can provide a device with increased accuracy and service life, ease and safety of use, requiring little or no training and little or no instruction, which reliably returns unprocessed coins to the user, rapidly processes coins, has a high throughput, a reduced incidence of jamming, in which some or all jams can be reliably cleared without human intervention, which has reduced need for intervention by trained personnel, can handle a broad range of coin types, or denominations, can handle wet or sticky coins or foreign or non-coin objects, has reduced incidence of malfunctioning or placing foreign objects in the coin bins, has reduced incidence of rejecting good coins, has simplified and/or reduced requirements for set-up, calibration or maintenance, has relatively small volume or footprint requirements, is tolerant of temperature variations, is relatively quiet, and/or enhanced ease of upgrading or retrofitting.

In one embodiment, the apparatus achieves singulation of a randomly-oriented mass of coins with reduced jamming and high throughput. In one embodiment, coins are effectively separated from one another prior to sensing and/or deflection. In one embodiment, deflection parameters, such as force and/or timing of deflection can be adjusted to take into account characteristics of coins or other objects, such as mass, speed, and/or acceleration, to assist in accuracy of coin handling. In one embodiment, slow or stuck coins are automatically moved (such as by a pin or rake), or otherwise provided with kinetic energy. In one embodiment items including those which are not recognized as valuable, acceptable or desirable coins or other objects are allowed to follow a non-diverted, default path (preferably, under the force of gravity), while at least some recognized and/or accepted coins are diverted from the default path to move such items into an acceptance bin or other location.

In one embodiment, the device provides for ease of application (e.g. multiple measurements done simultaneously and/or at one location), increased performance, such as improved throughput and reduced jams (that prematurely end transactions and risk losing coins), more accurate discrimination, and reduced cost and/or size. One or more torroidal cores can be used for sensing properties of coins or other objects passing through a magnetic field, created in or adjacent a gap in the torroid, thus allowing coins, disks, spherical, round or other objects, to be measured for their physical, dimensional, or metallic properties (preferably two or more properties, in a single pass over or through one sensor). The device facilitates rapid coin movement and high throughput. The device provides for better discrimination among coins and other objects than many previous devices, particularly with respect to U.S. dimes and pennies, while requiring fewer sensors and/or a smaller sensor region to achieve this result. Preferably, multiple parameters of a coin are measured substantially simultaneously and with the coin located in the same position, e.g., multiple sensors are co-located at a position on the coin path, such as on a rail. In a number of cases, components are provided which produce more than one function, in order to reduce part count and maintenance. For example, certain sensors, as described below, are used for sensing two or more items and/or provide data which are used for two or more functions. Coin handling apparatus having a lower cost of design, fabrication, shipping, maintenance or repair can be achieved. In one embodiment, a single sensor exposes a coin to two different electromagnetic frequencies substantially simultaneously, and substantially without the need to move the coin to achieve the desired two-frequency measurement. In this context, "substantially" means that, while there may be some minor departure from simultaneity or minor coin movement during the exposure to two different frequencies, the departure from simultaneity or movement is not so great as to interfere with certain purposes of the invention such as reducing space requirements, increasing coin throughput and the like, as compared to previous devices. For example, preferably, during detection of the results of exposure to the two frequencies, a coin will move less than a diameter of the largest-diameter coin to be detected, more preferably less than about ¾ a largest-coin diameter and even more preferably less than about ½ of a coin diameter.

The present invention makes possible improved discrimination, lower cost, simpler circuit implementation, smaller size, and ease of use in a practical system. Preferably, all parameters needed to identify a coin are obtained at the same time and with the coin in the same physical location, so software and other discrimination algorithms are simplified.

Other door configurations than those depicted can be used. The door 62 may have a laminated structure, such as two steel or other sheets coupled by, e.g., adhesive foam tape.

A number of variations and modifications of the invention can be used. It is possible to use some aspects of the invention without using others. For example, the described techniques and devices for providing multiple frequencies at a single sensor location can be advantageously employed without necessarily using the sensor geometry depicted. It is possible to use the described torroid-core sensors, while using analysis, devices or techniques different from those described herein and vice versa. It is possible to use the sensor and or coin rail configuration described herein without using the described coin pickup assembly. For example it is possible to use the sensor described herein in connection with the coin pickup assembly described in Ser. No. 08/883,655, for POSITIVE DRIVE COIN DISCRIMINATING APPARATUS AND METHOD, and incorporated herein by reference. It is possible to use aspects of the singulation and/or discrimination portion of the apparatus without using a trommel. Although the invention has been described in the context of a machine which receives a plurality of coins in a mass, a number of features of the invention can be used in connection with devices which receive coins one at a time, such as through a coin slot.

Although the sensors have been described in connection with the coin counting or handling device, sensors can also be used in connection with coin activated devices, such as vending machines, telephones, gaming devices, and the like. In addition to using information about discriminated coins for outputting a printed voucher, the information can be used in connection with making electronic funds transfers, e.g. to the bank account of the user (e.g. in accordance with information read from a bank card, credit card or the like) and/or to an account of a third party, such as the retail location where the apparatus is placed, to a utility company, to a government agency, such as the U.S. Postal Service, or to a charitable, non-profit or political organization (e.g. as described in U.S. application Ser. No. 08/852,328, filed May 7, 1997 for Donation Transaction method and apparatus, incorporated herein by reference. In addition to discriminating among coins, devices can be used for discriminating and/or quality control on other devices such as for small, discrete metallic parts such as ball bearings, bolts and the like. Although the depicted embodiments show a single sensor, it is possible to provide adjacent or spaced multiple sensors (e.g., to detect one or more properties or parameters at different skin depths). The sensors of the present invention can be combined with other sensors, known in the art such as optical sensors, mass sensors, and the like. In the depicted embodiment, the coin 242 is positioned on both a first side 244*a* of the gap and a second side 244*b* of the gap. It is believed that as the coin 224 moves down the rail 232, it will be typically positioned very close to the second portion 244*b* of the coil 242. If it is found that this close positioning results in an undesirably high sensitivity of the sensor inductance to the coin position (e.g. an undesirably large variation in inductance when coins "fly" or are otherwise somewhat spaced from the back wall of the rail 232), it may be desirable to place the high frequency coil 242 only on the second portion 244*a* (FIG. 2C) which is believed to be normally somewhat farther spaced from the coin 224 and thus less sensitive to coin positional variations. The gap may be formed between opposed faces of a torroid section, or formed between the opposed and spaced edges of two plates, coupled (such as by adhesion) to faces of a section of a torroid. In either configuration, a single continuous non-linear core has first and second ends, with a gap therebetween.

Although it is possible to provide a sensor in which the core is driven by a direct current, preferably, the core is driven by an alternating or varying current.

In one embodiment two or more frequencies are used. Preferably, to reduce the number of sensors in the devices, both frequencies drive a single core. In this way, a first frequency can be selected to obtain parameters relating to the core of a coin and a second frequency selected to obtain parameters relating to the skin region of the coin, e.g., to characterize plated or laminated coins. One difficulty in using two or more frequencies on a single core is the potential of interference. In one embodiment, to avoid such interference both frequencies are phase locked to a single reference frequency. In one approach, the sensor forms an inductor of an L-C oscillator, whose frequency is maintained by a Phase-Locked Loop (PLL) to define an error signal (related to Q) and amplitude which change as the coin moves past the sensor.

As seen in FIGS. 2A, 2B, 3 and 4, the depicted sensor includes a coil which will provide a certain amount of inductance or inductive reactance in a circuit to which it is connected. The effective inductance of the coil will change as, e.g. a coin moves adjacent or through the gap and this change of inductance can be used to at least partially characterize the coin. Without wishing to be bound by any theory, it is believed the coin or other object affects inductance in the following manner. As the coin moves by or across the gap, the AC magnetic field lines are altered. If the frequency of the varying magnetic field is sufficiently high to define a "skin depth" which is less than about the thickness of the coin, no field lines will go through the coin as the coin moves across or through the gap. As the coin is moved across or into the gap, the inductance of a coil wound on the core decreases, because the magnetic field of the direct, short path is canceled (e.g., by eddy currents flowing in the coin). Since, under these conditions no flux goes through any coin having any substantial conductivity, the decrease in inductance due to the presence of the coin is primarily a function of the surface area (and thus diameter) of the coin.

A relatively straightforward approach would be to use the coil as an inductor in a resonant circuit such as an LC oscillator circuit and detect changes in the resonant frequency of the circuit as the coin moved past or through the gap. Although this approach has been found to be operable and to provide information which may be used to sense certain characteristics of the coin (such as its diameter) a more preferred embodiment is shown, in general form, in FIG. 5 and is described in greater detail below.

In the embodiment of FIG. 5, a phase detector 506 compares a signal indicative of the frequency in the oscillator 508 with a reference frequency 510 and outputs an error signal 512 which controls a frequency-varying component of the oscillator 514 (such as a variable capacitor). The magnitude of the error signal 512 is an indication of the magnitude of the change in the effective inductance of the coil 502. The detection configuration shown in FIG. 5 is thus capable of detecting changes in inductance (related to the coin diameter) while maintaining the frequency of the oscillator substantially constant. Providing a substantially constant frequency is useful because, among other reasons, the sensor will be less affected by interfering electromagnetic fields than a sensor that allows the frequency to shift would be. It will also be easier to prevent unwanted electromagnetic radiation from the sensor, since filtering or shielding would be provided only with respect to one frequency as opposed to a range of frequencies.

Without wishing to be bound by any theory, it is believed that the presence of the coin affects energy loss, as indicated by the Q factor in the following manner. As noted above, as the coin moves past or through the gap, eddy currents flow causing an energy loss, which is related to both the amplitude of the current and the resistance of the coin. The amplitude of the current is substantially independent of coin conductivity (since the magnitude of the current is always enough to cancel the magnetic field that is prevented by the presence of the coin). Therefore, for a given effective diameter of the coin, the energy loss in the eddy currents will be inversely related to the conductivity of the coin. The relationship can be complicated by such factors as the skin depth, which affects the area of current flow with the skin depth being related to conductivity.

Thus, for a coil 502 driven at a first, e.g. sinusoidal, frequency, the amplitude can be determined by using timing signals 602 (FIG. 6) to sample the voltage at a time known to correspond to the peak voltage in the cycle, using a first sampler 606 and sampling at a second point in the cycle known to correspond to the trough using a second sampler 608. The sampled (and held) peak and trough voltages can be provided to a differential amplifier 610, the output of which 612 is related to the conductance. More precisely speaking, the output 612 will represent the Q of the circuit. In general, Q is a measure of the amount of energy loss in an oscillator. In a perfect oscillator circuit, there would be no energy loss (once started, the circuit would oscillate forever) and the Q value would be infinite. In a real circuit, the amplitude of oscillations will diminish and Q is a measure of the rate at which the amplitude diminishes. In another embodiment, data relating to changes in frequency as a function of changes in Q are analyzed (or correlated with data indicative of this functional relationship for various types of coins or other objects).

In one embodiment, the invention involves combining two or more frequencies on one core by phase-locking all the frequencies to the same reference. Because the frequencies are phase-locked to each other, the interference effect of one frequency on the others becomes a common-mode signal, which is removed, e.g., with a differential amplifier.

In one embodiment, a coin discrimination apparatus and method is provided in which an oscillating electromagnetic field is generated on a single sensing core. The oscillating electromagnetic field is composed of one or more frequency components. The electromagnetic field interacts with a coin, and these interactions are monitored and used to classify the coin according to its physical properties. All frequency components of the magnetic field are phase-locked to a common reference frequency. The phase relationships between the various frequencies are fixed, and the interaction of each frequency component with the coin can be accurately determined without the need for complicated electrical filters or special geometric shaping of the sensing core. In one embodiment, a sensor having a core, preferably ferrite, which is curved (or otherwise non-linear), such as in a U-shape or in the shape of a section of a torus, and defining a gap, is provided with a wire winding for excitation and/or detection. The sensor can be used for simultaneously obtaining data relating to two or more parameters of a coin or other object, such as size and conductivity of the object. Two or more frequencies can be used to sense core and/or cladding properties.

In the embodiment depicted in FIGS. 8A–8C, the apparatus can be constructed using parts which are all currently readily available and relatively low cost. As will be apparent to those of skill in the art, other circuits may be configured for performing functions useful in discriminating coins using the sensor of FIGS. 2–4. Some embodiments may be useful to select components to minimize the effects of temperature, drift, etc. In some situations, particularly high volume situations, some or all of the circuitry may be provided in an integrated fashion such as being provided on an application specific integrated circuit (ASIC). In some embodiments it may be desirable to switch the relative roles of the square wave 843 and triangle wave 862. For example, rather than obtaining a sample pulse based on a square wave signal 843, a circuit could be used which would provide a pulse reference that would go directly to the analog switch (without needing an edge detect). The square wave would be used to generate a triangular wave.

The phase locked loop circuits described above use very high (theoretically infinite) DC gain such as about 100 dB or more on the feedback path, so as to maintain a very small phase error. In some situations this may lead to difficulty in achieving phase lock up, upon initiating the circuits and thus it may be desirable to relax, somewhat, the small phase error requirements in order to achieve initial phase lock up more readily.

Although the embodiment of FIGS. 8A–8C provides for two frequencies, it is possible to design a detector using three or more frequencies, e.g. to provide for better coin discrimination.

Additionally, rather than providing two or more discrete frequencies, the apparatus could be configured to sweep or "chirp" through a frequency range. In one embodiment, in order to achieve swept-frequency data it would be useful to provide an extremely rapid frequency sweep (so that the coin does not move a large distance during the time required for the frequency to sweep) or to maintain the coin stationary during the frequency sweep.

In some embodiments in place of or in addition to analyzing values obtained at a single time ($t_1$ FIG. 9) to characterize coins or other objects, it may be useful to use data from a variety of different times to develop a Q vs. t profile or D vs. t profile (where t represents time) for detected objects. For example, it is believed that larger coins such as quarters, tend to result in a Q vs. t profile which is flatter, compared to a D vs. t profile, than the profile for smaller coins. It is believed that some, mostly symmetric, waveforms have dips in the middle due to an "annular" type coin where the Q of the inner radius of the coin is different from the Q of the outer annulus. It is believed that, in some cases, bumps on the leading and trailing edges of the Q waveforms may be related to the rim of the coin or the thickness of plating or lamination near the rim of the coin.

In some embodiments the output data is influenced by relatively small-scale coin characteristics such as plating thickness or surface relief. In some circumstances it is believed that surface relief information can be used, e.g., to distinguish the face of the coin, (to distinguish "heads" from "tails") to distinguish old coins from new coins of the same denomination and the like. In order to prevent rotational orientation of the coin from interfering with proper surface relief analysis, it is preferable to construct sensors to provide data which is averaged over annular regions such as a radially symmetric sensor or array of sensors configured to provide data averaged in annular regions centered on the coin face center.

Although FIG. 5 depicts one fashion of obtaining a signal related to Q, other circuits can also be used. In the embodiment depicted in FIG. 5, a sinusoidal voltage is applied to the sensor coil 220, e.g., using an oscillator 1102. The waveform of the current in the coil 220, will be affected by the presence of a coin or other object adjacent the gap 216, 316, as described above. Different phase components of the resulting current wave form can be used to obtain data related to inductance and Q respectively. In the depicted embodiment, the current in the coil 220 is decomposed into at least two components, a first component which is in-phase with the output of the oscillator 1102, and a second component which is delayed by 90 degrees, with respect to the output of the oscillator 1102. These components can be obtained using phase-sensitive amplifiers 1104, 1106 such as a phase locked loop device and, as needed, a phase shift or delay device of a type well known in the art. The in-phase component is related to Q, and the 90 degree lagging component is related to inductance. In one embodiment, the output from the phase discriminators 1104, 1106, is digitized by an analog-to-digital converter 1108, and processed by a microprocessor 1110. In one implementation of this technique, measurements are taken at many frequencies. Each frequency drives a resistor connected to the coil. The other end of the coil is grounded. For each frequency, there is a dedicated "receiver" that detects the I and Q signals. Alternatively, it is possible to analyze all frequencies simultaneously by employing, e.g., a fast Fourier transform (FFT) in the microprocessor. In another embodiment, it is possible to use an impedance analyzer to read the Q (or "loss tangent") and inductance of a coil.

Figure 12:
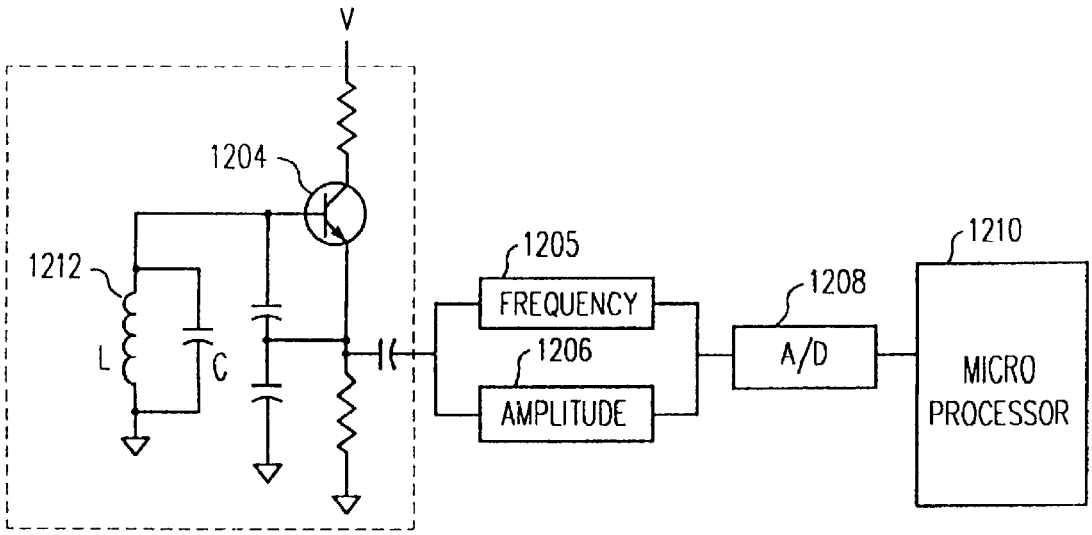
FIG. 12 is a schematic and block diagram of a discrimination advice according to an embodiment of the present invention.

In another embodiment, depicted in FIG. 12, information regarding the coin parameters is obtained by using the sensor 1212 as an inductor in an LC oscillator 1202. A number of types of LC oscillators can be used as will be apparent to those of skill in the art, after understanding the present disclosure. Although a transistor 1204 has been depicted, other amplifiers such as op amps, can be used in different configurations. In the depicted embodiment, the sensor 1212 has been depicted as an inductor, since presence of a coin in the vicinity of the sensor gap will affect the inductance. Since the resonant frequency of the oscillator 1202 is related to the effective inductance (frequency varies as $(I/LC)^{-1/2}$): as the diameter of the coin increases, the frequency of the oscillator increases. The amplitude of the AC in the resonant LC circuit, is affected by the conductivity of objects in the vicinity of the sensor gap. The frequency is detected by frequency detector 1205, and by amplitude detector 1206, using well known electronics techniques with the results preferably being digitized 1208, and processed by microprocessor 1210. In one embodiment the oscillation loop is completed by amplifying the voltage, using a hard-limiting amplifier (square wave output), which drives a resistor. Changes in the magnitude of the inductance caused the oscillator's frequency to change. As the diameter of the test coin increases, the frequency of the oscillator increases. As the conductivity of the test coin decreases, the amplitude of the AC voltage and the tuned circuit goes down. By having a hard-limiter, and having a current-limiting resister that is much larger than the resonant impedance of the tuned circuit, the amplitude of the signal at the resonant circuit substantially accurately indicates, in inverse relationship, the Q of the conductor.

Although one manner of analyzing D and Q signals using a microprocessor is described above, a microprocessor can use the data in a number of other ways. Although it would be possible to use formulas or statistical regressions to calculate or obtain the numerical values for diameter (e.g., in inches) and/or conductivity (e.g., in mhos), it is contemplated that a frequent use of the present invention will be in connection with a coin counter or handler, which is intended to 1) discriminate coins from non-coin objects, 2) discriminate domestic from foreign coins and/or 3) discriminate one coin denomination from another. Accordingly, in one embodiment, the microprocessor compares the diameter-indicating data, and conductivity-indicating data, with standard data indicative of conductivity and diameter for various known coins. Although it would be possible to use the microprocessor to convert detected data to standard diameter and conductivity values or units (such as inches or mhos), and compare with data which is stored in memory in standard values or units, the conversion step can be avoided by storing in memory, data characteristic of various coins in the same values or units as the data received by the microprocessor. For example, when the detector of FIGS. 5 and/or 6 outputs values in the range of e.g., 0 to +5 volts, the standard data characteristic of various known coins can be converted, prior to storage, to a scale of 0 to 5, and stored in that form so that the comparison can be made directly, without an additional step of conversion.

Although in one embodiment it is possible to use data from a single point in time, such as when the coin is centered on the gap 216, (as indicated, e.g., by a relative maximum, or minimum, in a signal), in another embodiment a plurality of values or a continuous signal of the values obtained as the coin moves past or through the gap 216 is preferably used.

Figure 13:
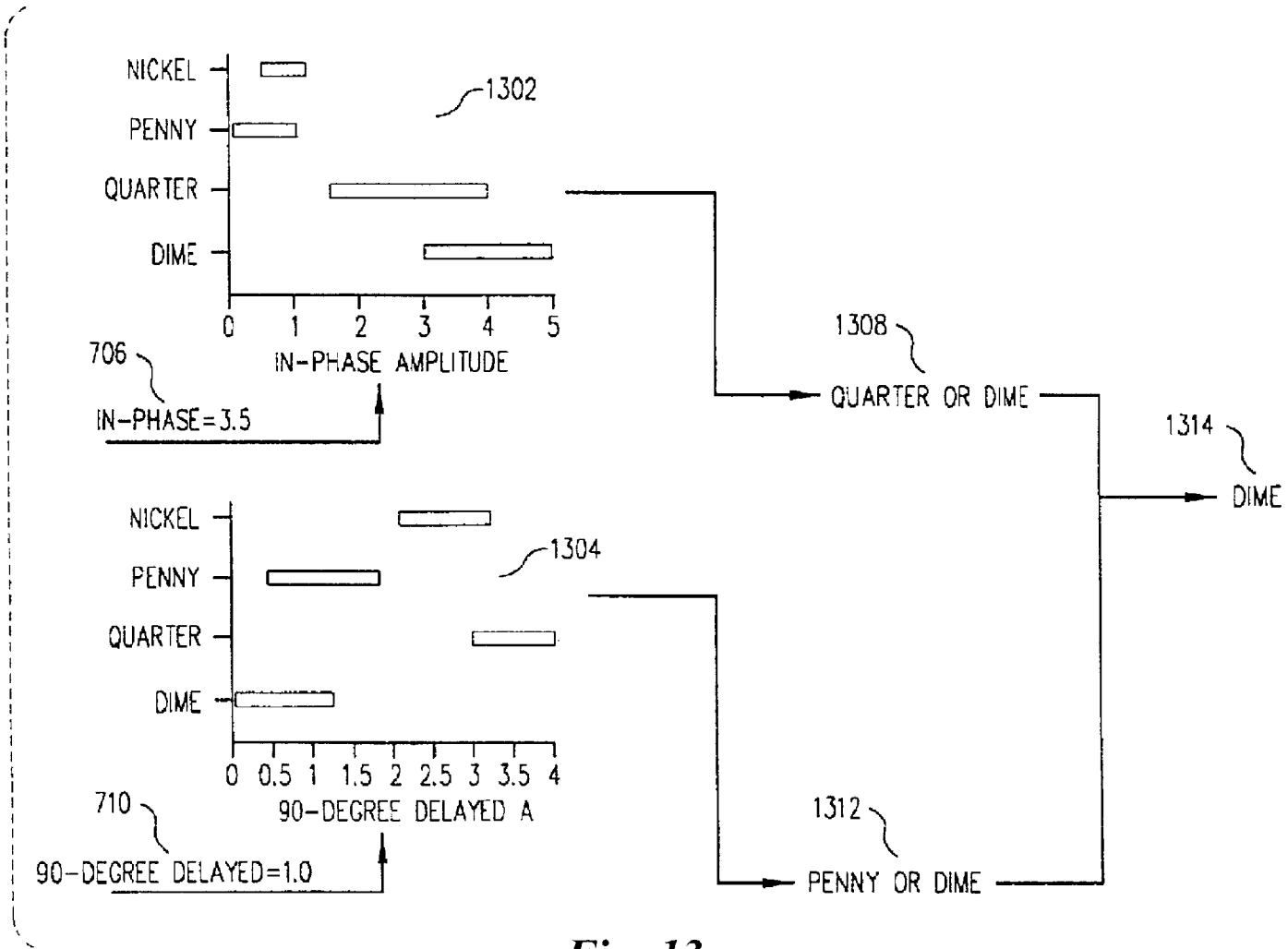
FIG. 13 depicts use of in-phase and delayed amplitude data for coin discriminating according to one embodiment.

An example of a single point of comparison for each of the in-phase and delayed detector, is depicted in FIG. 13. In this figure, standard data (stored in the computer), indicates the average and/or acceptance or tolerance range of in-phase amplitudes (indicative of conductivity), which has been found to be associated with U.S. pennies, nickels, dimes and quarters, respectively 1302. Data is also stored, indicating the average and/or acceptance or tolerance range of values output by the 90 degree delayed amplitude detector 406 (indicative of diameter) associated with the same coins 1304. Preferably, the envelope or tolerance is sufficiently broad to lessen the occurrence of false negative results, (which can arise, e.g., from worn, misshapen, or dirty coins, electronic noise, and the like), but sufficiently narrow to avoid false positive results, and to avoid or reduce substantial overlap of the envelopes of two or more curves (in order to provide for discrimination between denominations). Although, in the figures, the data stored in the computer is shown in graphical form, for the sake of clarity of disclosure, typically the data will be stored in digital form in a memory, in a manner well known in the computer art. In the embodiment in which only a single value is used for discrimination, the digitized single in-phase amplitude value, which is detected for a particular coin (in this example, a value of 3.5) (scaled to a range of 0 to 5 and digitized), is compared to the standard in-phase data, and the value of 3.5 is found (using programming techniques known in the art) to be consistent with either a quarter or a dime 1308. Similarly, the 90-degree delayed amplitude value which is detected for this same coin 1310 (in this example, a value of 1.0), is compared to the standard in-phase data, and the value of 1.0 is found to be consistent with either a penny or a dime 1312. Thus, although each test by itself would yield ambiguous results, since the single detector provides information on two parameters (one related to conductivity and one related to diameter), the discrimination can be made unambiguously since there is only one denomination (dime) 1314 which is consistent with both the conductivity data and the diameter data.

Figure 14:
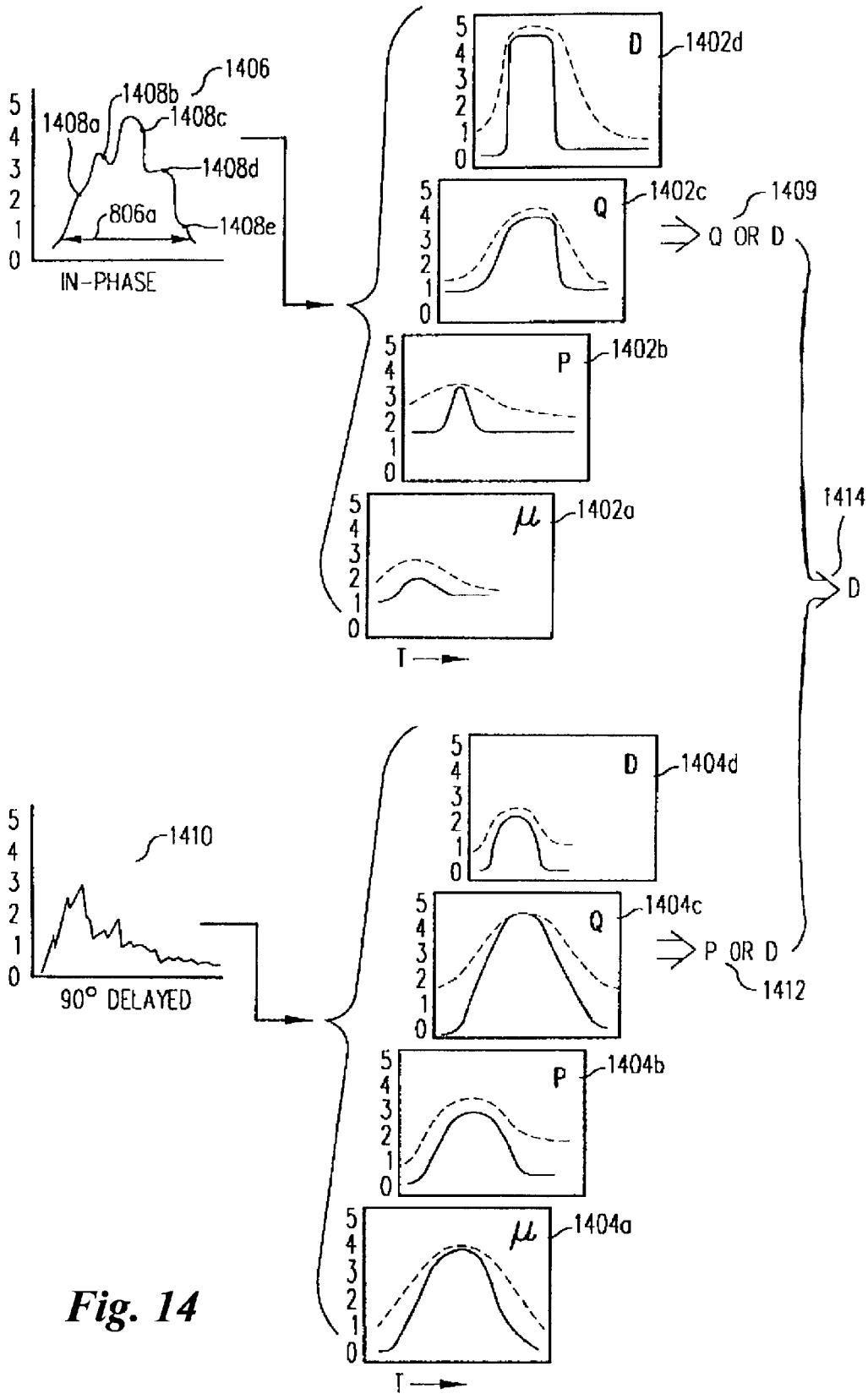
FIG. 14 depicts use of in-phase and delayed amplitude data for coin discriminating according to another embodiment.

As noted, rather than using single-point comparisons, it is possible to use multiple data points (or a continuous curve) generated as the coin moves past or through the gap 216, 316. Profiles of data of this type can be used in several different ways. In the example of FIG. 14, a plurality of known denominations of coins are sent through the discriminating device in order to accumulate standard data profiles for each of the denominations 1402*a, b, c, d,* 1404*a, b, c, d.* These represent the average change in output from the in-phase amplitude detector 1104 and a 90-degree delay detector for (shown on the vertical axes) 1403 and acceptance ranges or tolerances 1405 as the coins move past the detector over a period of time, (shown on the horizontal axis). In order to discriminate an unknown coin or other object, the object is passed through or across the detector, and each of the in-phase amplitude detector 1104 and 90-degree delayed amplitude detector 1106, respectively, produce a curve or profile 1406, 1410, respectively. In the embodiment depicted in FIG. 8, the in-phase profile 1406 generated as a coin passes the detector 212, is compared to the various standard profiles for different coins 1402*a,* 1402*b,* 1402*c,* 1402*d.* Comparison can be made in a number of ways. In one embodiment, the data is scaled so that a horizontal axis between initial and final threshold values 1406*a* equals a standard time, for better matching with the standard values 1402*a* through 1402*d.* The profile shown in 1406 is then compared with standard profiles stored in memory 1402*a* through 1402*d,* to determine whether the detected profile is within the acceptable envelopes defined in any of the curves 1402*a* through 1402*d.* Another method is to calculate a closeness of fit parameter using well known curve-fitting techniques, and select a denomination or several denominations, which most closely fit the sensed profile 1406. Still another method is to select a plurality of points at predetermined (sealed) intervals along the time axis 1406*a* (1408*a, b, c, d*) and compare these values with corresponding time points for each of the denominations. In this case, only the standard values and tolerances or envelopes at such predetermined times needs to be stored in the computer memory. Using any or all these methods, the comparison of the sensed data 1406, with the stored standard data 1402*a* through 1402*d* indicates, in this example, that the in-phase sensed data is most in accord with standard data for quarters or dimes 1409. A similar comparison of the 90-degree delayed data 1410 to stored standard 90-degree delayed data (1404*a* through 1404*d*), indicates that the sensed coin was either a penny or a dime. As before, using both these results, it is possible to determine that the coin was a dime 1414.

In one embodiment, the in-phase and out-of-phase data are correlated to provide a table or graph of in-phase amplitude versus 90-degree delayed amplitude for the sensed coin (similar to the Q versus D data depicted in FIGS. 10A and 10B), which can then be compared with standard in-phase versus delayed profiles obtained for various coin denominations in a manner similar to that discussed above in connection with FIGS. 10A and 10B.

Although coin acceptance regions are depicted (FIGS. 10A, 10B) as rectangular, they may have any shape.

In both the configuration of FIG. 2 and the configuration of FIGS. 3 and 4, the presence of the coin affects the magnetic field. It is believed that in some cases, eddy currents flowing in the coin, result in a smaller inductance as the coin diameter is larger, and also result in a lower Q of the inductor, as the conductivity of the coin is lower. As a result, data obtained from either the sensor of FIGS. 2A and 2B, or the sensor of FIGS. 3 and 4, can be gathered and analyzed by the apparatus depicted in FIGS. 5 and 6, even though the detected changes in the configuration of FIGS. 3 and 4 will typically be smaller than the changes detected in the configuration of FIGS. 2A and 2B.

Although certain sensor shapes have been described herein, the techniques disclosed for applying multiple frequencies on a single core could be applied to and of a number of sensor shapes, or other means of forming an inductor to subject a coin to an alternating magnetic field.

Figure 11A:
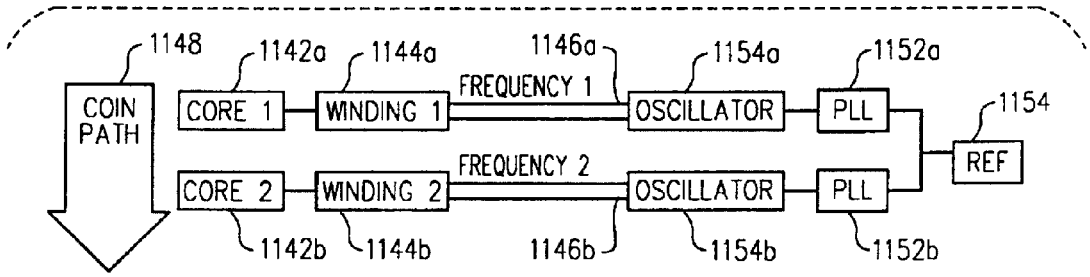
FIG. 11A is a block diagram of a two-core discrimination device, according to an embodiment of the present invention.

Although an embodiment described above provides two AC frequencies to a single sensor core at the same time, other approaches are possible. One approach is a time division approach, in which different frequencies are generated during different, small time periods, as the coin moves past the sensor. This approach presents the difficulty of controlling the oscillator in a "time-slice" fashion, and correlating time periods with frequencies for achieving the desired analysis. Another potential problem with time-multiplexing is the inherent time it takes to accurately measure Q in a resonant circuit. The higher the Q, the longer it takes for the oscillator's amplitude to settle to a stable value. This will limit the rate of switching and ultimately the coin throughput. In another embodiment, two separate sensor cores (1142*a,b* FIG. 11A) can be provided, each with its own winding 1144*a, b* and each driven at a different frequency 1146*a, b*. This approach has not only the advantage of reducing or avoiding harmonic interference, but provides the opportunity of optimizing the core materials or shape to provide the best results at the frequency for which that core is designed. When two or more frequencies are used, analysis of the data can be similar to that described above, with different sets of standard or reference data being provided for each frequency. In one embodiment, multiple cores, such as the two cores 1142*a, b* of FIG. 11A, along the coin path 1148 are driven by different frequencies 1146*a,b* that are phase-locked 1152*a, b* to the same reference 1154, such as a crystal or other reference oscillator. In one embodiment, the oscillators 1154*a, b* that provide the core driving frequencies 1146*a,b* are phase-locked by varactor tuning (e.g as described above) the oscillators 1154*a, b* using the sensing inductor 1154*a, b* as part of the frequency determination.

Figure 2D:
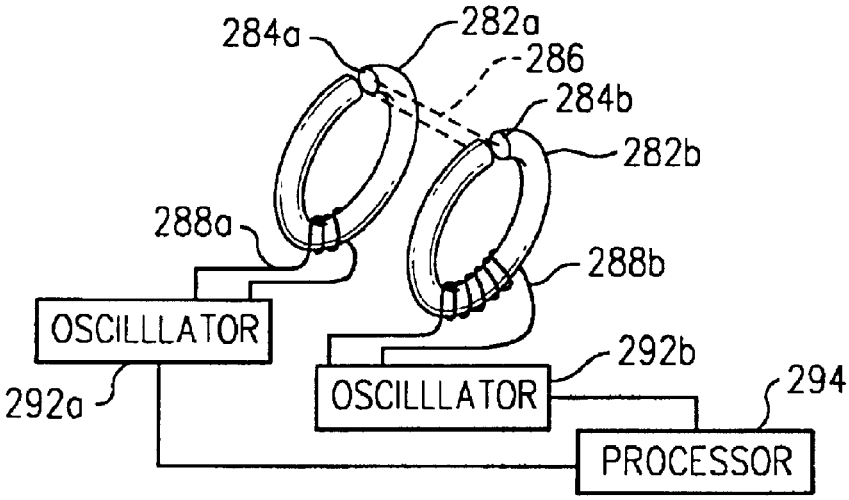
FIG. 2D depicts a two-core configuration according to an embodiment of the present invention.

In one embodiment, a sensor includes first and second ferrite cores, each substantially in the shape of a section of a torus 282*a, b* (FIG. 2D), said first core defining a first gap 284*a,* and said second core defining a second gap 284*b,* said cores positioned with said gaps aligned 286 so that a coin conveyed by said counting device will move through said first and second gaps; at least first and second coils 288*a, b* of conductive material wound about a first portion of each of said first and second cores, respectively; an oscillator 292 a coupled to said first coil 288*a* configured to provide current defining at least a first frequency defining a first skin depth less than said cladding thickness and wherein, when a coin is conveyed past said first gap 282*a,* the signal in said coil undergoes at least a first change in inductance and a change in the quality factor of said inductor; an oscillator 292*b* coupled to said second coil 288*b* configured to provide current defining at least a second frequency defining a second skin depth greater than said first skin depth wherein, when said coin is conveyed past said second gap 284*b,* the signal in said coil undergoes at least a second change in inductance and a second change in the quality factor of said inductor; and a processor 294 configured to receive data indicative of said first and second changes in inductance and changes in quality factor to permit separate characterization of said cladding and said core.

In another embodiment, current provided to the coil is a substantially constant or DC current. This configuration is useful for detecting magnetic (ferromagnetic) v. non-magnetic coins. As the coin moves through or past the gap, there will be eddy current effects, as well as permeability effects. As discussed above, these effects can be used to obtain, e.g., information regarding conductivity, such as core conductivity. Thus, in this configuration such a sensor can provide not only information about the ferromagnetic or non-magnetic nature of the coin, but also regarding the conductivity. Such a configuration can be combined with a high-frequency (skin effect) excitation of the core and, since there would be no low-frequency (and thus no low-frequency harmonics) interference problems would be avoided. It is also possible to use two (or more) cores, one driven with DC, and another with AC. The DC-driven sensor provides another parameter for discrimination (permeability). Permeability measurement can be useful in, for example, discriminating between U.S. coins and certain foreign coins or slugs. Preferably, computer processing is performed in order to remove "speed effects."

Although the invention has been described by way of a preferred embodiment and certain variations and modifications, other variations and modifications can also be used, the invention being defined by the following claims.

What is claimed is:

1. A method in a coin counting machine for processing multiple coins received from a user, the method comprising:

moving at least one coin along a coin path;

sensing a characteristic of the coin to determine if the coin is an acceptable coin or an unacceptable coin;

when the coin is determined to be an acceptable coin, causing the coin to move off of the coin path; and when the coin is determined to be an unacceptable coin, allowing the coin to proceed along the coin path.

2. The method of claim 1 wherein causing the coin to move off to the coin path includes accepting the coin by actuating a coin mover positioned adjacent to the coin path.

3. The method of claim 2 wherein actuating the coin mover includes actuating a resilient door positioned adjacent to the coin path, the resilient door having a retracted position at least generally clear of the coin path and a deflected position at least partially blocking the coin path.

4. The method of claim 2 wherein moving the coin along the coin path includes moving the coin along a first part of the coin path under the force of gravity, wherein allowing the unacceptable coin to proceed along the coin path includes allowing the unacceptable coin to continue moving along a second part of the coin path under the force of gravity, and wherein the first part of the coin path is positioned upstream of the coin mover and the second part of the coin path is positioned downstream of the coin mover.

5. The method of claim 2 wherein moving the coin along the coin path includes rolling the coin along a first part of the coin path under the force of gravity, wherein allowing the unacceptable coin to proceed along the coin path includes allowing the unacceptable coin to continue rolling along a second part of the coin path under the force of gravity, and wherein the first part of the coin path is positioned upstream of the coin mover and the second part of the coin path is positioned downstream of the coin mover.

6. The method of claim 1 wherein moving the coin along the coin path includes moving the coin along a first part of the coin path under the force of gravity, wherein allowing the unacceptable coin to proceed along the coin path includes allowing the unacceptable coin to continue moving along a second part of the coin path under the force of gravity, and wherein the first part of the coin path and the second part of the coin path are at least generally aligned with each other.

7. The method of claim 1 wherein causing the acceptable coin to move off of the coin path includes deflecting the acceptable coin off of the coin path and into a coin receptacle for collection by the coin counting machine.

8. The method of claim 1 wherein allowing the unacceptable coin to proceed along the coin path includes returning the unacceptable coin to a user of the coin counting machine.

9. The method of claim 1, further comprising dispensing a redeemable voucher from the coin counting machine when the coin is determined to be an acceptable coin.

10. The method of claim 1, further comprising at least approximately simultaneously receiving multiple randomly oriented coins of different denomination in a coin receiving region of the coin counting machine, and wherein moving at least one coin along a coin path includes moving at least one of the received coins along the coin path.

11. A method for separating acceptable coins from unacceptable coins in a coin counting machine, the method comprising:

moving a first coin along a coin path;

sensing a characteristic of the first coin to determine if the first coin is an acceptable coin or an unacceptable coin;

moving a second coin along the coin path;

measuring a gap between the first coin and the second coin relative to the coin path to determine if the gap is an acceptable gap or an unacceptable gap;

when the first coin is determined to be an acceptable coin and the measured gap is determined to be an acceptable gap, actuating a coin mover positioned adjacent to the coin path to cause the first coin to move off of the coin path; and when the first coin is determined to be an acceptable coin and the measured gap is determined to be an unacceptable gap, allowing the first coin to proceed along the coin path.

12. The method of claim 11, further comprising, when the first coin is determined to be an unacceptable coin, allowing the first coin to proceed along the coin path.

13. The method of claim 11 wherein measuring the gap between the first coin and the second coin to determine if the gap is an acceptable gap or an unacceptable gap includes comparing the measured gap to a first criteria to determine if the measured gap meets the first criteria, and wherein the method further comprises:

when the first coin is determined to be an unacceptable coin, sensing the second coin with the coin sensor positioned adjacent to the coin path to determine if the second coin is an acceptable coin or an unacceptable coin;

when the second coin is determined to be an acceptable coin:

comparing the measured gap between the first coin and the second coin to a second criteria to determine if the measured gap meets the second criteria;

when the measured gap between the first coin and the second coin meets the second criteria, actuating the coin mover positioned adjacent to the coin path to cause the second coin to move off of the coin path; and when the measured gap between the first coin and the second coin does not meet the second criteria, allowing the second coin to proceed along the coin path.

14. The method of claim 13 wherein the first criteria is a first distance and the second criteria is a second distance less than the first distance.

15. The method of claim 11 wherein measuring the gap between the first coin and the second coin relative to the coin path includes determining a spatial distance between the first coin and the second coin.

16. The method of claim 11 wherein measuring the gap between the first coin and the second coin relative to the coin path includes determining a time increment between the first coin and the second coin.

17. The method of claim 11 wherein actuating the coin mover to cause the first coin to move off of the coin path includes deflecting the first coin off of the coin path and into a coin receptacle for collection by the coin counting machine.

18. The method of claim 11 wherein allowing the first coin to proceed along the coin path includes allowing the first coin to proceed along the coin path for return to a user of the coin counting machine.

19. The method of claim 11 wherein measuring the gap between the first coin and the second coin relative to the coin path to determine if the gap is an acceptable gap or an unacceptable gap includes:

measuring a time increment related to the passages of the first coin and the second coin relative to the coin sensor; and determining a distance between the first coin and the second coin based on the measured time increment and a velocity associated with the second coin, an acceleration associated with the second coin, or both the velocity and the acceleration associated with the second coin.

20. A method for separating acceptable coins from unacceptable coins in a coin counting machine, the method comprising:

moving a first coin along a coin path;

sensing the first coin with a coin sensor positioned adjacent to the coin path to determine if the coin is an acceptable coin or an unacceptable coin;

moving a second coin along the coin path;

measuring a gap between the first coin and the second coin relative to the coin path to determine if the gap is an acceptable gap or an unacceptable gap; and when the first coin is determined to be an acceptable coin and the measured gap is determined to be an acceptable gap, selecting the first coin for collection by the coin counting machine; and when the first coin is determined to be an acceptable coin and the measured gap is determined to be an unacceptable gap, rejecting the first coin for collection by the coin counting machine.

21. The method of claim 20, further comprising, when the first coin is determined to be an unacceptable coin, rejecting the first coin for collection by the coin counting machine.

22. The method of claim 20 wherein measuring a gap between the first coin and the second coin relative to the coin path includes determining a spatial distance between the first coin and the second coin.

23. The method of claim 20 wherein selecting the first coin for collection by the coin counting machine includes diverting the first coin off of the coin path and into a coin receptacle, and wherein rejecting the first coin for collection by the coin counting machine includes allowing the first coin to proceed along the coin path for return to a user of the coin counting machine.

24. The method of claim 20 wherein measuring the gap between the first coin and the second coin relative to the coin path to determine if the gap is an acceptable gap or an unacceptable gap includes:

measuring a time increment related to the passages of the first coin and the second coin relative to the coin sensor; and determining a distance between the first coin and the second coin based on the measured time increment and a velocity associated with the second coin, an acceleration associated with the second coin, or both the velocity and the acceleration associated with the second coin.

25. A method in a coin counting machine for separating coins received from a user into acceptable coins and unacceptable coins, the method comprising:

moving a first coin along a coin path;

moving a second coin along the coin path;

measuring a gap between the first coin and the second coin relative to the coin path to determine if the gap is an acceptable gap or an unacceptable gap; and when the measured gap is determined to be an unacceptable gap, returning the first coin to the user.

26. The method of claim 25 wherein measuring the gap between the first coin and the second coin relative to the coin path includes determining a spatial distance between the first coin and the second coin.

27. The method of claim 25 wherein measuring the gap between the first coin and the second coin relative to the coin path includes determining a time increment between the first coin and the second coin.

28. The method of claim 25 wherein measuring the gap between the first coin and the second coin relative to the coin path to determine if the gap is an acceptable gap or an unacceptable gap includes:

measuring a time increment associated with the first coin and the second coin passing a coin sensor; and determining a distance between the first coin and the second coin based on the measured time increment and a velocity associated with the second coin, an acceleration associated with the second coin, or both the velocity and the acceleration associated with the second coin.

29. The method of claim 25 wherein moving the first coin along the coin path includes moving the first coin along a first part of the coin path under the force of gravity, and wherein returning the first coin to the user includes allowing the first coin to proceed along a second part of the coin path under the force of gravity.

30. A method for selecting coins in a coin counting machine, the coin counting machine including a coin sensor and a coin mover, the coin sensor and the coin mover being positioned adjacent to a coin path and being spaced apart to define a distance between the coin sensor and the coin mover, the method comprising:

moving a coin along the coin path relative to the coin sensor;

as the coin moves relative to the coin sensor, measuring the velocity of the moving coin, the acceleration of the moving coin, or both the velocity and the acceleration of the moving coin; and based on the distance between the coin sensor and the coin mover and the measured velocity of the moving coin, the measured acceleration of the moving coin, or both the measured velocity and the measured acceleration of the moving coin, determining when to actuate the coin mover causing the coin mover to move the coin.

31. The method of claim 30 wherein moving the coin along the coin path includes rolling the coin along an inclined path between the coin sensor and the coin mover.

32. The method of claim 30 wherein determining when to actuate the coin mover includes determining when to deflect a resilient door positioned adjacent to the coin path to divert the coin off of the coin path.

33. The method of claim 30 wherein measuring the velocity of the moving coin includes:

identifying the coin;

obtaining a radius for the identified coin;

determining the amount of time it takes the coin to travel a distance equivalent to the obtained radius; and calculating the velocity of the moving coin based on the determined amount of time and the obtained radius.

34. The method of claim 30 wherein measuring the acceleration of the moving coin includes:

determining a first coin velocity at a first point along the coin path;

determining a second coin velocity at a second point along the coin path different than the first point; and calculating an acceleration of the moving coin based on the determined first coin velocity and the determined second coin velocity.

35. A system for processing a plurality of coins received from a user, the system comprising:

means for moving at least one of the plurality of coins along a coin path;

means for determining if the coin is an acceptable coin or an unacceptable coin as the coin is moving along the coin path;

means for accepting the coin when the coin is determined to be an acceptable coin by diverting the coin off of the coin path; and means for returning the coin to the user when the coin is determined to be an unacceptable coin by allowing the coin to proceed along the coin path.

36. The system of claim 35 wherein the means for moving the at least one coin along the coin path includes means for rolling the at least one coin along a coin path that is at least generally straight from the means for determining to the means for accepting.

37. A system for separating acceptable coins from unacceptable coins in a coin counting machine, the system comprising:

means for moving a first coin along a coin path;

means for determining if the first coin is an acceptable coin or an unacceptable coin as the first coin is moving along the coin path;

means for moving a second coin along the coin path;

means for measuring a gap between the first coin and the second coin relative to the coin path to determine if the gap is an acceptable gap or an unacceptable gap; and means for accepting the first coin by causing the first coin to move off of the coin path when the first coin is determined to be an acceptable coin and the measured gap is determined to be an acceptable gap.

38. The system of claim 37, further comprising means for rejecting the first coin by allowing the first coin to proceed along the coin path when the first coin is determined to be an unacceptable coin or the measured gap is determined to be an unacceptable gap.

39. The system of claim 37 wherein the means for measuring the gap between the first coin and the second coin relative to the coin path include means for determining a spatial distance between the first coin and the second coin.

40. The system of claim 37 wherein the means for measuring the gap between the first coin and the second coin relative to the coin path include means for determining a velocity, an acceleration, or both a velocity and an acceleration of the first coin.

41. A coin counting machine comprising:

a coin path;

a coin sensor positioned adjacent to the coin path and configured to discriminate acceptable coins from unacceptable coins; and a coin mover positioned adjacent to the coin path downstream of the coin sensor, wherein the coin mover is configured to move acceptable coins off of the coin path and allow unacceptable coins to proceed along the coin path.

42. The coin counting machine of claim 41 further comprising a computer processor operably connected to the coin sensor and the coin mover, the computer processor being configured to receive coin discrimination information from the coin sensor and provide an actuation signal to the coin mover when the coin discrimination information indicates an acceptable coin is proceeding along the coin path from the coin sensor to the coin mover.

43. The coin counting machine of claim 41 further comprising a computer processor operably connected to the coin sensor and the coin mover, the computer processor being configured to receive coin discrimination information from the coin sensor and provide an actuation signal to the coin mover when the coin discrimination information indicates an acceptable coin is proceeding along the coin path from the coin sensor to the coin mover, the actuation signal causing the coin mover to deflect relative to the coin path and divert the acceptable coin off of the coin path and into a coin receptacle for collection by the coin counting machine.

44. The coin counting machine of claim 41, further comprising a coin receiving region configured to at least approximately simultaneously receive multiple randomly oriented coins of different denomination, and wherein the coin path is configured to receive coins from the coin receiving region.

* * * * *

UNITED STATES PATENT AND TRADEMARK OFFICE

CERTIFICATE OF CORRECTION

PATENT NO. : 6,766,892 B2
DATED : July 27, 2004
INVENTOR(S) : Douglas Alan Martin et al.

It is certified that error appears in the above-identified patent and that said Letters Patent is hereby corrected as shown below:

Column 18,
Line 67, “describe” should be -- described --;

Column 20,
Line 39, “lest” should be -- least --;

Column 21,
Line 26, “fraction” should be -- friction --;

Column 22,
Line 16, “dimension” should be -- dimensions --.

Signed and Sealed this

Twenty-third Day of November, 2004

JON W. DUDAS
*Director of the United States Patent and Trademark Office*